US011701291B2

(12) United States Patent
Nagamitsu et al.

(10) Patent No.: US 11,701,291 B2
(45) Date of Patent: Jul. 18, 2023

(54) MASSAGE MACHINE

(71) Applicant: FAMILY INADA CO., LTD., Osaka (JP)

(72) Inventors: Tomoki Nagamitsu, Tottori (JP); Tomoharu Fukuda, Tottori (JP); Atsushi Moritomo, Tottori (JP); Nichimu Inada, Osaka (JP)

(73) Assignee: FAMILY INADA CO., LTD., Osaka (JP)

( * ) Notice: Subject to any disclaimer, the term of this patent is extended or adjusted under 35 U.S.C. 154(b) by 1098 days.

(21) Appl. No.: 16/260,678

(22) Filed: Jan. 29, 2019

(65) Prior Publication Data

US 2019/0151187 A1 May 23, 2019

Related U.S. Application Data

(63) Continuation of application No. PCT/JP2018/019532, filed on May 21, 2018.

(30) Foreign Application Priority Data

Jun. 2, 2017 (JP) ..... 2017-110215
Jun. 2, 2017 (JP) ..... 2017-110216
(Continued)

(51) Int. Cl.
*A61H 7/00* (2006.01)
*A61H 9/00* (2006.01)
(Continued)

(52) U.S. Cl.
CPC ..... *A61H 7/007* (2013.01); *A61H 1/00* (2013.01); *A61H 7/00* (2013.01); *A61H 7/004* (2013.01);
(Continued)

(58) Field of Classification Search
CPC .... A61H 2201/0149; A61H 2201/1614; A61H 2205/062; A61H 2205/081; A61H 7/007
See application file for complete search history.

(56) References Cited

U.S. PATENT DOCUMENTS 4,009,710 A * 3/1977 Inada ..... A61H 23/0254 601/108
6,200,282 B1 * 3/2001 Furuie ..... A61H 23/006 601/108
(Continued)

FOREIGN PATENT DOCUMENTS

JP H09299432 A * 11/1997
JP 2004-033583 A 2/2004
(Continued)

OTHER PUBLICATIONS

International Search Report issued in Application No. PCT/JP2018/019532, dated Aug. 7, 2018.

*Primary Examiner* — Justine R Yu
*Assistant Examiner* — Christopher E Miller
(74) *Attorney, Agent, or Firm* — Michael Best & Friedrich LLP

(57) ABSTRACT

A massage machine includes a seat unit on which a treatment subject person is configured to sit, a backrest unit configured to support a back of the person sitting on the seat unit, a base that is disposed in front of the backrest unit; and a treatment mechanism that is attached to the base configured to perform a massage on a shoulder of the person in a state where the person sits on the seat unit. The treatment mechanism includes a drive unit which includes an output shaft attached to the base and rotated by supplied power, and a treatment device configured to press the shoulder from above. In accordance with rotation of the output shaft, the treatment
(Continued)

device oscillates in an upward/downward direction so as to perform the treatment on the shoulder.

25 Claims, 35 Drawing Sheets

(30) Foreign Application Priority Data

| | | |
|---|---|---|
| Aug. 31, 2017 | (JP) | 2017-167320 |
| Mar. 2, 2018 | (JP) | 2018-038088 |
| Mar. 30, 2018 | (JP) | 2018-069271 |

(51) Int. Cl.
*A61H 1/00* (2006.01)
*A61H 39/04* (2006.01)
*A61H 23/00* (2006.01)

(52) U.S. Cl.
CPC ..... *A61H 9/0078* (2013.01); *A61H 23/006* (2013.01); *A61H 39/04* (2013.01); *A61H 2201/0149* (2013.01); *A61H 2201/0176* (2013.01); *A61H 2201/0192* (2013.01); *A61H 2201/1207* (2013.01); *A61H 2201/1215* (2013.01); *A61H 2201/1418* (2013.01); *A61H 2201/1427* (2013.01); *A61H 2201/164* (2013.01); *A61H 2201/1604* (2013.01); *A61H 2201/169* (2013.01); *A61H 2201/1609* (2013.01); *A61H 2201/1614* (2013.01); *A61H 2201/1623* (2013.01); *A61H 2201/1633* (2013.01); *A61H 2201/1635* (2013.01); *A61H 2201/1664* (2013.01); *A61H 2201/1678* (2013.01); *A61H 2201/50* (2013.01); *A61H 2201/5064* (2013.01); *A61H 2201/5071* (2013.01); *A61H 2203/0431* (2013.01); *A61H 2205/04* (2013.01); *A61H 2205/06* (2013.01); *A61H 2205/062* (2013.01); *A61H 2205/081* (2013.01); *A61H 2205/088* (2013.01); *A61H 2205/10* (2013.01); *A61H 2205/12* (2013.01)

(56) References Cited

U.S. PATENT DOCUMENTS

| | | | | |
|---|---|---|---|---|
| 6,585,668 | B2 * | 7/2003 | Nissim | A61H 7/001 601/134 |
| 2002/0177796 | A1 * | 11/2002 | Suh | A61H 7/001 601/84 |
| 2002/0183665 | A1 * | 12/2002 | Suh | A61H 7/001 601/84 |
| 2007/0149907 | A1 * | 6/2007 | Ting | A61H 7/007 601/99 |
| 2007/0299377 | A1 | 12/2007 | Shiraishi | |
| 2010/0081972 | A1 * | 4/2010 | Kan | 601/99 |
| 2014/0343467 | A1 | 11/2014 | Fukuyama et al. | |

FOREIGN PATENT DOCUMENTS

| | | | | |
|---|---|---|---|---|
| JP | 2004-033583 | A | | 2/2004 |
| JP | 2004033583 | A | * | 2/2004 |
| JP | 2005-046541 | A | | 2/2005 |
| JP | 2009-219817 | A | | 10/2009 |
| JP | 2012-010854 | A | | 1/2012 |
| JP | 2012-010854 | A | | 1/2012 |
| JP | 2012010854 | A | * | 1/2012 |
| JP | 2012-120549 | A | | 6/2012 |
| JP | 2012-120549 | A | | 6/2012 |
| JP | 2012120549 | A | * | 6/2012 |
| JP | 2013-009733 | A | | 1/2013 |
| JP | 2015-211718 | A | | 11/2015 |
| KR | 20020082322 | A | * | 10/2002 |
| WO | 2014/027494 | A1 | | 2/2014 |
| WO | 2016/006327 | A1 | | 1/2016 |

* cited by examiner

MASSAGE MACHINE

RELATED APPLICATIONS

This is a continuation of International Application No. PCT/JP2018/019532 filed on May 21, 2018 claiming Paris Convention priority based on Japanese Patent Application Nos. 2017-110215 and 2017-110216 filed on Jun. 2, 2017, 2017-167320 filed on Aug. 31, 2017, 2018-038088 filed on Mar. 2, 2018 and 2018-069271 filed on Mar. 30, 2018, the contents of these applications of which are incorporated herein by reference in their entirety.

TECHNICAL FIELD

The present invention relates to a massage machine.

BACKGROUND ART

In the related art, a massage machine is known which performs kneading or patting treatment by pinching a shoulder of a treatment subject person. For example, JP-A-2005-046541 discloses a massage machine (stationary-type massage device) that has shoulder kneading means for pinching front and rear sites of each shoulder on the right and left sides of the treatment subject person who lies on the back, with a pair of kneading hands, and has a massage mechanism for realizing movement closer to or away from the front and rear sites of the shoulder with the pair of kneading hands.

For another example, JP-A-2012-120549 discloses a massage machine that has a first arm and a second arm which are arranged with an interval therebetween, and which moves closer to or away from each other so that the shoulder of the treatment subject person is pinched between tip contact portions. The massage machine further has a rotary shaft which is rotatably attached to the first arm and the second arm so as to change the interval between the first arm and the second arm. At least one of the first arm and the second arm is attached to the rotary shaft in an eccentric and inclined manner.

SUMMARY OF INVENTION

A massage machine according to the present invention includes a seat unit on which a treatment subject person is configured to sit, a backrest unit configured to support a back of the person sitting on the seat unit, a base that is disposed in front of the backrest unit; and a shoulder treatment mechanism that is attached to the base configured to perform a massage on a shoulder of the person in a state where the person sits on the seat unit. The treatment mechanism includes a drive unit which includes an output shaft attached to the base and rotated by supplied power, and a treatment device configured to press the shoulder from above. In accordance with rotation of the output shaft, the treatment device oscillates in an upward/downward direction so as to perform the treatment on the shoulder.

The shoulder treatment mechanism may include a drive unit which has an output shaft attached to the base so as to be rotated by supplied power, a first treatment device which presses the shoulder of the treatment subject person from above, and a second treatment device. When viewed along a width direction of the backrest unit, the second treatment device is located in front of the first treatment device. When viewed along the width direction of the backrest unit, in accordance with rotation of the output shaft, the first treatment device and the second treatment device perform treatment on the shoulder of the treatment subject person in conjunction with each other so as to change a distance between the first treatment device and the second treatment device.

When the treatment is performed by pressing the shoulder of the treatment subject person from above, the following treatment is suitable. The first treatment device and the second treatment device are moved in conjunction with each other. While the shoulder of the treatment subject person is held by the second treatment device in the shoulder treatment mechanism, the shoulder is pressed by the first treatment device from above. Accordingly, according to this characteristic configuration, while the front side of the shoulder of the treatment subject person is held by the second treatment device, the treatment can be suitably performed on the shoulder of the treatment subject person from above by using the first treatment device.

Therefore, according to the above-described configuration, it is possible to realize the massage machine which performs the treatment as follows. The pair of treatment devices is operated in conjunction with each other. While one of the treatment devices holds the front side of the shoulder of the treatment subject person, the other one of the treatment devices presses the shoulder from above.

In the massage machine according to the present invention, it is preferable that the shoulder treatment mechanism further includes a swash plate cam which is obliquely attached to the output shaft extending in an upward/downward direction, and a treatment device holder which is attached to the swash plate cam so as to oscillate in the upward/downward direction without being rotated together by rotation of the swash plate cam, that the first treatment device is integrally attached to the treatment device holder, and that the second treatment device is attached so that a base end side is oscillable around an oscillation axis extending along the width direction in which the treatment device holder is disposed, and a tip side performs the treatment on the shoulder of the treatment subject person.

BRIEF DESCRIPTION OF DRAWINGS

FIG. 31A illustrates a state when a left foot is viewed from above, and FIG. 31B illustrates a state where a left leg is viewed from the lateral side.

DESCRIPTION OF THE INVENTION

Figure 1:
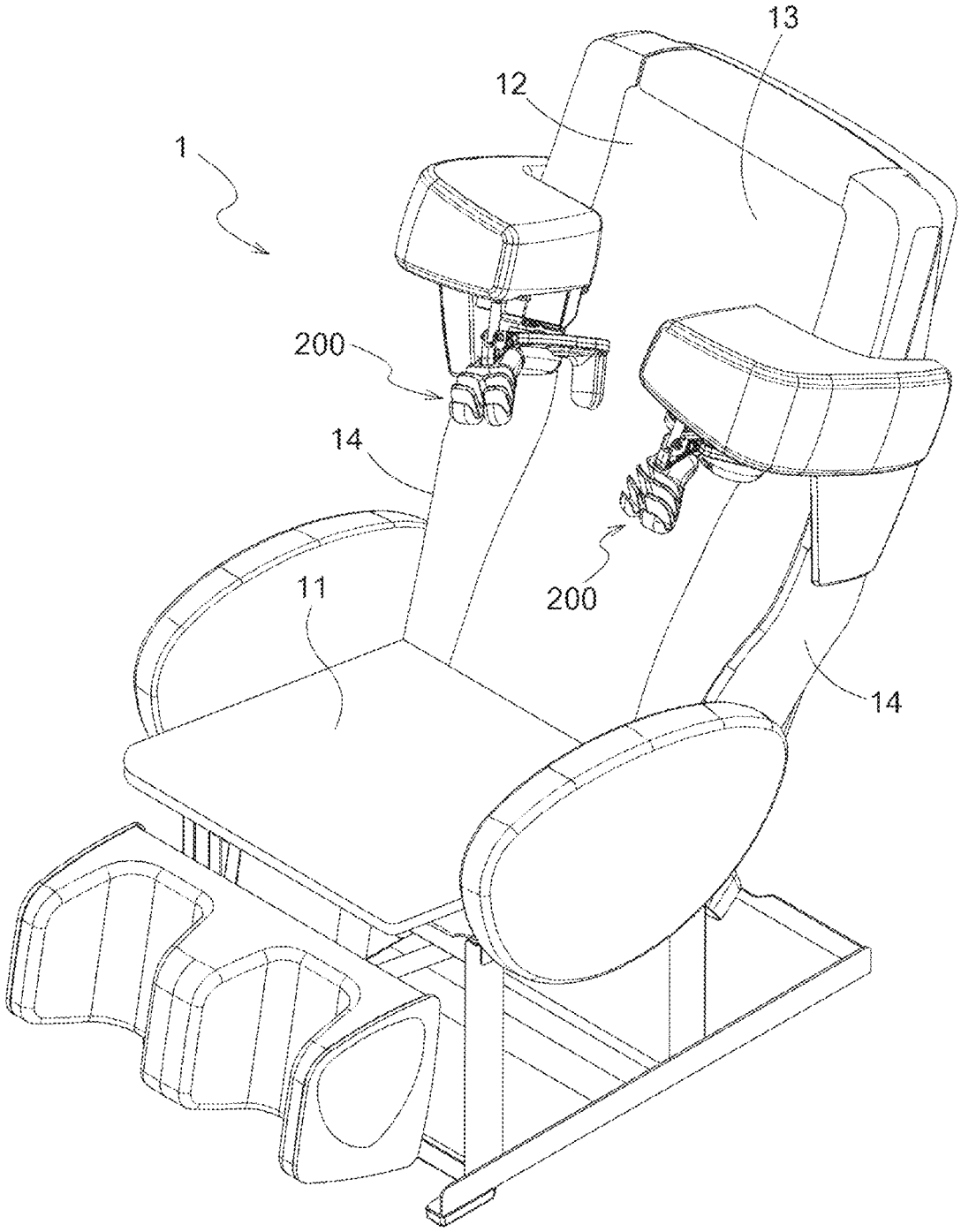
FIG. 1 is a perspective view illustrating an overall configuration of a massage machine according to a first embodiment.

Since the swash plate cam, a simple configuration enables the first treatment device to oscillate in the upward/downward direction, and the shoulder of the treatment subject person can be pressed from above. In addition, since the second treatment device is attached so as to be oscillable around the oscillation axis extending along the width direction. In this manner, the shoulder of the treatment subject person can be suitably held.

In the massage machine according to the present invention, it is preferable that the second treatment device is further supported by a link, and that one end portion of the link is rotatably attached to the base, and the other end portion of the link supports the second treatment device so as to be oscillable around the oscillation axis extending along the width direction between the base end side and the tip side of the second treatment device.

In the massage machine according to the present invention, it is preferable that the link extends in the upward/downward direction, the one end portion is located on an upper side, and the other end portion is located on a lower side.

Since the second treatment device is supported by the link, more complicated movement can be realized, compared to a case where the second treatment device is attached to the treatment device holder as a rigid body. Therefore, the movement of the treatment devices can be more similar to the movement of the fingers used when the shoulder is kneaded with the fingers of the treatment providing person.

In the massage machine according to the present invention, it is preferable that the swash plate cam is configured to include an annular bearing, and the output shaft is attached so as to be eccentric with respect to a center of the annular bearing.

According to this configuration, the movement of the first treatment device and the second treatment device which are moved by the swash plate cam can be added to the oscillation in the upward/downward direction, and it is possible to add the movement in the forward/rearward/rightward/leftward directions. In this manner, it is possible to press not only a specific site of the shoulder but also a peripheral site thereof. Therefore, it is possible to relax shoulder stiffness, and a treatment effect can be further improved.

In the massage machine according to the present invention, it is preferable that when viewed in a forward/rearward direction, the base is inclined in a direction away from the seat unit as the base is oriented inward in the width direction from a side surface of the backrest unit.

When a person is viewed from the front, the shoulder of the person is inclined so as to rise upward as the shoulder is closer to a spine. Therefore, according to the above-described configuration, the shoulder treatment mechanism attached to the base can be efficiently aligned with the shoulder of the treatment subject person.

In the massage machine according to the present invention, it is preferable that when viewed in the upward/downward direction, the base is inclined in a direction closer to the backrest unit as the base is oriented inward in the width direction from a side surface of the backrest unit.

When a person is viewed from above, an end portion of the shoulder of the person is located most forward, and the shoulder is inclined rearward as the shoulder is closer to the spine. Therefore, according to the above-described configuration, the shoulder treatment mechanism attached to the base can be efficiently aligned with the shoulder of the treatment subject person.

In the massage machine according to the present invention, it is preferable that the base has a first base and a second base, that the second base is attached to the first base so that a base end side is oscillable, that the drive unit is attached to the second base, and that a biasing member for biasing a tip side of the second base in a direction away from the first base is provided between the first base and the second base.

According to this configuration, even if a biasing force of the biasing member causes the first treatment device and the second treatment device to oscillate in the upward/downward direction, the treatment devices are not separated from the shoulder of the treatment subject person during the treatment. While always holding the shoulder from the front side, the treatment devices can press the shoulder from above. In this case, the oscillation of the first treatment device in the upward/downward direction and the biasing force of the biasing member can periodically change a force of the first treatment device pressing the shoulder. Therefore, even though the treatment is performed by the massage machine, the treatment subject person can feel as if the treatment is more similar to the treatment performed by the treatment providing person with the fingers.

In the massage machine according to the present invention, it is preferable that a width of a tip portion of the second treatment device is wider than a width of a tip portion of the first treatment device.

In the massage machine according to the present invention, the first treatment device imitates the thumb, and the second treatment device imitates the remaining four fingers. Therefore, according to the above-described configuration, the movement of the treatment devices can be more similar to the movement of the fingers used when the shoulder of the treatment subject person is kneaded with the thumb and the four fingers of the treatment providing person.

In the massage machine according to the present invention, it is preferable that when viewed along the width direction of the backrest unit, a tip portion of the second treatment device is located below a tip portion of the first treatment device.

In the massage machine according to the present invention, the first treatment device imitates the thumb, and the second treatment device imitates the remaining four fingers. Then, in a case where the treatment providing person kneads the shoulder of the treatment subject person, the remaining four fingers are located below the thumb when viewed along the width direction. Therefore, according to the above-described configuration, the movement of the treatment devices can be more similar to the movement of the fingers used when the shoulder of the treatment subject person is kneaded with the thumb and the four fingers of the treatment providing person.

In the massage machine according to the present invention, it is preferable that the shoulder treatment mechanism is movable in the upward/downward direction.

According to this configuration, even when the treatment subject persons whose seated heights are different from each other sit on the seat unit, the shoulder treatment mechanism can be moved to an optimal height in accordance with each height of the shoulder of the respective treatment subject persons.

In the massage machine according to the present invention, it is preferable that the shoulder treatment mechanism is movable in the width direction.

According to this configuration, even when the treatment subject persons whose shoulder widths are different from each other sit on the seat unit, the shoulder treatment mechanism can be moved to an optimal width in accordance with each shoulder width of the respective treatment subject persons.

In the massage machine according to the present invention, it is preferable that the first treatment device and/or the second treatment device have/has an air bag.

According to this configuration, the shoulder can be treated or held by the air bag from the front side and/or from above.

In the massage machine according to the present invention, it is preferable that the massage machine has an air supply/discharge unit capable of inflating and deflating the air bag, and that the air supply/discharge unit is capable of adjusting strength of the treatment using the air bag, and holding a treatment subject site.

According to this configuration, the strength of the treatment can be individually adjusted, or the treatment unit can be held in accordance with an individual body shape.

In the massage machine according to the present invention, it is preferable that the massage machine has a control unit capable of controlling the drive unit and the air supply/discharge unit, and that the control unit is capable of controlling the drive unit and the air supply/discharge unit independently of each other.

According to this configuration, the treatment can be performed by combining the mechanical treatment using the drive unit with the air-assisting treatment using the air supply/discharge unit.

In the massage machine according to the present invention, it is preferable that the massage machine has a support body that is disposed closer to the treatment subject person than the air bag, a third treatment device that is disposed in the support body, and a forward/rearward movement mechanism capable of moving the support body forward to and rearward from the treatment subject person by inflating and deflating the air bag.

According to this configuration, the strength of the treatment of the third treatment device can be changed by inflating and deflating the air bag. In addition, it is possible to perform the treatment which is different from pressing treatment using the air bag.

In the massage machine according to the present invention, it is preferable that the massage machine further has a pillow that supports a head of the treatment subject person, and that the pillow has position adjustment means which is capable of adjusting a head position of the treatment subject person in the forward/rearward direction.

According to this configuration, when the back is treated using the treatment unit inside the backrest unit, it is possible to eliminate an oppressive feeling of the shoulder treatment mechanism located beside the head of the treatment subject person. In addition, when the treatment is performed using the shoulder treatment mechanism, the treatment can be performed at an optimal position.

In the massage machine according to the present invention, it is preferable that the biasing member is configured to include an air bag and an air supply/discharge unit capable of inflating and deflating the air bag, that the massage machine includes a control unit capable of controlling the drive unit and the air supply/discharge unit, and that the control unit is capable of controlling the drive unit and the air supply/discharge unit independently of each other.

According to this configuration, it is possible to suitably adjust the strength of the treatment using the first treatment device and the second treatment device. For example, it is possible to change a force of pressing the shoulder by the drive unit adjusting the inflated and deflated amount of the air bag during the treatment using the first treatment device and the second treatment device.

In the massage machine according to the present invention, it is preferable that the massage machine has movement means capable of moving the shoulder treatment mechanism in a height direction of the shoulder treatment mechanism, first detection means for detecting a specific position in the height direction of the treatment subject person, second detection means for detecting an oscillation position of the second base with respect to the first base, and a control unit capable of controlling the movement means, and that the control unit performs a first step of causing the first detection means to detect a specific position in a height direction of the shoulder treatment mechanism and a second step of causing the second detection means to detect an oscillation position of the second base so as to specify an optimal treatment position of the shoulder treatment mechanism with respect to the shoulder of the treatment subject person.

According to this configuration, the optimal treatment position of the shoulder treatment mechanism can be specified with respect to the shoulder of the treatment subject person. Therefore, the treatment can be effectively performed on the shoulder of the treatment subject person.

In the massage machine according to the present invention, it is preferable that the movement means has a lifting/lowering motor, and that the control unit stops the lifting/lowering motor in a case where a load applied to the lifting/lowering motor reaches a predetermined value or greater.

According to this configuration, the lifting/lowering motor is stopped. In this manner, the treatment can be safely performed on the shoulder of the treatment subject person, and excessive movement can be prevented.

In the massage machine according to the present invention, it is preferable that the backrest unit has a mechanical treatment unit movable in the height direction of the treatment subject person with respect to the back of the treatment subject person, and third detection means for detecting a specific position in the height direction of the treatment subject person by moving the treatment unit, and that the control unit sets a shoulder position of the treatment subject person which is detected by the third detection means as a reference position so as to specify a movement position of the shoulder treatment mechanism in the first step, based on the reference position.

According to this configuration, the shoulder position information of the backrest unit can be reflected in the treatment position of the shoulder treatment mechanism, and a time required for detecting the treatment position can be shortened.

In the massage machine according to the present invention, it is preferable that the massage machine has reclining means for causing the backrest unit to recline against the seat unit, and that the control unit performs the first step and the second step on position misalignment of the treatment subject person with respect to the backrest unit which is caused by the reclining means, and corrects a treatment position of the treatment subject person in the shoulder treatment mechanism.

According to this configuration, the position misalignment of the treatment subject person can be corrected with respect to the backrest unit. Therefore, even if a posture of the treatment subject person is changed, the treatment subject person can receive the treatment at a suitable position.

In the massage machine according to the present invention, it is preferable that the control unit stops driving of the shoulder treatment mechanism, in a case where the oscillation position detected by the second detection means reaches a predetermined value or greater.

According to this configuration, when the treatment subject person is separated from the shoulder treatment mechanism during the treatment of the shoulder treatment mechanism, it is detected that the treatment subject person is separated from the shoulder treatment mechanism, thereby enabling the treatment subject person to be safely separated therefrom. In addition, when the shoulder treatment mechanism is moved to the vicinity of the head during the treatment of the shoulder treatment mechanism, it is possible to prevent a possibility that the treatment may be performed on the head.

In the massage machine according to the present invention, it is preferable that a fourth treatment device is attached to a position facing at least a shoulder outer surface or an upper arm outer surface of the treatment subject person.

According to this configuration, the treatment can be performed on the shoulder outer surface or the upper arm outer surface of the treatment subject person.

In the massage machine according to the present invention, it is preferable that the fourth treatment device is attached to a side wall portion which protrudes rearward from an outer side in the width direction of the second treatment device.

According to this configuration, the treatment device can perform the treatment or can hold the shoulder or the upper arm of the treatment subject person, not only from the front side and/or from above but also from the lateral side.

In the massage machine according to the present invention, it is preferable that the fourth treatment device has an air bag.

According to this configuration, the air bag can perform the treatment or can hold the shoulder or the upper arm.

In the massage machine according to the present invention, it is preferable that the air bag is attached to a front side as a fulcrum in the forward/rearward direction of the side wall portion.

According to this configuration, the shoulder or the upper arm can be treated or held from behind the side surface. For example, while the second treatment device performs the treatment or holds the shoulder or the upper arm from the front surface and/or from above, the air bag (fourth treatment device) can perform the treatment or hold the shoulder or the upper arm from the lateral side. That is, the shoulder or the upper arm can be treated or held in three directions.

In the massage machine according to the present invention, it is preferable that the massage machine includes a seat unit on which a treatment subject person sits, and a treatment mechanism that performs treatment on the treatment subject person, that the treatment mechanism further includes a base, a drive unit which has an output shaft attached to the base so as to be rotated by supplied power, a first treatment device and a second treatment device which perform the treatment on a treatment subject site of the treatment subject person, a swash plate cam which is obliquely attached along the output shaft, and a treatment device holder which is attached to the swash plate cam, that the first treatment device is integrally attached to the treatment device holder, that the second treatment device is attached so that a base end side is oscillable around an oscillation axis extending along an axial direction intersecting the output shaft disposed in the treatment device holder, that the treatment mechanism is disposed in the seat unit, and that the treatment mechanism is capable of performing the treatment on at least one of a hip and a thigh of the treatment subject person. According to this characteristic configuration, while the second treatment device holds at least one of the hip and thigh of the treatment subject person sitting on the seat unit, the first treatment device can suitably perform the treatment. A plurality of sites of the hip and the thigh may be simultaneously treated by providing a plurality of treatment mechanisms for the seat unit.

In the massage machine according to the present invention, it is preferable that the massage machine includes a backrest unit on which a treatment subject person rests, and a treatment mechanism that performs treatment on the treatment subject person, that the treatment mechanism further includes a base, a drive unit which has an output shaft attached to the base so as to be rotated by supplied power, a first treatment device and a second treatment device which perform the treatment on a treatment subject site of the treatment subject person, a swash plate cam which is obliquely attached along the output shaft, and a treatment device holder which is attached to the swash plate cam, that the first treatment device is integrally attached to the treatment device holder, that the second treatment device is attached so that a base end side is oscillable around an oscillation axis extending along an axial direction intersecting the output shaft disposed in the treatment device holder, that the treatment mechanism is disposed in the backrest unit, and that the treatment mechanism is capable of performing the treatment on at least one among a neck, a back, and a waist of the treatment subject person. According to this characteristic configuration, while the second treatment device holds at least one among the neck, the back, and the waist of the treatment subject person resting on the backrest unit, the first treatment device can suitably perform the treatment. A plurality of sites, for example, such as the neck and the back, the neck and the waist, the back and the waist, or the neck, the waist, and the back, may be simultaneously treated by providing a plurality of treatment mechanisms for the backrest unit.

In the massage machine according to the present invention, it is preferable that the massage machine includes a footrest unit that supports a lower thigh of a treatment subject person, and a treatment mechanism that performs treatment on the treatment subject person, that the treatment mechanism further includes a base, a drive unit which has an output shaft attached to the base so as to be rotated by supplied power, a first treatment device and a second treatment device which perform the treatment on a treatment subject site of the treatment subject person, a swash plate cam which is obliquely attached along the output shaft, and a treatment device holder which is attached to the swash plate cam, that the first treatment device is integrally attached to the treatment device holder, that the second treatment device is attached so that a base end side is oscillable around an oscillation axis extending along an axial direction intersecting the output shaft disposed in the treatment device holder, that the treatment mechanism is disposed in the footrest unit, and that the treatment mechanism is capable of performing the treatment on at least one of a leg and a foot of the treatment subject person. According to this characteristic configuration, while the second treatment device holds at least one of the leg and the foot of the treatment subject person supported by the footrest unit, the first treatment device can suitably perform the treatment. A plurality of sites of the leg and the foot may be simultaneously treated by providing a plurality of treatment mechanisms for the footrest unit.

In the massage machine according to the present invention, it is preferable that the massage machine an armrest unit that supports an arm of a treatment subject person, and a treatment mechanism that performs treatment on the treatment subject person, that the treatment mechanism further includes a base, a drive unit which has an output shaft attached to the base so as to be rotated by supplied power, a first treatment device and a second treatment device which perform the treatment on a treatment subject site of the treatment subject person, a swash plate cam which is obliquely attached along the output shaft, and a treatment device holder which is attached to the swash plate cam, that the first treatment device is integrally attached to the treatment device holder, that the second treatment device is attached so that a base end side is oscillable around an oscillation axis extending along an axial direction intersecting the output shaft disposed in the treatment device holder, that the treatment mechanism is disposed in the armrest unit, and that the treatment mechanism is capable of performing the treatment on the arm of the treatment subject person. According to this characteristic configuration, while the second treatment device holds the arm of the treatment subject person supported by the armrest unit, the first treatment device can suitably perform the treatment. A plurality of sites, for example, such as the finger and the arm, the finger and the upper arm, the arm and the upper arm, or the finger, the arm, and the upper arm, may be simultaneously treated by providing a plurality of treatment mechanisms for the armrest unit.

When the treatment is performed by pressing the treatment subject site of the treatment subject person, the following treatment is suitable. The first treatment device and the second treatment device are moved in conjunction with each other. While the treatment subject site of the treatment subject person is held by the second treatment device in the treatment mechanism, the treatment subject site is pressed by the first treatment device.

Therefore, according to the above-described configuration, it is possible to realize the massage machine which performs the treatment as follows. The pair of treatment devices is operated in conjunction with each other. While one of the treatment devices holds the treatment subject site, the other one of the treatment devices presses the treatment subject site.

In addition, since the swash plate cam is used, a simple configuration enables the first treatment device to oscillate in the upward/downward direction, and the treatment subject site of the treatment subject person can be pressed from above. Since the second treatment device is attached so as to be oscillable around the oscillation axis extending along the width direction, the treatment subject site of the treatment subject person can be suitably held.

It is preferable that the second treatment device is further supported by a link, and that one end portion of the link is rotatably attached to the base, and the other end portion of the link supports the second treatment device so as to be oscillable around the oscillation axis extending along the axial direction intersecting the output shaft between the base end side and the tip side of the second treatment device.

Since the second treatment device is supported by the link, more complicated movement can be realized, compared to a case where the second treatment device is attached to the treatment device holder as a rigid body. Therefore, the movement of the treatment devices can be more similar to the movement of the fingers used when the shoulder is kneaded with the fingers of the treatment providing person.

It is preferable that the first treatment device and/or the second treatment device have/has an air bag. According to this configuration, the treatment subject site can be treated or held by the air bag.

It is preferable that a pair of the right and left treatment mechanisms is disposed across a center line in a rightward/leftward direction of a body of the treatment subject person, that the treatment mechanisms are attached along the height direction of the treatment subject person, that the first treatment device is located in a direction closer to the center line than the second treatment device, and that the second treatment device is located in a direction farther away from the center line than the first treatment device. According to this configuration, the first treatment device can treat or hold the inner side in the rightward/leftward direction of the treatment subject site, and the second treatment device can treat or hold the outer side in the rightward/leftward direction of the treatment subject site.

It is preferable that a pair of the right and left treatment mechanisms is disposed across a center line in a rightward/leftward direction of a body of the treatment subject person, that the second treatment device is located in a direction closer to the center line than the first treatment device, and that the first treatment device is located in a direction farther away from the center line than the second treatment device. According to this configuration, the first treatment device can treat or hold the outer side in the rightward/leftward direction of the treatment subject site, and the second treatment device can treat or hold the inner side in the rightward/leftward direction of the treatment subject site.

In order to solve the second problem, a massage machine according to the present invention adopts a configuration including a seat unit on which a treatment subject person sits, and a backrest unit that supports a back of the treatment subject person sitting on the seat unit, a base that is disposed in front of the backrest unit, and a shoulder treatment mechanism that is attached to the base so as to perform a massage on a shoulder of the treatment subject person in a state where the treatment subject person sits on the seat unit. The shoulder treatment mechanism includes a drive unit which has an output shaft attached to the base and rotated by supplied power, and a treatment device which presses the shoulder of the treatment subject person from above. In accordance with rotation of the output shaft, the treatment device oscillates in an upward/downward direction so as to perform the treatment on the shoulder of the treatment subject person.

When the treatment is performed by pressing the shoulder of the treatment subject person from above, the following treatment is suitable. The treatment device in the shoulder treatment mechanism is caused to oscillate in the upward/downward direction. Therefore, according to this characteristic configuration, the shoulder of the treatment subject person can be suitably treated from above.

Therefore, according to the above-described configuration, it is possible to realize the massage machine which can perform the treatment by pressing the shoulder of the treatment subject person from above.

In the massage machine according to the present invention, it is preferable that the shoulder treatment mechanism further includes a swash plate cam which is obliquely attached to the output shaft extending in an upward/downward direction, and a treatment device holder which is attached to the swash plate cam so as to oscillate in the upward/downward direction without being rotated together by rotation of the swash plate cam, and that the treatment device is integrally attached to the treatment device holder.

Since the swash plate cam is used, a simple configuration enables the treatment device to oscillate in the upward/downward direction.

In the massage machine according to the present invention, it is preferable that the swash plate cam is configured to include an annular bearing, and the output shaft is attached so as to be eccentric with respect to a rotation center of the annular bearing.

According to this configuration, the movement of the treatment device moved by the swash plate cam can be added to the oscillation in the upward/downward direction, and it is possible to add the movement in the forward/rearward/rightward/leftward directions. In this manner, it is possible to press not only a specific site of the shoulder but also a peripheral site thereof. Therefore, it is possible to relax shoulder stiffness, and a treatment effect can be further improved.

In the massage machine according to the present invention, it is preferable that when viewed in a forward/rearward direction, the base is inclined in a direction away from the seat unit as the base is oriented inward in the width direction from a side surface of the backrest unit.

When a person is viewed from the front side, the shoulder of the person is inclined so as to rise upward as the shoulder is closer to the spine. Therefore, according to the above-described configuration, the shoulder treatment mechanism attached to the base can be efficiently aligned with the shoulder of the treatment subject person.

In the massage machine according to the present invention, it is preferable that when viewed in an upward/downward direction, the base is inclined in a direction closer to the backrest unit as the base is oriented inward in the width direction from a side surface of the backrest unit.

When the person is viewed from above, the end portion of the shoulder of the person is located most forward, and the shoulder is inclined rearward as the shoulder is closer to the spine. Therefore, according to the above-described configuration, the shoulder treatment mechanism attached to the base can be efficiently aligned with the shoulder of the treatment subject person.

In the massage machine according to the present invention, it is preferable that the base has a first base and a second base, that the second base is attached to the first base so that a base end side is oscillable, that the drive unit is attached to the second base, and that a biasing member for biasing a tip side of the second base in a direction away from the first base is provided between the first base and the second base.

According to this configuration, even if the biasing force of the biasing member causes the treatment device to oscillate in the upward/downward direction, the treatment device is not separated from the shoulder of the treatment subject person during the treatment. The shoulder can be always pressed from above. In this case, the oscillation of the treatment device in the upward/downward direction and the biasing force of the biasing member can periodically change a force of the treatment device pressing the shoulder. Therefore, even though the treatment is performed by the massage machine, the treatment subject person can feel as if the treatment is more similar to the treatment performed by the treatment providing person with the fingers.

In the massage machine according to the present invention, it is preferable that the shoulder treatment mechanism is movable in the upward/downward direction.

According to this configuration, even when the treatment subject persons whose seated heights are different from each other sit on the seat unit, the shoulder treatment mechanism can be moved to an optimal height in accordance with each height of the shoulder of the respective treatment subject persons.

In the massage machine according to the present invention, it is preferable that the shoulder treatment mechanism is movable in the width direction.

According to this configuration, even when the treatment subject persons whose shoulder widths are different from each other sit on the seat unit, the shoulder treatment mechanism can be moved to an optimal width in accordance with each shoulder width of the respective treatment subject persons.

DESCRIPTION OF THE EMBODIMENTS

Hereinafter, embodiments according to the present invention will be described in detail with reference to the drawings. The embodiments described below are examples for describing the present invention, and the present invention is not limited only to these embodiments. Therefore, the present invention can be embodied in various forms as long as the forms do not depart from the gist of the present invention.

(1) First Embodiment

Overall Configuration

FIG. 1 illustrates an overall structure of a massage machine 1 according to the present embodiment. The massage machine 1 includes a seat unit 11, a backrest unit 12, a support unit 100 (not illustrated), and a shoulder treatment mechanism 200. The seat unit 11 is used when a treatment subject person sits thereon in a state where a hip or a thigh of the treatment subject person is in contact with the seat unit 11. The backrest unit 12 supports a back of the treatment subject person sitting on the seat unit 11. Hereinafter, an abdominal side in a state where the treatment subject person sits on the seat unit 11 in the massage machine 1 will be defined as a "front side," a back side will be defined as a "rear side," a right hand side will be defined as a "right side," a left hand side will be defined as a "left side," a head side will be defined as an "upper side," and a foot side will be defined as a "lower side." In addition, a direction parallel to a shoulder width direction of the treatment subject person will be defined as a "width direction" or a "rightward/leftward direction," a direction parallel to a direction rearward from the front side will be defined as a "forward/rearward direction," and a direction perpendicular to both the width direction and the forward/rearward direction will be defined as an "upward/downward direction."

In the following description of the embodiments, the support unit 100, the base 210, the shoulder treatment mechanism 200 on the left side (side treating a left shoulder) illustrated in FIG. 1 will be described. In the support unit 100, the base 210, and the shoulder treatment mechanism 200, the right side and the left side have mutually symmetrical shapes. Accordingly, a shape on the right side will be omitted in the description.

[Support Unit]

The support unit 100 is attached to right and left side surfaces 14 and 14 of the backrest unit 12, which are surfaces intersecting a back contact surface 13 with which a back of the treatment subject person comes into contact. In the present embodiment, the support unit 100 is attached to the backrest unit 12, but may not be attached to the backrest unit 12 as long as the support unit 100 reclines in conjunction with reclining movement of the backrest unit 12.

Figure 2:
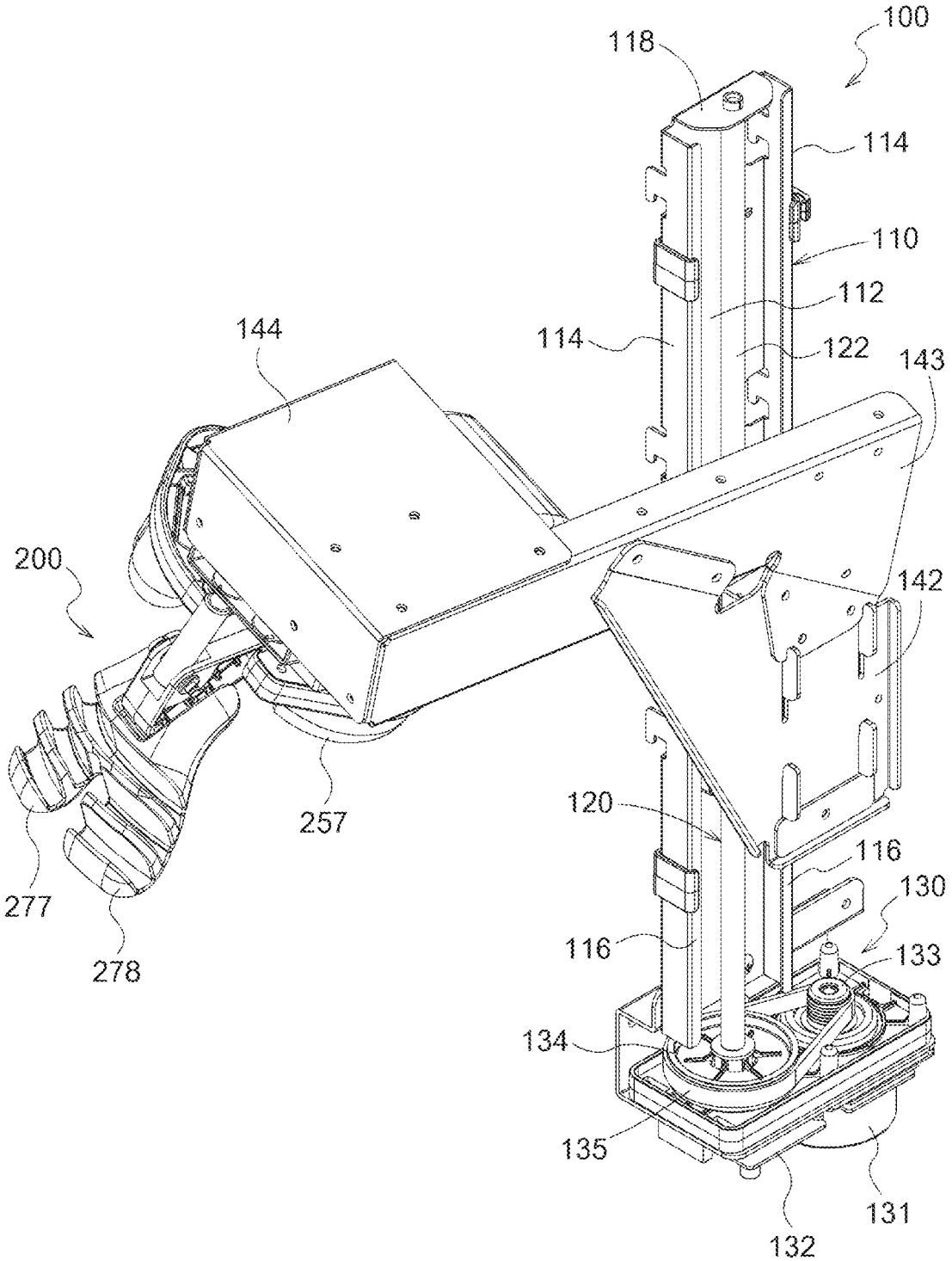
FIG. 2 is a perspective view of a support unit and a shoulder treatment mechanism.
Figure 3:
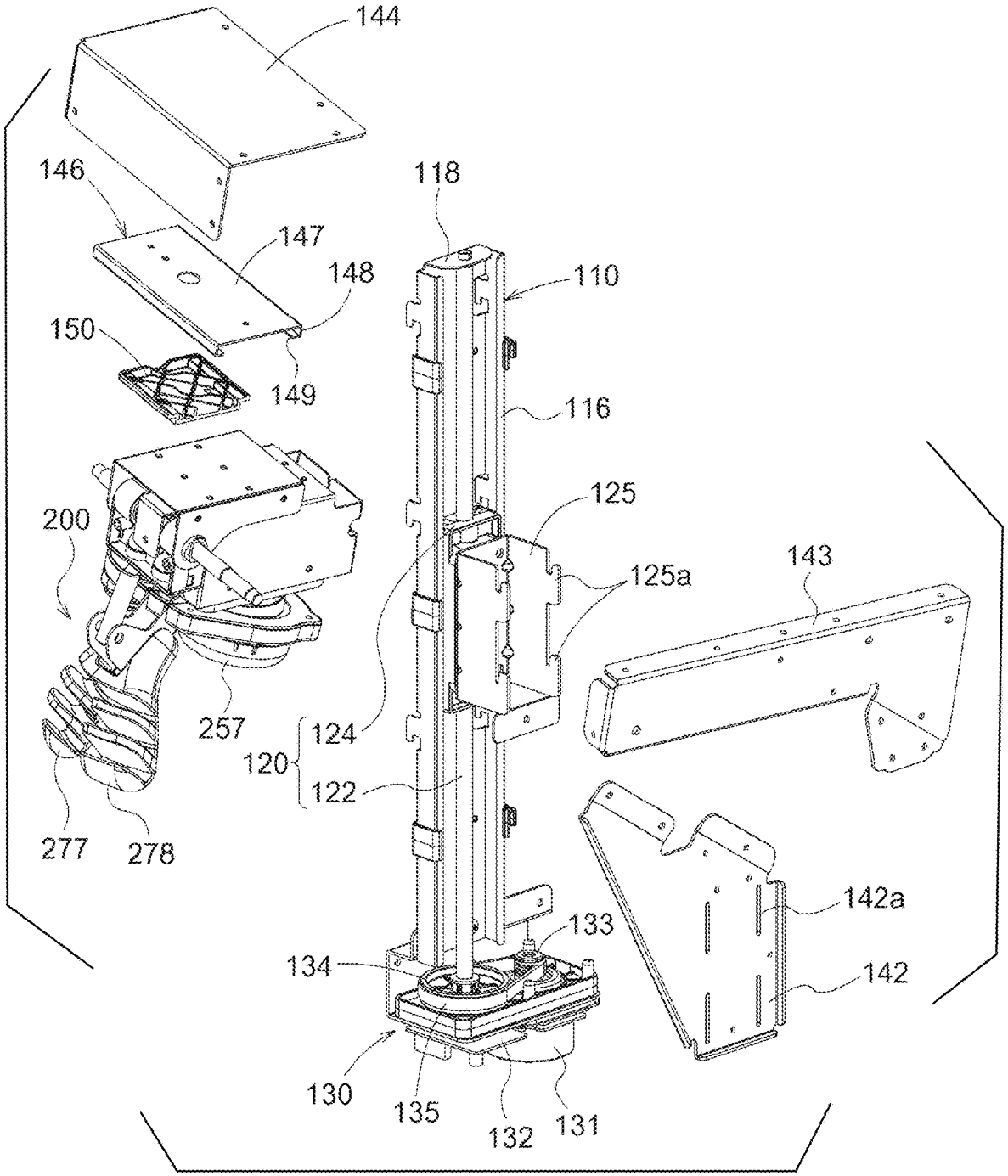
FIG. 3 is an exploded perspective view of the support unit.

As illustrated in FIGS. 2 and 3, the support unit 100 includes a lifting/lowering slide rail 110, a slide screw 120 (male screw 122 and lifting/lowering member 124), a lifting/lowering motor drive unit 130, a first metal plate 142, a second metal plate 143, a third metal plate 144, a rightward/leftward slide rail 146, and a slide plate 150. The lifting/lowering slide rail 110 is formed by bending a metal plate such as an iron plate into a rectangular shape in a cross section, and has a bottom portion 112, a pair of side portions 114 erected in the same direction on both sides of the bottom portion 112, and a pair of claw portions 116 formed by being bent inward from an end portion of both side portions. The male screw 122 parallel to an extending direction of the lifting/lowering slide rail 110 is attached to a space surrounded by the bottom portion 112, the side portions 114, and the claw portion 116 of the lifting/lowering slide rail 110. One end portion of the male screw 122 is connected to the lifting/lowering motor drive unit 130 connected to the lifting/lowering slide rail 110, and the other end portion is supported by a male screw holder 118 erected from the bottom portion 112 of the lifting/lowering slide rail 110.

The lifting/lowering motor drive unit 130 has a brushless DC motor (hereinafter, referred to as a "lifting/lowering motor") 131 having an output shaft serving as movement means capable of moving the shoulder treatment mechanism 200 (to be described later) in a height direction of the treatment subject person, a lifting/lowering motor drive circuit 132 for driving the lifting/lowering motor 131, a small diameter pulley 133 attached to the output shaft of the lifting/lowering motor 131 so as to be integrally rotated, a large-diameter pulley 134 attached to one end portion of the male screw 122 so as to be integrally rotated, and a pulley belt 135 attached between the two pulleys 133 and 134 so as to transmit the rotation of the output shaft to the male screw 122. According to this configuration, the rotation of the output shaft of the lifting/lowering motor 131 is decelerated, and is transmitted to the male screw 122 so as to rotate the male screw 122. However, if the lifting/lowering motor 131 is a type having high torque and low rotation, the male screw 122 may be directly rotated without the pulleys.

The lifting/lowering member 124 which internally accommodates a nut (not illustrated) screwed to the male screw 122 is attached to the lifting/lowering slide rail 110. The lifting/lowering member 124 is made of resin which is highly slidable. In the present embodiment, the male screw 122 and the lifting/lowering member 124 configure a slide screw 120. The lifting/lowering member 124 has a substantially rectangular parallelepiped shape having a projection portion (not illustrated) to be engaged by being surrounded by the bottom portion 112, the side portions 114, and the claw portion 116 of the lifting/lowering slide rail 110. In the lifting/lowering member 124, the male screw 122 is rotated forward and rearward. In this manner, the internal nut linearly moves in both directions along the extending direction of the male screw 122. That is, the lifting/lowering member 124 moves in the upward/downward direction in a state where the lifting/lowering member 124 is brought into sliding contact with the lifting/lowering slide rail 110 by forward and rearward rotation of the lifting/lowering motor 131. The shoulder treatment mechanism 200 is attached to the support unit 100 via the base 210 (to be described later), and drives the lifting/lowering motor 131 serving as the movement means so as to move the lifting/lowering member 124 upward and downward. In this manner, even when the treatment subject persons whose seated heights are different from each other sit on the seat unit 11, the shoulder treatment mechanism 200 can be moved in the upward/downward direction which is the height direction of the treatment subject person so as to be located at an optimal height in accordance with the height of the shoulder of the respective treatment subject persons. Instead of the slide screw, a ball screw having a ball may be disposed between the male screw 122 and the nut.

The first metal plate 142 is attached to a support member 125 attached to the lifting/lowering member 124 of the support unit 100 by using a screw. Four hooking claws 125*a* are formed in the support member 125, and four slit holes 142*a* formed in the first metal plate 142 respectively engage with the hooking claws 125*a* (refer to FIG. 2). The second metal plate 143 connected to the first metal plate 142 by using a screw extends forward of the backrest unit 12 from the lifting/lowering slide rail 110. The third metal plate 144 connected to the second metal plate 143 by using a screw extends forward and inward of the backrest unit 12 (in a direction overlapping the backrest unit 12 when viewed along the forward/rearward direction). The third metal plate 144 extends so as to align with a shoulder structure of the treatment subject person (human). That is, the third metal plate 144 is not parallel to the back contact surface 13 and the width direction of the backrest unit 12. The third metal plate 144 is closer to the backrest unit 12 as the third metal plate 144 extends inward from a portion connected to the second metal plate 143, and is configured to be inclined upward.

The rightward/leftward slide rail 146 made of metal is attached to an inner side (lower side) of the third metal plate 144. The rightward/leftward slide rail 146 extends parallel to the extending direction of the third metal plate 144, and has a bottom portion 147, side portions 148, and a claw portion 149, similar to the lifting/lowering slide rail 110. The slide plate 150 which comes into contact with the rightward/leftward slide rail 146 and moves along the extending direction is attached to an inner space of the rightward/leftward slide rail 146. The shoulder treatment mechanism 200 is attached to the slide plate 150 via the base 210. The shoulder treatment mechanism 200 is moved in the width direction along the rightward/leftward slide rail 146, thereby moving the slide plate 150 and the base 210 together in the width direction. In this manner, the shoulder treatment mechanism 200 can be aligned with a suitable position of the shoulder of the treatment subject person. In the present embodiment, the shoulder treatment mechanism 200 is manually moved in the width direction.

In the present embodiment, the lifting/lowering member 124 is lifted and lowered by the lifting/lowering motor 131. However, a configuration may be adopted in which the lifting/lowering member 124 can be manually lifted and lowered. In addition, a configuration may be adopted in which the shoulder treatment mechanism 200 can be moved in the width direction by driving a motor instead of the manual operation. These lifting, lowering, and moving methods can be freely combined with each other.

Base

Figure 4:
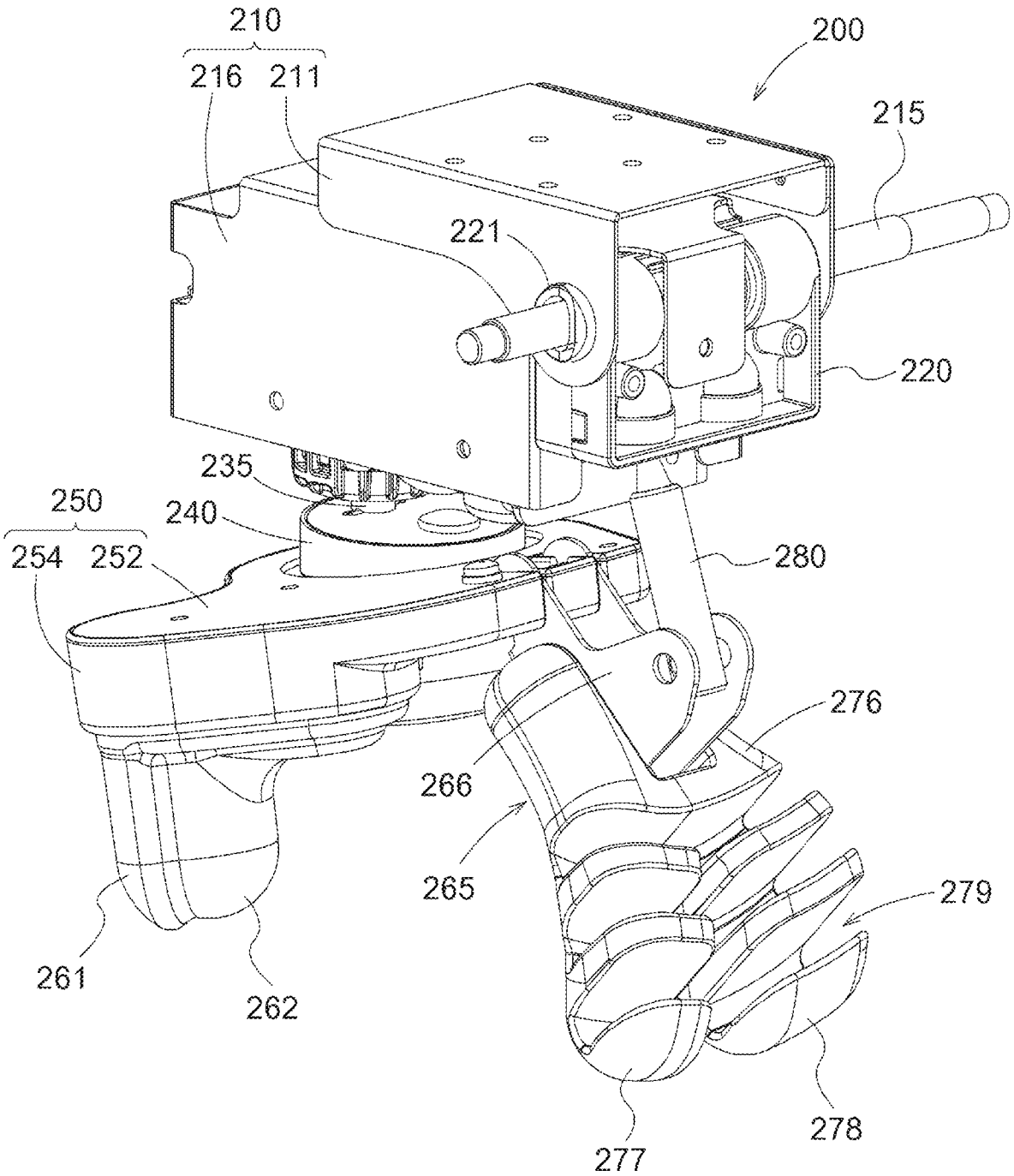
FIG. 4 is a perspective view of a base and the shoulder treatment mechanism.
Figure 5:
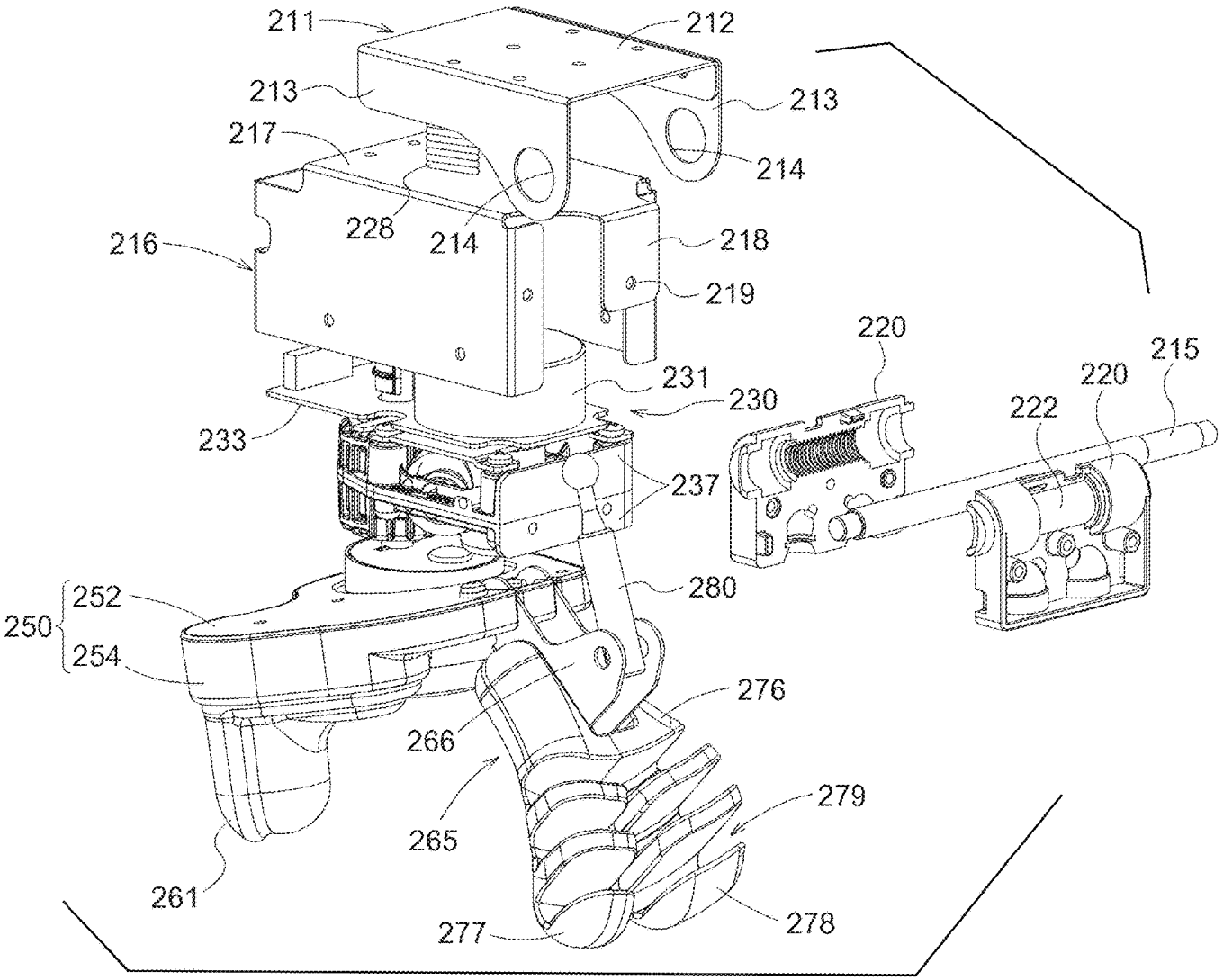
FIG. 5 is an exploded perspective view of the base and the shoulder treatment mechanism.

As illustrated in FIGS. 4 and 5, the base 210 has a first base 211 and a second base 216. The base 210 is attached parallel to the third metal plate 144. That is, when viewed along the forward/rearward direction, the base 210 is not parallel to the width direction, and is configured to be inclined in a direction away from the seat unit 11 as the base 210 faces inward in the width direction from the side surface 14 of the backrest unit 12. In addition, when viewed along the upward/downward direction, the base 210 is not parallel to the back contact surface 13 of the backrest unit 12, and is configured to be inclined in a direction close the backrest unit 12 as the base 210 faces inward in the width direction from the side surface 14 of the backrest unit 12.

The first base 211 is formed by bending a metal plate into a U-shape, and has a bottom portion 212 and a pair of side portions 213. The bottom portion 212 of the first base 211 is attached to the slide plate 150 by using a screw via four spacers (not illustrated). A circular joint holding through-hole 214 is formed at facing positions in the side portions 213. The first base 211 extends in the forward/rearward direction, and the joint holding through-hole 214 is formed in a front end portion of the side portions 213.

The second base 216 is formed by bending a metal plate into a rectangular parallelepiped box shape whose lower surface is open. The second base 216 is located at a position between the bottom portion 212 and the side portion 213 of the first base 211. The bottom portion 217 of the second base 216 faces the bottom portion 212 of the first base 211. A front end of the bottom portion 217 of the second base 216 extends forward, thereby forming a tongue portion 218. A tip of the tongue portion 218 is bent, and extends downward. A tongue portion through-hole 219 is formed in the vicinity of the tip of the tongue portion 218.

A joint portion 220 is disposed between the two joint holding through-holes 214 of the first base 211. The joint portion 220 is configured to have a rectangular parallelepiped shape by combining two resin components with each other, and a pair of cylindrical protrusions 221 is formed on both end surfaces facing the pair of side portions 213 of the first base 211 inside the surface of the joint portion 220. This protrusion 221 is fitted into the joint holding through-hole 214 of the first base 211. In this manner, the joint portion 220 can oscillate around an axis of the protrusion 221 with respect to the first base 211 in the forward/rearward direction and the upward/downward direction. A through-hole is formed at the center of the pair of protrusions 221, and a shaft 215 is inserted into the through-hole (refer to FIG. 4).

A recess 222 is formed in a central portion of the surface located inward of the surface parallel to the oscillation axis of the joint portion 220. The tongue portion 218 of the second base 216 is fitted into the recess 222. A screw is inserted into the tongue portion through-hole 219 formed in the tongue portion 218, and is fixed to the joint portion 220, thereby fixing the second base 216 to the joint portion 220. In this manner, when the joint portion 220 oscillates with respect to the first base 211, the second base 216 also oscillates at the same time.

A compression coil spring 228 serving as an example of the biasing member 239 is attached between the bottom portion 212 of the first base 211 and the bottom portion 217 of the second base 216. In this manner, a force (biasing force) acting around the oscillation axis of the protrusion 221 of the joint portion 220 in a direction away from the first base 211 the second base 216 is always applied to a tip side of the second base 216 (refer to FIGS. 16 and 17).

Figure 16:
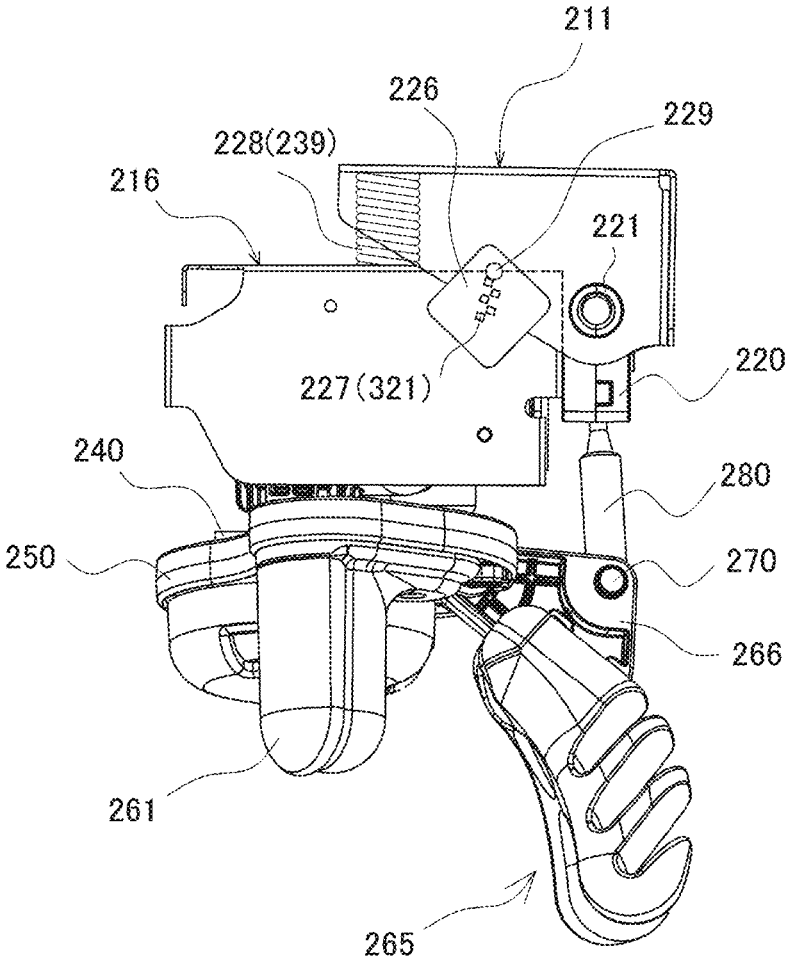
FIG. 16 is a view illustrating an operation of a second base and the shoulder treatment mechanism with respect to a first base.
Figure 17:
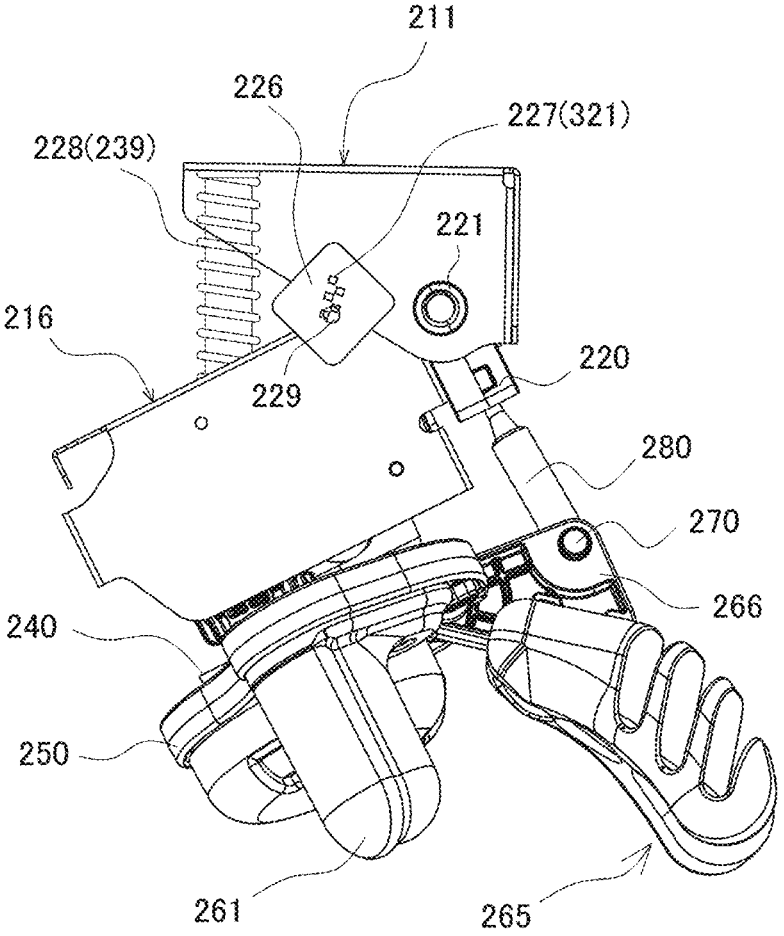
FIG. 17 is a view illustrating an operation of the second base and the shoulder treatment mechanism with respect to the first base.

As illustrated in FIGS. 16 and 17, a magnet 229 is attached to the compression coil spring 228 on a side close to the second base 216. A substrate attached to the first base 211 so as to face a magnetic pole surface of the magnet 229 is equipped with a plurality of Hall elements 227 (or Hall ICs) which are second detection means 321 (to be described later) along an expansion/contraction direction of the compression coil spring 228. An expansion and contraction amount of the compression coil spring 228 by specifying the Hall element 227 whose Hall voltage is detected by the magnet 229 moving close thereto. In addition, the plurality of (five in the embodiment) Hall elements 227 attached onto the substrate 226 of the first base 211 are arranged in a range where the magnet 229 of the second base 216 pivots around the protrusion 221 as the oscillation axis, and are arranged apart from each other so that the magnet 229 lies across the two Hall elements 227. In this manner, it is possible to more delicately detect the expansion and contraction amount. In this way, in a case where an air bag 300 (to be described later) is used instead of the compression coil spring 228, it is possible to more delicately adjust the expansion amount by adjusting an inflating amount of the air bag 300. A configuration may be adopted in which the Hall element 227 is attached to the compression coil spring 228 and the first base 211 includes a plurality of the magnets 229 so as to face the Hall element 227.

Instead of the compression coil spring 228, an air bag 307 whose volume is inflated and deflated by injecting and discharging air may be used as the biasing member 239. Normally, the massage machine 1 includes the air bag 300 for performing the treatment on a place other than the shoulder, for example, such as a forearm, a back, and a calf, and an air supply/discharge unit 301 (to be described later) serving as an air compressor for injecting the air into and discharging the air from the air bag 300. Therefore, even if the air bag 307 is used, without increasing the cost, a force (biasing force) acting in a direction away from the first base 211 can be applied to the tip side of the second base 216. The force (biasing force) acting in the direction away from the first base 211 can be adjusted by adjusting the air amount. For example, the inflating amount is increased for a person who wishes the shoulder to be strongly pressed, and the inflating amount is decreased for a person who desires the shoulder to be weakly pressed weakly. In addition, the drive unit and the air supply/discharge unit 301 for driving the first treatment device 261 and the second treatment device 265 are independently controlled. In this manner, a pressing force applied to the shoulder by the drive unit during the treatment of the first treatment device 261 and the second treatment device 265 is adjusted. Therefore, it is possible to perform various types of treatment on the shoulder of the treatment subject person.

Shoulder Treatment Mechanism

The shoulder treatment mechanism 200 performs the treatment on the shoulder of the treatment subject person, and particularly performs the treatment by pressing the shoulder from above. As illustrated in FIGS. 4 to 12, the shoulder treatment mechanism 200 has a treatment motor drive unit 230, a swash plate cam 240, a treatment device holder 250, a first treatment device 261, and a second treatment device 265. The shoulder treatment mechanism 200 is configured to be movable together with the base 210 in each extending direction of the lifting/lowering slide rail 110 and the rightward/leftward slide rail 146.

(a) Treatment Motor Drive Unit

Figure 6:
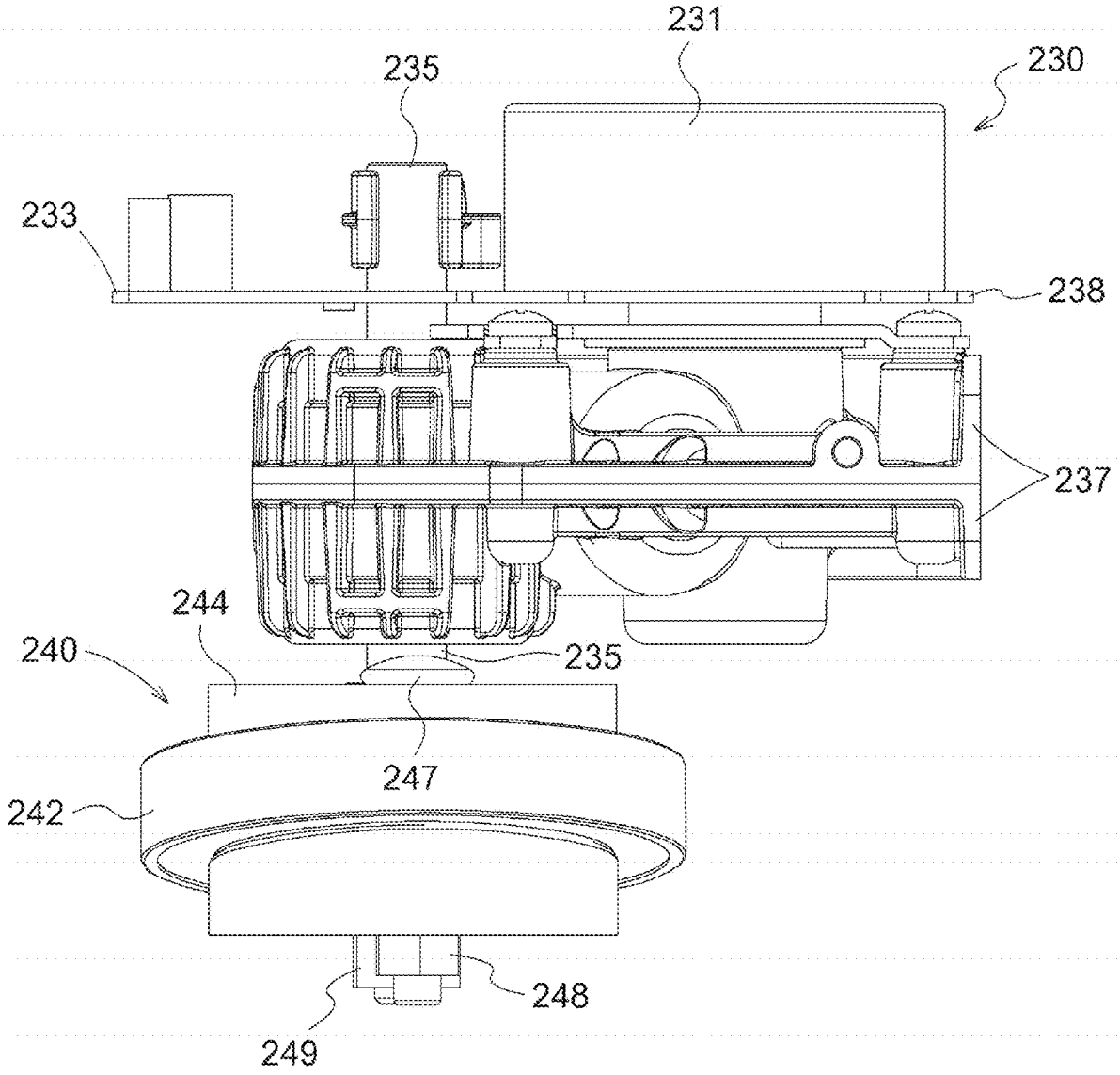
FIG. 6 is a left side view of a treatment motor drive unit and a swash plate cam.
Figure 7:
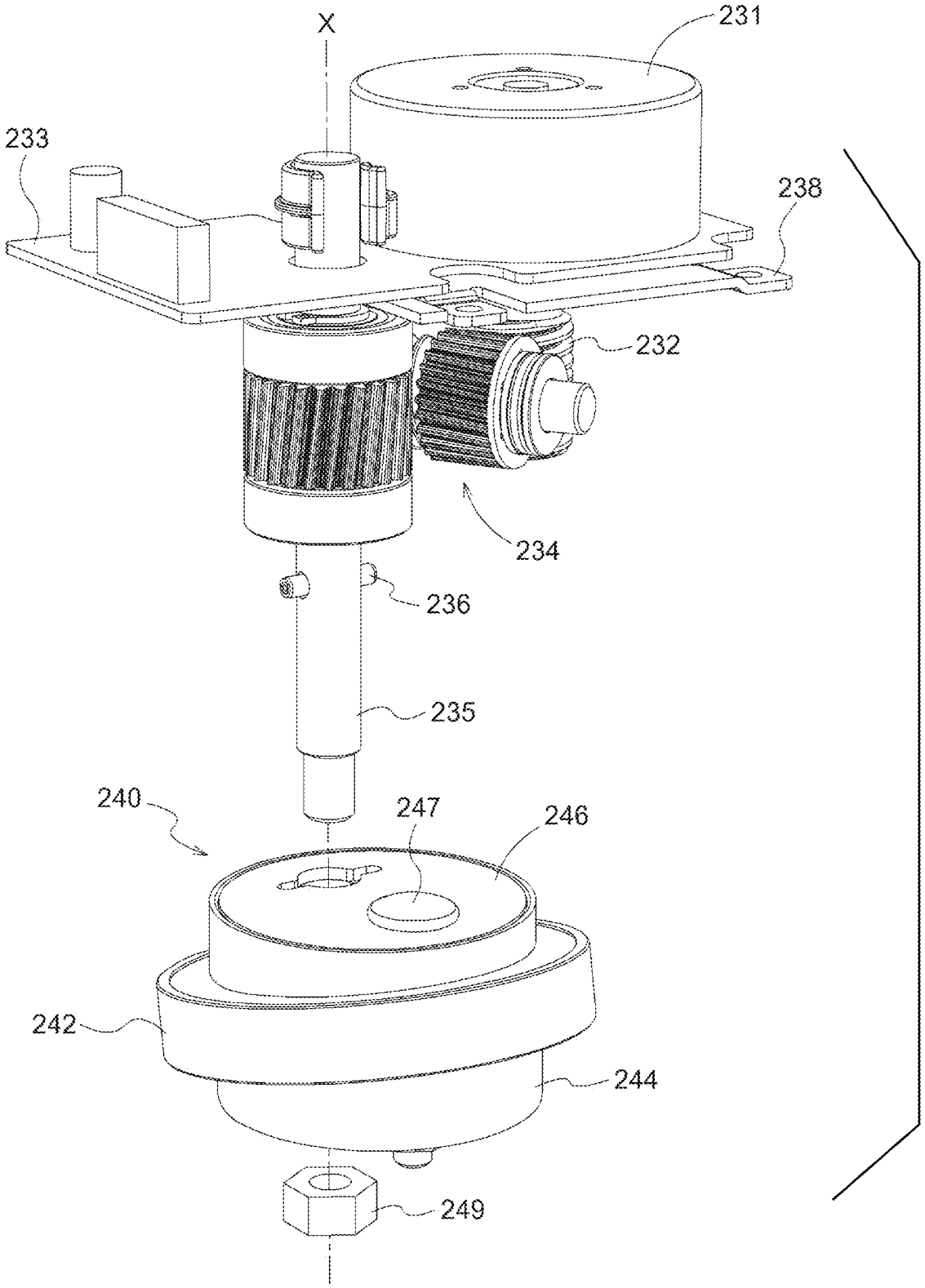
FIG. 7 is an exploded perspective view of the treatment motor drive unit and the swash plate cam in a state where a reduction mechanism case is removed.

As illustrated in FIGS. 5 to 7, the treatment motor drive unit 230 serving as an example of the drive unit is accommodated in an internal space of the second base 216. The treatment motor drive unit 230 has a brushless DC motor (hereinafter, referred to as a "treatment motor") 231 having a worm output shaft 232, a treatment motor drive circuit 233 for driving the treatment motor 231, a worm reduction mechanism 234 for decelerating the rotation of the treatment motor 231 by meshing with the worm output shaft 232 of the treatment motor 231, a treatment output shaft 235 (example of the output shaft) meshing with the worm reduction mechanism 234, and a reduction mechanism case 237.

The worm output shaft 232 and the worm reduction mechanism 234 are accommodated inside the reduction mechanism case 237. The treatment motor 231 and the treatment motor drive circuit 233 except for the worm output shaft 232 are fixed via a stay 238 to the reduction mechanism case 237 by using a screw. The reduction mechanism case 237 is fixed to the side surface of the second base 216 by using a screw, and the treatment motor drive unit 230 is integrated with the second base 216. In addition, the swash plate cam 240 (to be described later) is attached to the treatment output shaft 235.

(b) Swash Plate Cam

Figure 8:
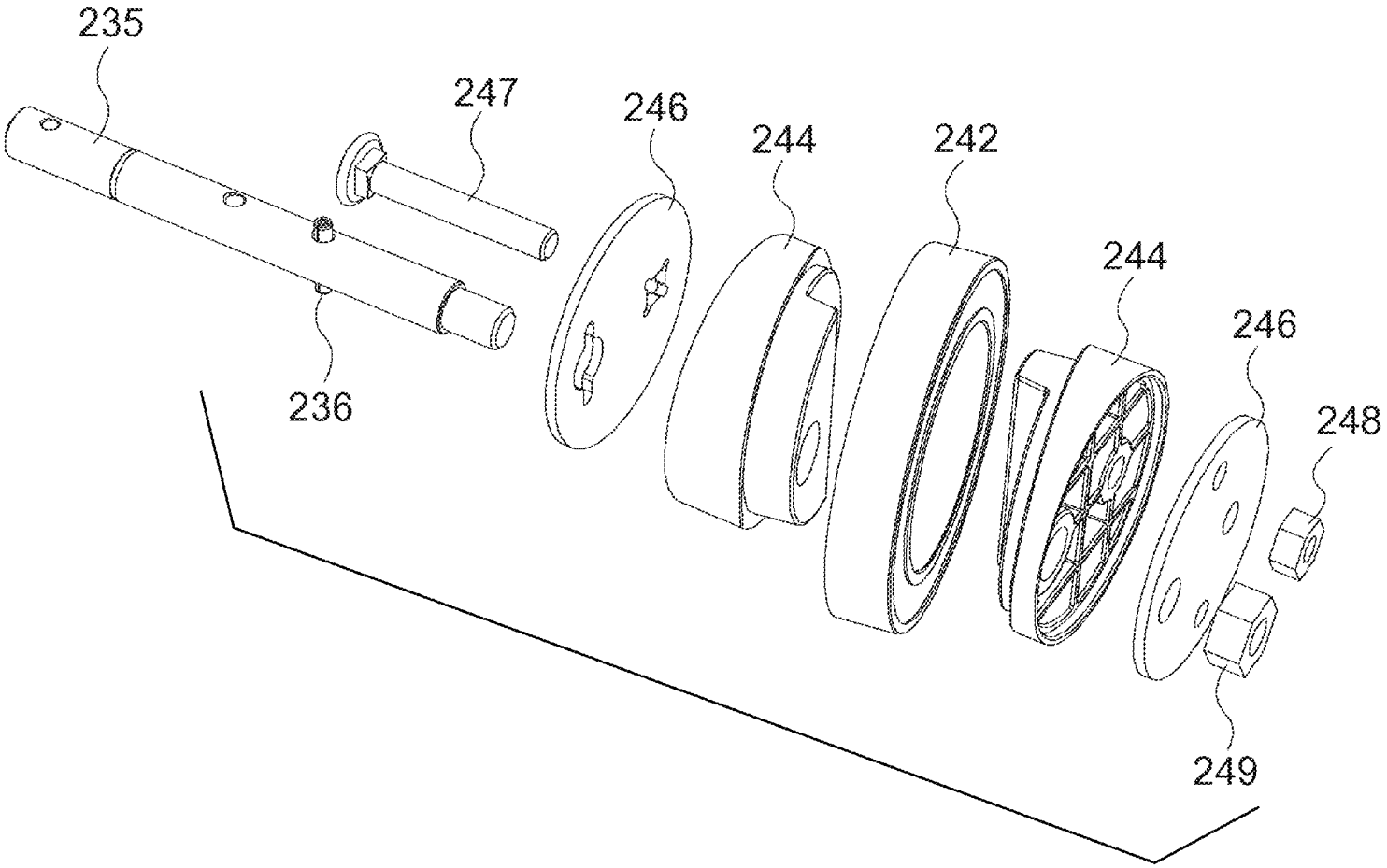
FIG. 8 is an exploded perspective view of the swash plate cam.
Figure 9:
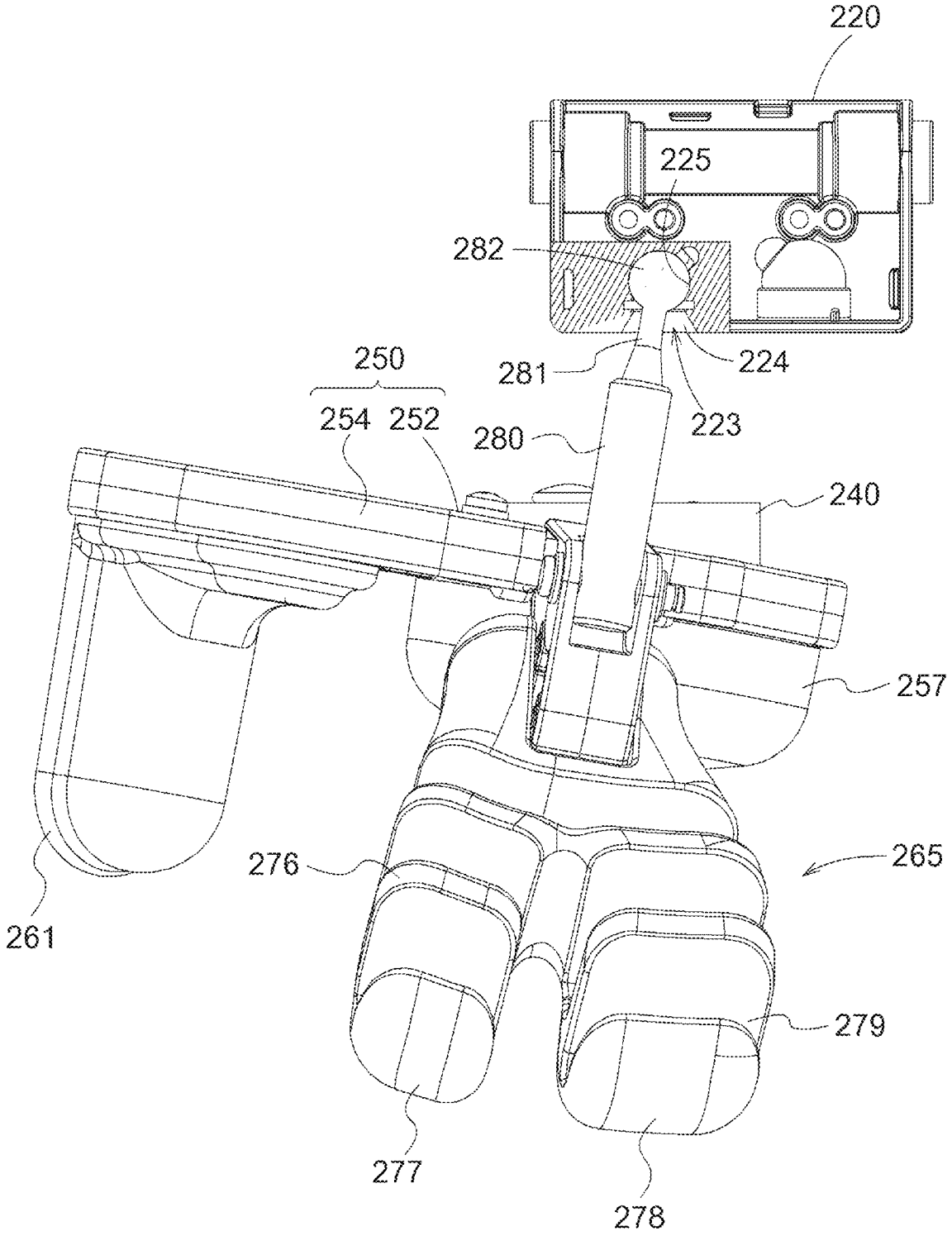
FIG. 9 is a front view of the swash plate cam, a treatment device holder, and first and second treatment devices.
Figure 10:
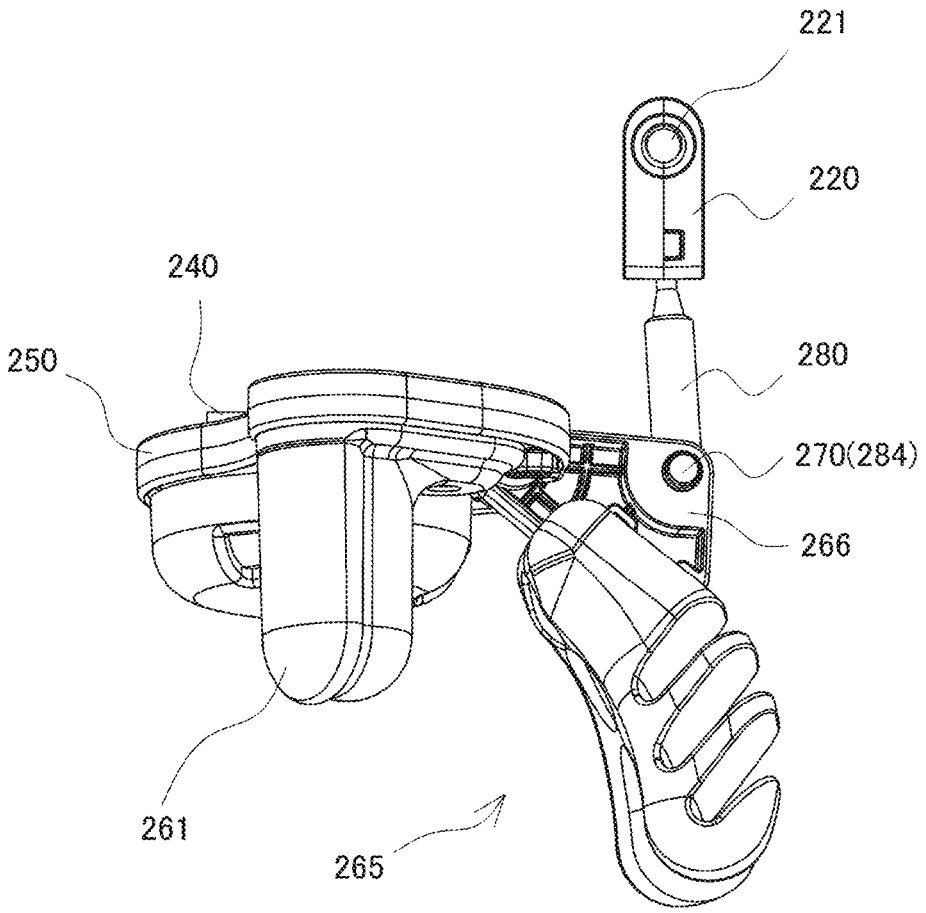
FIG. 10 is a left side view of the swash plate cam, the treatment device holder, and the first and second treatment devices.
Figure 11:
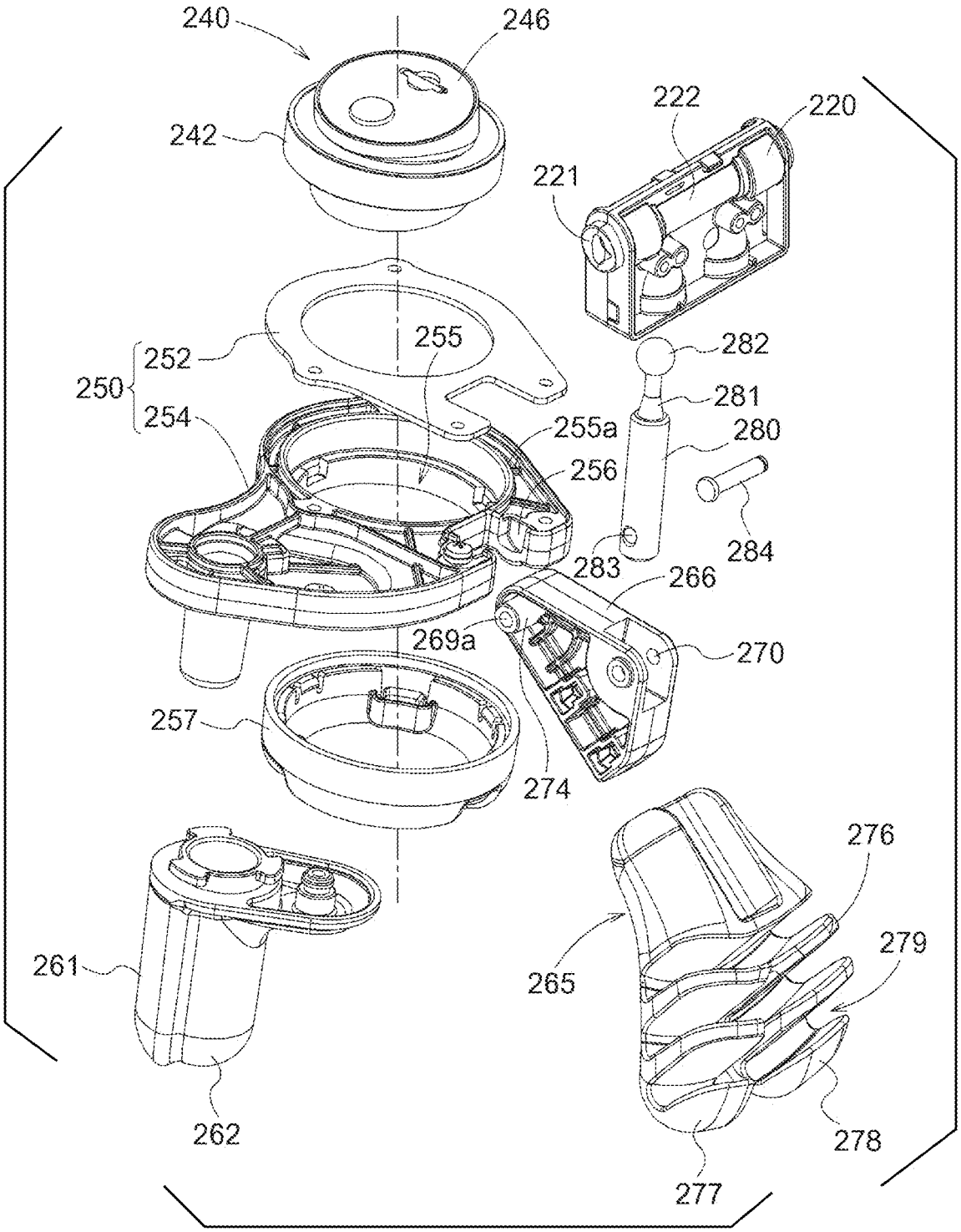
FIG. 11 is an exploded perspective view of the swash plate cam, the treatment device holder, and the first and second treatment devices.
Figure 12:
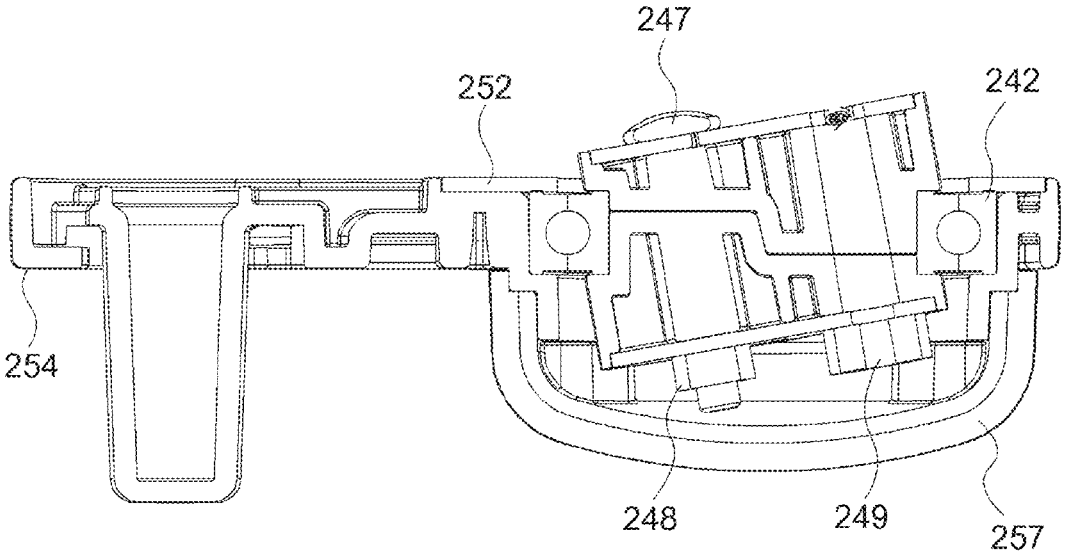
FIG. 12 is a sectional view of the swash plate cam and the treatment device holder.

As illustrated in FIGS. 6 to 8, the swash plate cam 240 includes a ball bearing 242 serving as an example of an annular bearing, a resin-made cylindrical cam main body 244 rotated integrally with an inner ring of the ball bearing 242 while pinching the inner ring of the ball bearing 242 from both sides in the axial direction, and a fixing plate 246 attached to two bottom surfaces of the cam main body 244 and pinching the cam main body 244 further from the outside. The swash plate cam 240 has two holes penetrating the cam main body 244 and the fixing plate 246. A bolt 247 is inserted into one of the holes from one fixing plate 246 to the cam main body 244 and the other fixing plate 246, and is fastened using a nut 248. In this manner, the fixing plate 246, the cam main body 244, and the ball bearing 242 are integrated with each other. The treatment output shaft 235 is inserted into another hole, and is fastened using a nut 249. A radially protruding locking pin 236 is inserted into the treatment output shaft 235. A shape fitted to the locking pin 236 is formed in one of the fixing plates 246. In this manner, the treatment output shaft 235 and the swash plate cam 240 (except for an outer ring of the ball bearing 242) are integrally rotated.

An axis X of the treatment output shaft 235 is a rotation axis of the swash plate cam 240. However, the treatment output shaft 235 is attached so as to be eccentric from a rotation center of the ball bearing 242, that is, an axis of the cam main body 244. In addition, the rotation axis of the ball bearing 242 is inclined with respect to both the axis and the bottom surface of the cam main body 244. Specifically, if a point is assumed on the circumference where a radial half line passing through the center of the treatment output shaft 235 intersects the outer peripheral surface of the cam main body 244 from the axis of the cam main body 244 as a starting point, the ball bearing 242 is inclined so that a site farthest away from the treatment motor drive unit 230 of the ball bearing 242 is located on the line parallel to the axis of the cam main body 244 after passing through this point. In other words, inside the ball bearing 242, a site closest to the treatment output shaft 235 is located farthest away from the treatment motor drive unit 230, and a site farthest away from the treatment output shaft 235 is located closest to the treatment motor drive unit 230. In this manner, when the treatment output shaft 235 is rotated, the inner ring of the ball bearing 242 of the swash plate cam 240 is rotated in a state of being eccentric and deflected with respect to the axis X. Instead of the site closes to the treatment output shaft 235 inside the ball bearing 242, a configuration may be adopted in which any other desired place is located farthest away from the treatment motor drive unit 230. In addition, instead of the ball bearing 242, a roller bearing or a sliding bearing may be used.

(c) Treatment Device Holder

As illustrated in FIGS. 5 and 9 to 12, the treatment device holder 250 is attached to the swash plate cam 240. The treatment device holder 250 is configured so that a plate-shaped first member 252 made of a metal plate and a resin-made second member 254 having a side surface erected so as to surround the bottom surface and the periphery of the bottom surface are fastened using a screw. The first member 252 has a function as a lid for covering the periphery of a cam holding through-hole 255 of the second member 254. The treatment device holder 250 has the cam holding through-hole 255 having a circular cross sectional shape fitted into the outer ring of the ball bearing 242 of the swash plate cam 240 from the first member 252 to the second member 254. The cam holding through-hole 255 is formed from a cylindrical protrusion 255*a* vertically erected from the bottom surface in the second member 254. The outer ring of the ball bearing 242 is attached to an inner peripheral surface of the protrusion 255*a* by using a method such as press-fitting or bonding. That is, the treatment device holder 250 is attached vertically to the rotation axis of the ball bearing 242. Accordingly, the treatment device holder 250 is inclined with respect to the treatment output shaft 235 at an angle the same as an angle of the ball bearing 242. In addition, a cover 257 is attached to a side opposite to a side having the protrusion of the bottom surface of the second member 254 so as to cover an end portion of the swash plate cam 240.

(d) Treatment Device

As illustrated in FIGS. 5 and 9 to 11, the first treatment device 261 (example of the treatment device) made of resin or rubber is integrally attached using a screw to the further inside in the width direction from the swash plate cam 240 (that is, the left side of the swash plate cam 240 when viewed from the front to the rear), which is a side the same as a side to which the cover 257 of the second member 254 of the treatment device holder 250 is attached. The first treatment device 261 has a substantially L-shaped cross-section, and a contact portion 262 which comes into contact with the shoulder of the treatment subject person protrudes downward from a site connected to the treatment device holder 250. A tip of the contact portion 262 has a substantially hemispherical shape. The first treatment device 261 imitates the treatment using the thumb of the treatment providing person. For example, the first treatment device 261 presses acupoints such as a middle shoulder transporter, an outer shoulder transporter, a cooked wall, and GB21, or a latissimus dorsi muscle, a levator scapular muscle, and a trapezius muscle.

In the vicinity and in front of a site to which the swash plate cam 240 of the treatment device holder 250 is attached, the second treatment device 265 is attached so as to be oscillable in the forward/rearward direction and the upward/downward direction with respect to the treatment device holder 250. The second treatment device 265 has an interlocking member 266, a second treatment device main body 276, and an interlocking shaft (example of the link) 280.

The interlocking member 266 has a columnar shape whose cross section is a right triangle having a rounded corner, and is formed of resin. A pivot shaft 274 is formed so as to protrude on both sides from a surface forming the right triangle, in a corner portion having a long side and an oblique side out of two sides (long side and short side) across a right angle. The pivot shaft 274 is inserted into a U-shaped groove 256 formed in the second member 254 of the treatment device holder 250, and the first member 252 covers the U-shaped groove 256. In this manner, the interlocking member 266 is held so as to be oscillable around the axis of the pivot shaft 274 in the forward/rearward direction and the upward/downward direction with respect to the treatment device holder 250. The interlocking member 266 is attached to the treatment device holder 250 so that the pivot shaft 274 is parallel to the width direction of the treatment device holder 250. A first pin through-hole 270 is formed in the corner portion forming the right angle of the interlocking member 266 so as to penetrate a surface forming the right triangle.

The second treatment device main body 276 is made of resin or rubber, and a base end side thereof is fixed to the surface forming the oblique side of the right triangle of the interlocking member 266 by using a screw so as to be integrated with the interlocking member 266. The second treatment device main body 276 extends is located outward in the width direction from the first treatment device 261, and extends forward from the treatment device holder 250. That is, when viewed along the width direction, the second treatment device main body 276 is located in front of the first treatment device 261, and a tip portion of the second treatment device main body 276 is located below a tip portion of the first treatment device 261. In addition, when viewed along the width direction, the protrusion 221 (joint holding through-hole 214 of the first base 211) of the joint portion 220 is located between the tip portion of the first treatment device 261 and the tip portion of the second treatment device main body 276.

The tip side of the second treatment device main body 276 is a site which comes into contact with the shoulder of the treatment subject person, and is divided into two portions from an intermediate portion of the second treatment device main body 276. Sizes of the two portions in the width direction are different from each other, and a first contact portion 277 located inward in the width direction is smaller than a second contact portion 278 located outward in the width direction. In addition, a total width of the tip portion of the second treatment device main body 276 is wider than a width (diameter of the hemispherical portion) of the first treatment device 261. Furthermore, the first contact portion 277 and the second contact portion 278 have a plurality of groove portions 279 in a direction perpendicular to an extending direction thereof. In this manner, even in a case where a hard material is used for the second treatment device main body 276, it is possible to weaken the pressure when the first contact portion 277 and the second contact portion 278 press the shoulder of the treatment subject person. The second treatment device main body 276 imitates the treatment using four fingers excluding the thumb of the treatment providing person. The second treatment device main body 276 supports or kneads the body of the treatment subject person from the front side, and presses an acupoint called ST21 or a greater pectoral muscle. The second treatment device main body 276 may not be divided into the two portions, and may be an integrated type.

The interlocking shaft 280 extends in the upward/downward direction, and is located above the interlocking member 266 and the second treatment device main body 276. One end on the upper side of the interlocking shaft 280 is supported by the joint portion 220, and the other end on the lower side is attached to the interlocking member 266 so as to be oscillable. The interlocking shaft 280 has a columnar shape. A side close to one end serves as a small diameter portion 281 having a columnar shape whose diameter is smaller than the diameter of the central portion, and a tip (one end) of the interlocking shaft 280 serves as a spherical portion 282 having a larger diameter than the small diameter portion 281. In the surface of the joint portion 220, a circular opening is formed on the surface facing the interlocking shaft 280, and a hole 223 is formed therein. The hole 223 has a mortar-shaped hole 224 whose diameter decreases inward from the surface, and a spherical hole 225 communicating with the bottom of the mortar-shaped hole 224 and capable of holding the tip of the interlocking shaft 280 (refer to FIG.

9). The diameter of the bottom of the mortar-shaped hole 224 is smaller than the diameter of the spherical hole 225. In this manner, if the joint portion 220 is assembled in a state where the spherical portion 282 of the interlocking shaft 280 is fitted into the spherical hole 225, one end of the interlocking shaft 280 is restricted in moving with respect to the joint portion 220 in the forward/rearward direction, the upward/downward direction, and the width direction. However, one end of the interlocking shaft 280 is freely rotatable and oscillable within an angular range which comes into contact with the mortar-shaped hole 224 around the spherical portion 282. That is, one end of the interlocking shaft 280 and the joint portion 220 are connected to each other by means of a so-called ball joint.

A second pin through-hole 283 is formed in the radial direction in the other end of the interlocking shaft 280, and is attached to the interlocking member 266 so as to be oscillable by an interlocking pin 284 penetrating the second pin through-hole 283 and the first pin through-hole 270 of the interlocking member 266. The interlocking pin 284 is attached parallel to the width direction of the treatment device holder 250, that is, parallel to the pivot shaft 274. Accordingly, the second treatment device 265 (interlocking member 266) is supported by the interlocking pin 284 so as to be oscillable around the axis of the interlocking pin 284 in the forward/rearward direction and the upward/downward direction. In addition, an interlocking site between the interlocking shaft 280 and the interlocking member 266 is located between the base end side and the tip side of the second treatment device 265.

According to the configuration as described above, the second treatment device 265 is configured so that the interlocking member 266 configures a link which is oscillable with respect to the treatment device holder 250 and the interlocking shaft 280 configures a ball joint and a link which is oscillable. The second treatment device 265 has a so-called dual link mechanism. Accordingly, the second treatment device 265 is movable in the upward/downward direction with respect to the treatment device holder 250, and is rotatable with respect to the joint portion 220.

Operation of Treatment Device

Next, an operation of the first treatment device 261 and the second treatment device 265 when the massage machine 1 according to the present embodiment is operated will be described with reference to FIGS. 13 to 17.

Figure 13:
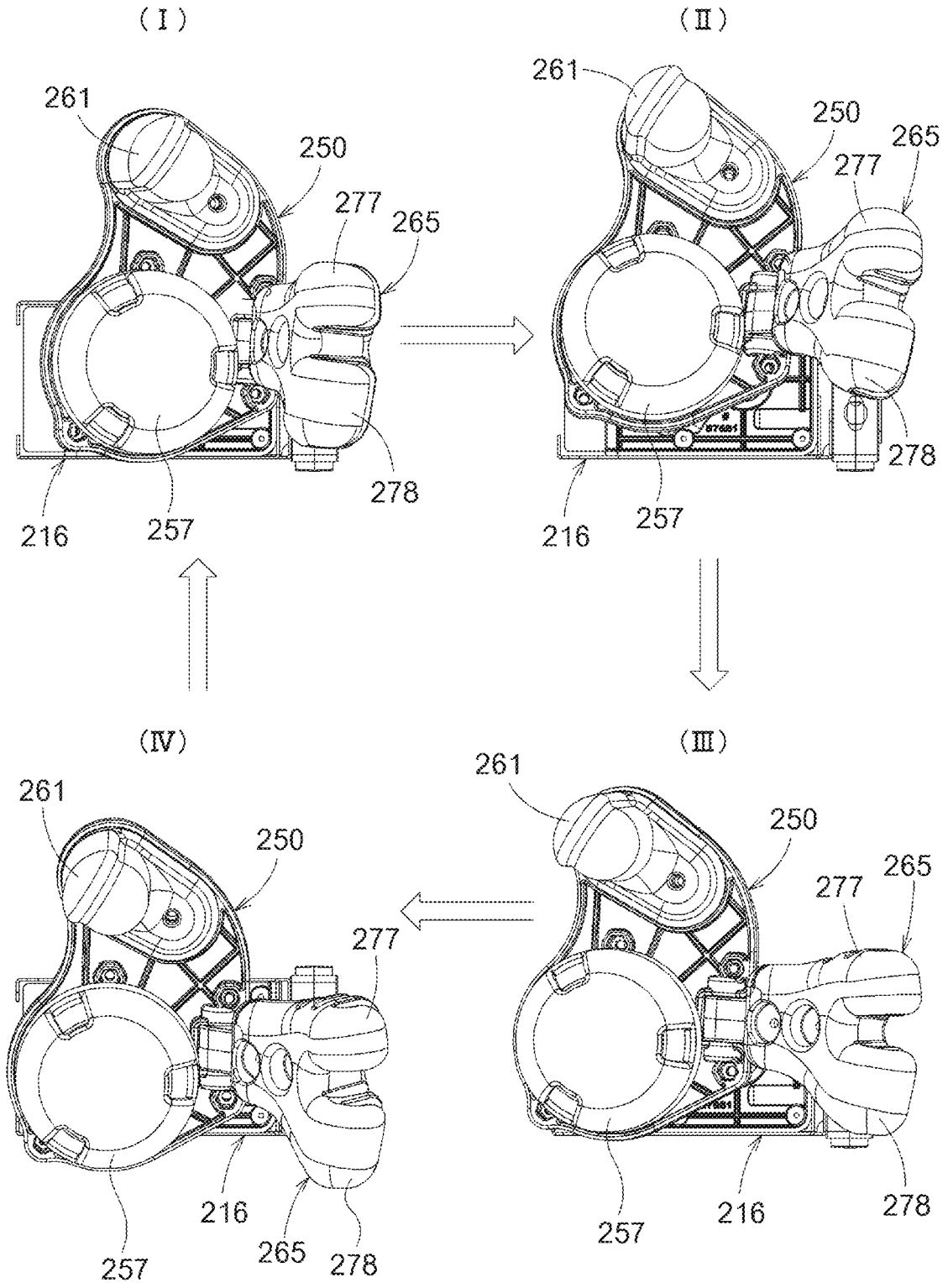
FIG. 13 is a view illustrating an operation of the first and second treatment devices.
Figure 14:
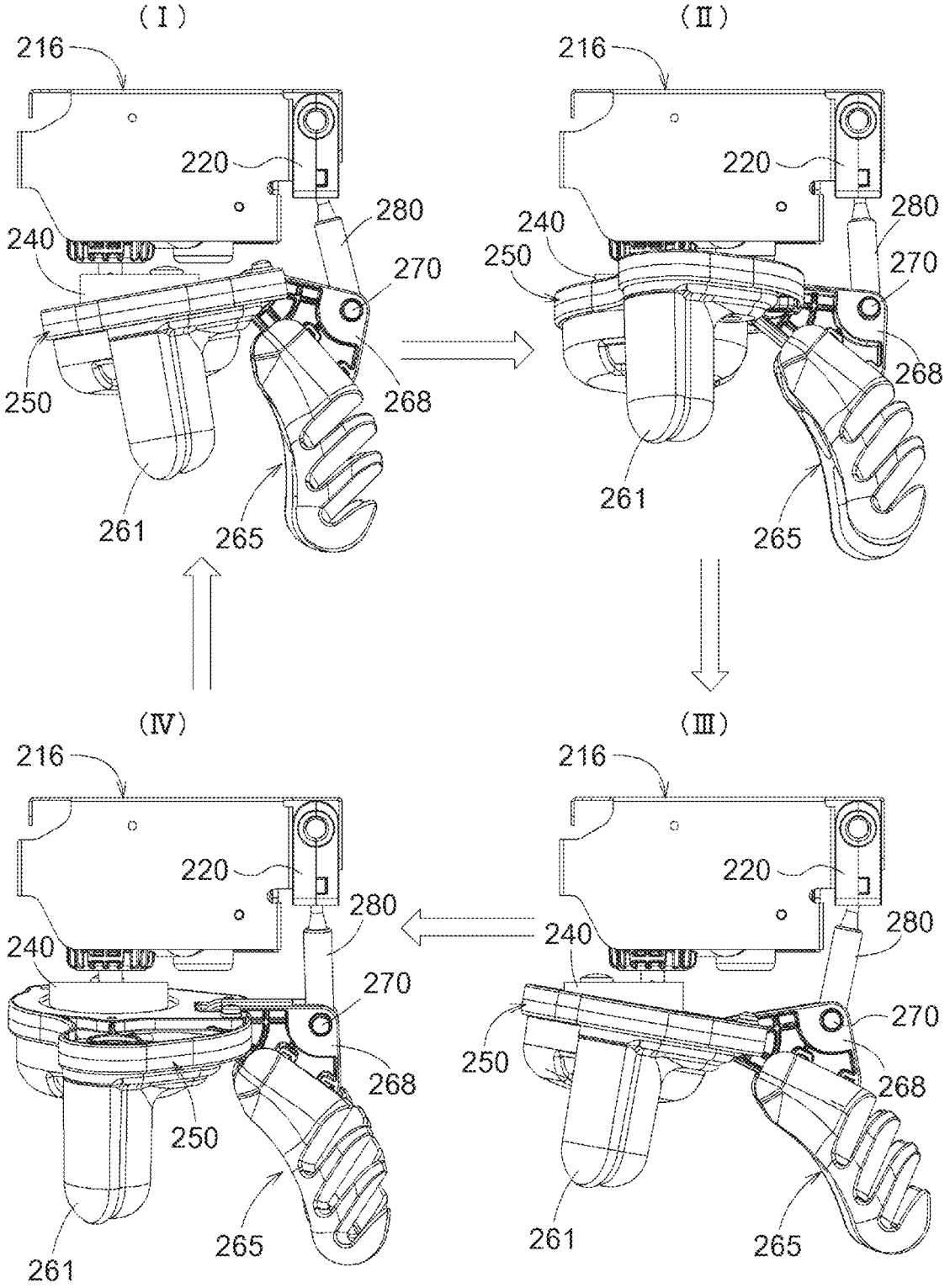
FIG. 14 is a view illustrating an operation of the first and second treatment devices.
Figure 15:
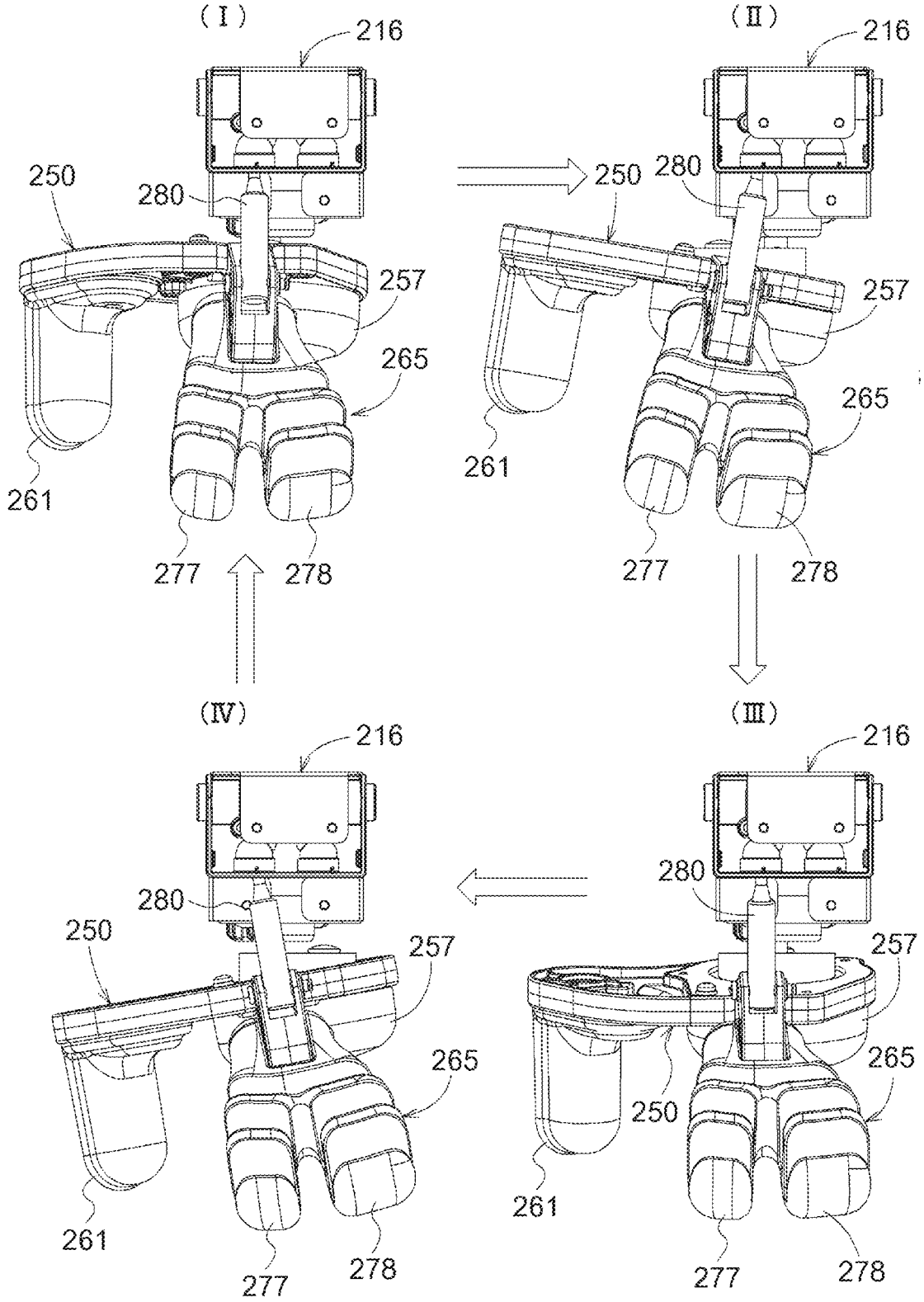
FIG. 15 is a view illustrating an operation of the first and second treatment devices.

First, in a state where the treatment subject person does not sit on the seat unit 11 of the massage machine 1, that is, in a state where both the first treatment device 261 and the second treatment device 265 are not in contact with the treatment subject person, the treatment motor 231 is operated. In this case, as illustrated in FIG. 17, the tip side of the second base 216 is separated from the first base 211 by the biasing force of the compression coil spring 228. However, hereinafter, description will be made on the assumption that the biasing force of the compression coil spring 228 is not applied to the second base 216 as illustrated in FIGS. 13 to 15.

If the treatment motor 231 is driven, the treatment motor 231 is decelerated by the worm reduction mechanism 234, and the treatment output shaft 235 is rotated. Since the treatment output shaft 235 is rotated, the cam main body 244, the fixing plate 246, the inner ring of the ball bearing 242 of the swash plate cam 240 are integrally rotated. However, the treatment device holder 250 is not rotated together. The reason is that the second treatment device 265 attached to the treatment device holder 250 is supported by the first base 211 via the interlocking shaft 280 and the joint portion 220. However, the treatment device holder 250 is fixed to the outer ring of the ball bearing 242. Accordingly, even if the treatment device holder 250 is not rotated, there is no resistance when the treatment output shaft 235, the cam main body 244, the fixing plate 246, the inner ring of the ball bearing 242 are rotated.

As described above, the treatment output shaft 235 is attached in a state of being eccentric with respect to the axis of the cam main body 244 of the swash plate cam 240. Accordingly, as the treatment output shaft 235 is rotated, the axis of the cam main body 244 of the swash plate cam 240 revolves around the axis X. That is, the swash plate cam 240 is rotated so as to be eccentric with respect to the axis X of the treatment output shaft 235.

The rotation axis of the ball bearing 242 is inclined with respect to both the axis and the bottom surface of the cam main body 244. Accordingly, the treatment device holder 250 attached vertically to the rotation axis of the ball bearing 242 is also inclined with respect to both the axis and the bottom surface of the cam main body 244. If the treatment output shaft 235 is rotated in this state, as illustrated in FIGS. 13 to 15, the treatment device holder 250 moves as much as a movement amount of the swash plate cam 240 moving in the forward/rearward direction and the width direction with respect to the treatment output shaft 235 (refer to FIG. 13). At the same time, the treatment device holder 250 oscillates in an angular range which is the same as an angular range where the ball bearing 242 oscillates (swings in the upward/downward direction) (refer to FIGS. 14 and 15). That is, a position and an inclination direction of the treatment device holder 250 in the forward/rearward direction and the width direction are continuously changed in accordance with a rotation angle of the treatment output shaft 235.

As described above, the first treatment device 261 is integrally attached to the treatment device holder 250. When a state where the treatment device holder 250 is located most forward of the treatment output shaft 235 is set as a rotation reference (0 degrees) ((I) in each of FIGS. 13 to 15), when viewed along the upward/downward direction, the first treatment device 261 moves as follows. As illustrated in FIG. 13, as the treatment output shaft 235 is rotated in a counterclockwise direction when viewed from below, in conjunction with the movement of the treatment device holder 250, the first treatment device 261 moves (circular movement) rightward (rotation angle of the treatment output shaft 235 is 90 degrees, FIG. 13(II)), rearward (180 degrees, FIG. 13(III)), and leftward (270 degrees, FIG. 13(IV)). Thereafter, the first treatment device 261 moves forward again (0 degrees, FIG. 13(I)). At the same time, when viewed along the forward/rearward direction and the width direction, as illustrated in FIGS. 14 and 15, the first treatment device 261 passes through an intermediate position (0 degrees, (II) in each of FIGS. 14 and 15), an upper position (90 degrees, (II) in each of FIGS. 14 and 15), an intermediate position (180 degrees, (III) in each of FIGS. 14 and 15), and a lower position (270 degrees, (IV) in FIGS. 14 and 15). Thereafter, the first treatment device 261 moves (oscillates) so as to be located again at the intermediate position (0 degrees). The reason is that the ball bearing 242 fitted to the treatment device holder 250 (first treatment device 261) is rotated in a state of being eccentric and deflected with respect to the treatment output shaft 235. The upper position means an uppermost position and a position in the vicinity of the uppermost position where the first treatment device 261 can be located in the upward/downward direction. The lower position means a lowermost position and a position in the vicinity of the lowermost position where the first treatment device 261 can located in the upward/downward direction. The intermediate position means an intermediate position between the upper position and the lower position.

In this case, in the second treatment device 265, as illustrated in FIGS. 13 to 15, the second treatment device 265, when a position where the treatment device holder 250 is located most forward of the treatment output shaft 235 is set as a rotation reference (0 degrees), when viewed along the upward/downward direction, the base end side of the second treatment device 265 moves as follows. As illustrated in FIG. 13, as the treatment output shaft 235 is rotated in the counterclockwise direction when viewed from below, in conjunction with the movement of the treatment device holder 250, the base end side of the second treatment device 265 moves (circular movement) rightward (rotation angle of the treatment output shaft 235 is 90 degrees, FIG. 13(II)), rearward (180 degrees, FIG. 13(III)), and leftward (270 degrees, FIG. 13(IV)). Thereafter, the base end side of the second treatment device 265 moves forward again (0 degrees, FIG. 13(I)). The tip side (the first contact portion 277 and the second contact portion 278) of the second treatment device main body 276 of the second treatment device 265 also moves similarly to the base end side. However, due to an operation of the dual link mechanism, the movement amount of the tip side moving in the forward/rearward direction is smaller than the movement amount of the base end side. At the same time, when viewed along the width direction, as illustrated in FIG. 14, the tip side of the second treatment device main body 276 passes through the intermediate position (0 degrees, FIG. 15(I)), the right position (90 degrees, FIG. 15(II)), the intermediate position (180 degrees, FIG. 15(III)), and the left position (270 degrees, FIG. 15(IV)). Thereafter, the tip side of the second treatment device main body 276 oscillates so as to be located again at the intermediate position (0 degrees). However, due to the operation of the dual link mechanism, the movement amount (oscillation amount) in the upward/downward direction is smaller than the movement amount of the treatment device holder 250 (first treatment device 261). The movement amount in the width direction is equal to the movement amount of the first treatment device 261. The interlocking shaft 280 supported by the joint portion 220 (second base 216) is rotated around the spherical portion 282. However, the interlocking shaft 280 does not come into contact with the wall surface of the mortar-shaped hole 224 of the joint portion 220.

The above-described upper position means an uppermost position and a position in the vicinity of the uppermost position where the second treatment device main body 276 can be located in the upward/downward direction. The lower position means a lowermost position and a position in the vicinity of the lowermost position where the second treatment device main body 276 can located in the upward/downward direction. The intermediate position means an intermediate position between the upper position and the lower position. The left position means a leftmost position and a position in the vicinity of the leftmost position where the second treatment device main body 276 can be located in the width direction. The right position means a rightmost position and a position in the vicinity of the rightmost position where the second treatment device main body 276 can be located in the width direction. The intermediate position means an intermediate position between the left position and the right position.

As described above, when viewed along the width direction, the first treatment device 261 moves (oscillates) forward and rearward in conjunction with the movement of the treatment device holder 250. The tip side of the second treatment device main body 276 of the second treatment device 265 also oscillates forward and rearward in conjunction with the movement of the treatment device holder 250. However, the movement amount (oscillation amount) is small. Therefore, when viewed along the width direction, a distance between the tip side of the first treatment device 261 and the tip side of the second treatment device main body 276 is changed in accordance with the rotation of the treatment output shaft 235. Then, the first treatment device 261 and the second treatment device main body 276 move in conjunction with each other so as to shorten the distance between the mutual tip sides. In this manner, while the shoulder of the treatment subject person is held by the second treatment device main body 276 from the front side, the treatment can be performed by causing the first treatment device 261 to press the shoulder of the treatment subject person from above.

In this way, a simple configuration using the swash plate cam 240 enables the first treatment device 261 and the second treatment device 265 to oscillate in the upward/downward direction. The movement of the first treatment device 261 and the second treatment device 265 which are moved by the rotation angle of the treatment output shaft 235 is changed by a relationship between the treatment output shaft 235 and the ball bearing 242 furthest away from the treatment motor drive unit 230.

Next, movement of the first treatment device 261 and the second treatment device 265 in a state where the treatment subject person sits on the massage machine 1 will be described. First, in a state where the treatment subject person sits on the seat unit 11 of the massage machine 1, the shoulder treatment mechanism 200 supported by the support unit 100 is aligned with the shoulder position. Specifically, the first treatment device 261 is located in the upper portion of the shoulder, and the second treatment device 265 is located in the front portion of the shoulder. In this case, the tip side of the second base 216 is separated from the first base 211 due to the operation of the compression coil spring 228. In this manner, the first treatment device 261 presses the shoulder of the treatment subject person from above, and the second treatment device 265 holds the shoulder from the front side. In this state, the treatment motor 231 is driven.

While the second treatment device holds the shoulder of the treatment subject person from the front side by using the operation of the compression coil spring 228, the first treatment device 261 presses the shoulder of the treatment subject person from above. Accordingly, the first treatment device 261 and the second treatment device 265 oscillate in the upward/downward direction, and without being separated from the shoulder of the treatment subject person, the first treatment device 261 and the second treatment device 265 can always press the shoulder from above while holding the shoulder. While the shoulder is pressed from above by the first treatment device 261, due to the oscillation of the first treatment device 261 in the upward/downward direction and the biasing force of the compression coil spring 228, it is possible to periodically change the force of the first treatment device 261 is the shoulder of the treatment providing person. Accordingly, the treatment subject person can feel as if the treatment is more similar to the treatment performed by the treatment providing person with the fingers. Therefore, in the massage machine 1 according to the present embodiment, the second treatment device 265 holds the shoulder of the treatment subject person so as not to be raised from the backrest unit 12, and the first treatment device 261 can stimulate the GB21 which is the acupoint of the shoulder from above.

In addition, the first treatment device 261 and the second treatment device 265 move in the forward/rearward direction and the rightward/leftward direction. Accordingly, it is possible to press not only a specific site of the shoulder of the treatment subject person but also the periphery of the specific site. Therefore, a pressing treatment effect can be further improved.

In the shoulder treatment mechanism 200 according to the present embodiment, as described above, while the first treatment device 261 performs so-called circular movement by moving in the forward/rearward direction and the rightward/leftward direction (refer to FIG. 13), the first treatment device 261 and the second treatment device 265 are repeatedly move closer to and away from each other in the forward/rearward direction by the dual link mechanism (refer to FIG. 14). Accordingly, not only the shoulder is pressed, but also shoulder muscles such as the levator scapular muscle and the upper portion of the trapezius muscle can be relaxed through gripping and kneading. Whereas the trapezius muscle is a thick and strong muscle, the levator scapular muscle is a thin and weak muscle. In particular, women or persons with sloping shoulders have the weak levator scapular muscle. Therefore, the muscles of these persons are likely to be in a tension state, and these persons are likely to feel shoulder stiffness.

Therefore, in the shoulder treatment mechanism 200, the first treatment device 261 performs the circular movement around the treatment output shaft 235 extending in the upward/downward direction. In this manner, the first treatment device 261 reproduces the finger movement or the thenar rotation of the treatment providing person when kneading the shoulder. Therefore, the shoulder muscles such as the levator scapular muscle and the upper portion of the trapezius muscle can be relaxed by pressing a range which is slightly larger than a range of the acupressure. In this case, the second treatment device 265 grips and holds the body of the treatment subject person so as not to move away when the kneading operation is performed by the first treatment device 261. That is, the second treatment device 265 grips the shoulder muscles of the treatment subject person when the first treatment device 261 and the second treatment device 265 are closer to each other, and supports the body of the treatment subject person when the first treatment device 261 and the second treatment device 265 are away from each other. In this manner, it is possible to effectively relax the shoulder muscles of the treatment subject person.

The lifting/lowering members 124 and 124 respectively provided on the right and left side surfaces 14 and 14 of the backrest unit 12 in the upward/downward direction, and the shoulder treatment mechanisms 200 and 200 in the width direction can be respectively and independently moved. In addition, with regard to the treatment motors 231 and 231 on the right and left shoulder treatment mechanisms 200 and 200, only any one of the treatment motors 231 can be driven, or each number of rotations can be changed. That is, the treatment motors 231 and 231 can be respectively and independently controlled. In this manner, it is possible to easily cope with all cases such as a case where the height of the right and left shoulders is changed due to an individual difference in the heights of the treatment subject persons, a case where the pressing position or the pressing force which the treatment subject person desires is changed on the right and left shoulders, and a case where the treatment subject person wants to receive the treatment on only one of the right and left shoulders.

(2) Second Embodiment

(a) Treatment Device

Figure 18:
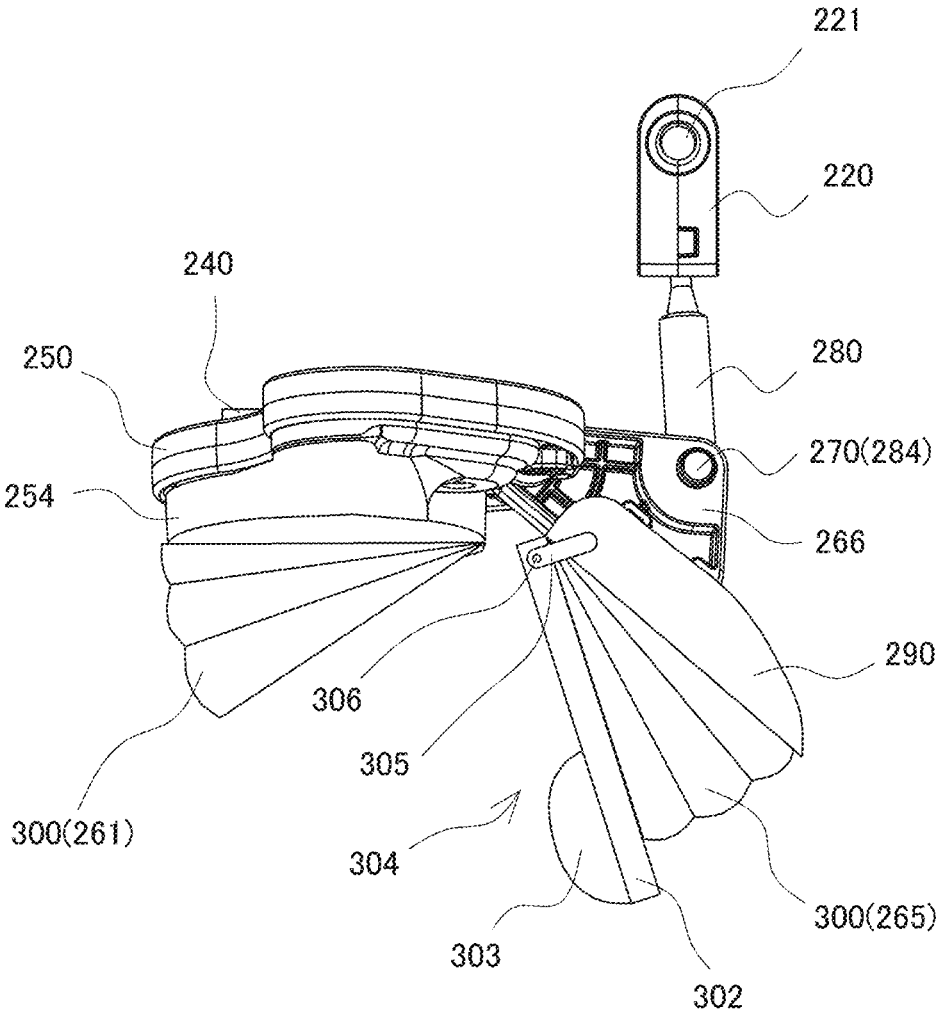
FIG. 18 is a left side view of a first treatment device and a second treatment device of a massage machine according to a second embodiment.
Figure 19:
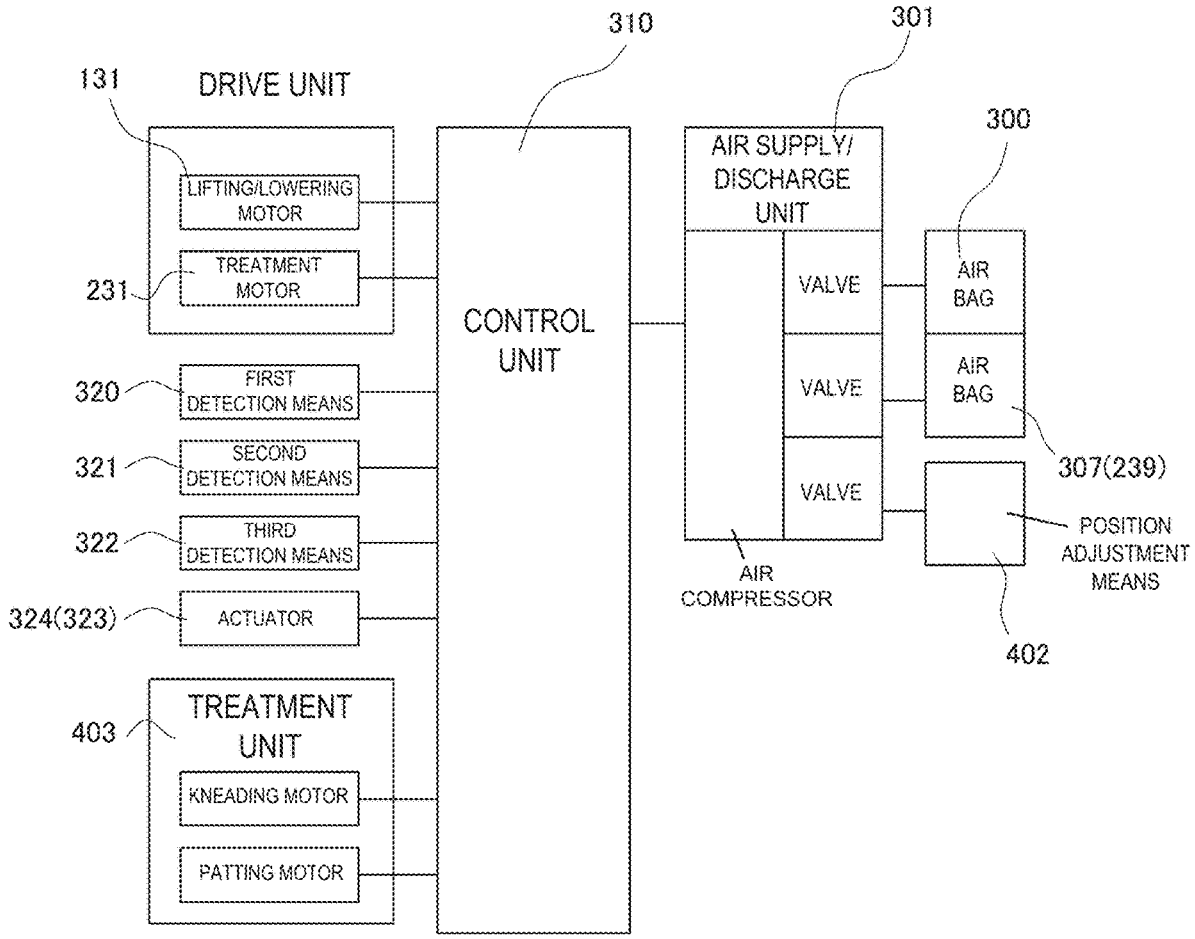
FIG. 19 is a functional block diagram of the massage machine according to the second embodiment.

FIG. 18 illustrates a left side view of a first treatment device 261 and a second treatment device 265 of a massage machine 400 according to a second embodiment. FIG. 19 illustrates a functional block diagram of the massage machine 400 according to the second embodiment. A basic configuration of the second embodiment is the same as that of the first embodiment, and configurations of the first treatment device 261 and the second treatment device 265 of the shoulder treatment mechanism 200 are different from those according to the first embodiment.

As illustrated in FIGS. 18 and 19, the first treatment device 261 and/or the second treatment device 265 have/has the air bag 300. The air bag 300 belonging to the first treatment device 261 can adjust the strength of the treatment as follows. The massage machine 400 holds a state where the air bag 300 is brought into contact with the shoulder of the treatment subject person from above by the air supply/discharge unit 301 configured to include the above-described air compressor and valve for supplying and discharging the air and capable of inflating and deflating the air bag 300 on the side the same as the treatment subject person side in the second member 254 of the treatment device holder 250. The massage machine 400 performs the pressing treatment by inflating and deflating the air bag 300, and adjusts the air amount of the air bag 300. In addition, the air bag 300 belonging to the second treatment device 265 is attached to a member 290 disposed in the interlocking member 266, and can adjust the strength of the treatment as follows. The massage machine 400 holds a state where the air bag 300 is brought into contact with the shoulder of the treatment subject person from the front side by the above-described air supply/discharge unit 301. The massage machine 400 performs the pressing treatment by inflating and deflating the air bag 300, and adjusts the air amount of the air bag 300. In this way, the strength of the treatment suitable for the individual can be adjusted, and the air bag 300 can be held in accordance with the body shape of the individual.

As illustrated in FIG. 19, the air supply/discharge unit 301 is electrically connected to a control unit 310. The control unit 310 can adjust the air amount, and can control the timing to inflate and deflate the air bag 300. In addition, the lifting/lowering motor 131 and the drive unit serving as the treatment motor 231 are electrically connected to the control unit 310, and the control unit 310 can control the driving of the lifting/lowering motor 131 and the treatment motor 231. The control unit 310 can control the air supply/discharge unit 301 and the drive unit independently driven. In this way, the control unit 310 controls the air supply/discharge unit 301 to inflate and deflate the air bag 300. While the air bag 300 is brought into contact with the shoulder of the treatment subject person, the control unit 310 can control the drive unit to perform the treatment on the shoulder of the treatment subject person. The treatment can be performed by combining the air-assisting treatment using the air supply/discharge unit 301 with the mechanical treatment using the drive unit.

(b) Forward/Rearward Movement Mechanism

Next, a forward/rearward movement mechanism 304 which can move a third treatment device 303 forward to and rearward from the treatment subject person will be described.

As illustrated in FIG. 18, the member 290 has a support body 302 disposed on the treatment subject person side from the air bag 300 of the second treatment device 265, the third treatment device 303 disposed in the tip portion of the support body 302, and the forward/rearward movement mechanism 304 capable of moving the support body 302 forward to and rearward from the treatment subject person by inflating and deflating the air bag 300. One of the interlocking members 305 is disposed in the member 290, and the other one is pivotally supported by the support body 302 via a pivot shaft 306. The forward/rearward movement mechanism 304 causes the support body 302 to pivot around the pivot shaft serving as a fulcrum by inflating and deflating the air bag 300. In this manner, the forward/rearward movement mechanism 304 can move the support body 302 forward to and rearward from the treatment subject person. In this way, the treatment different from the treatment using the air bag 300 can be performed on the shoulder by the third treatment device 303 disposed in the tip portion of the support body 302. In addition, the control unit 310 controls the air supply/discharge unit 301 to adjust the air amount to be supplied to the air bag 300. In this manner, the strength of the treatment can be changed. In the above-described example, a case where the support body 302, the third treatment device 303, and the forward/rearward movement mechanism 304 are disposed on the second treatment device 265 side. However, without being limited thereto, all of these may be disposed on the first treatment device 261 side.

Figure 20:
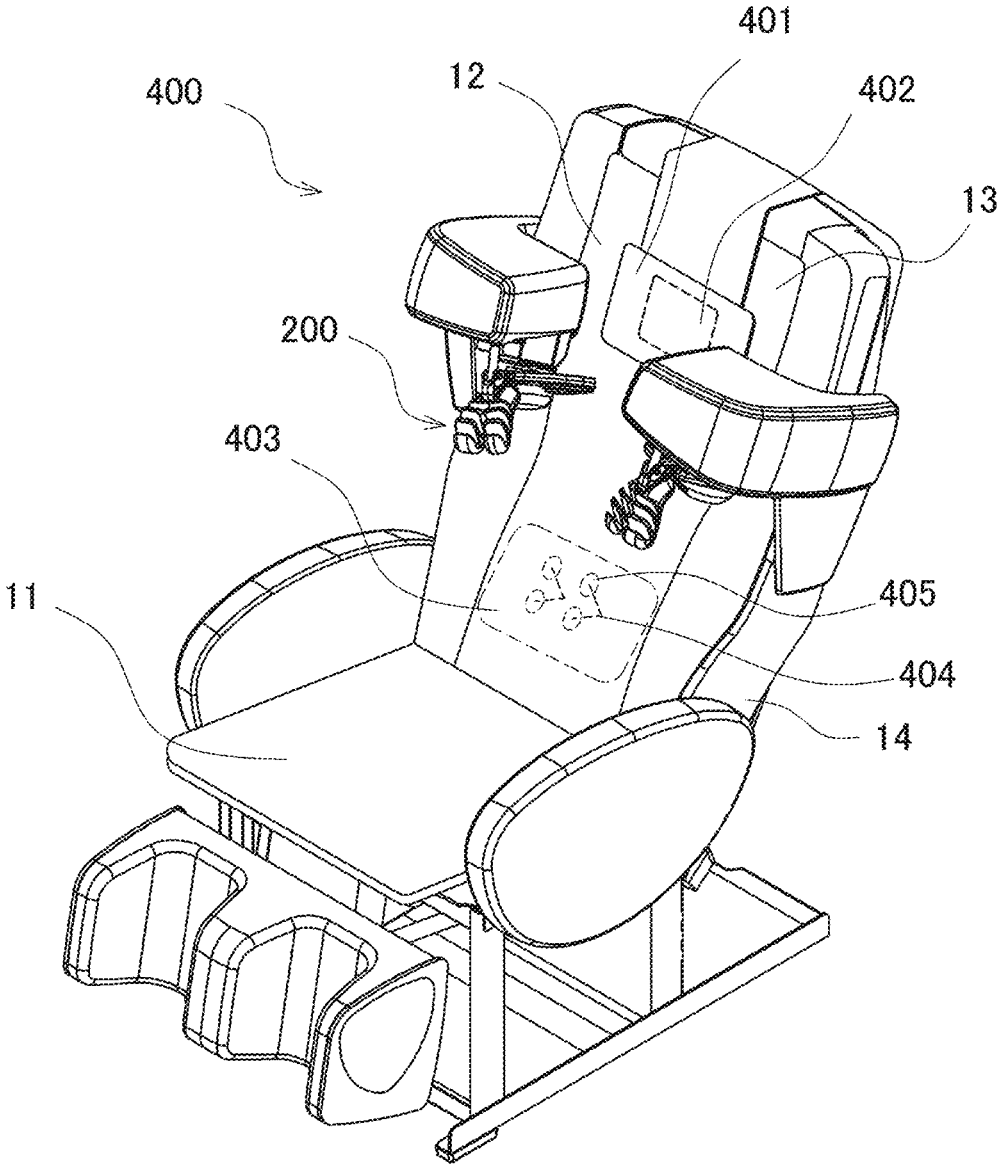
FIG. 20 is a perspective view illustrating an overall configuration of the massage machine according to the second embodiment.

FIG. 20 illustrates a perspective view illustrating an overall configuration of the massage machine 400 according to the second embodiment. A configuration of a pillow 401 (to be described later) for supporting the head of the treatment subject person and a treatment unit 403 (to be described later) disposed inside the backrest unit 12 is different from the configuration of the massage machine 1 according to the first embodiment.

As illustrated in FIGS. 19 and 20, in addition to the above-described first embodiment, in the massage machine 400 according to the second embodiment, the pillow 401 which supports the head of the treatment subject person on the back contact surface 13 with which the back of the treatment subject person comes into contact is disposed in the backrest unit 12. The treatment unit 403 which performs a kneading operation on the shoulder of the treatment subject person by driving a kneading motor and/or a patting operation on the shoulder of the treatment subject person by driving a patting motor is disposed inside the backrest unit 12. The pillow 401 has position adjustment means 402 which can adjust of a head position of the treatment subject person in the forward/rearward direction. The position adjustment means 402 is configured to include the air bag 300 and the air supply/discharge unit 301 which can inflate and deflate the air bag 300. The air bag 300 is inflated so that the head of the treatment subject person moves forward, and the air bag 300 is deflated so that the head of the treatment subject person moves rearward. In the above-described example, a configuration has been described in which the position adjustment means 402 includes the air bag 300 and the air supply/discharge unit 301. However, the present invention is not limited thereto. For example, the position adjustment means 402 may be a mechanical type which can adjust the head position of the treatment subject person by using a motor-driven jack.

When the treatment unit 403 performs the treatment on the back of the treatment subject, the shoulder treatment mechanism 200 is usually located beside the head of the treatment subject person. Accordingly, while the treatment subject person feels pressure beside the head, the treatment subject person receives the treatment. According to the above-described configuration, the treatment subject person can adjust the position of the treatment unit 403 by moving the head to a position where the treatment subject person does not feel the pressure, and can receive the treatment without feeling the pressure. In a case where the shoulder treatment mechanism 200 does not perform the treatment on the shoulder of the treatment subject person, the control unit 310 may control the air supply/discharge unit 301 to bring the air bag 300 of the position adjustment means 402 into an inflated state. In this manner, a configuration may be adopted so that the treatment subject person does not always feel the pressure.

When the shoulder treatment mechanism 200 performs the treatment on the shoulder of the treatment subject person, the treatment subject person can receive the treatment at an optimal position for the shoulder by causing the position adjustment means 402 to adjust the head position of the treatment subject person. For example, the control unit 310 controls the air supply/discharge unit 301 to deflate the air bag 300 of the position adjustment means 402, thereby bringing the back of the treatment subject person into a state of close contact with the backrest unit 12. In a state where the back of the treatment subject person is brought into close contact with the backrest unit 12, the shoulder treatment mechanism 200 can perform the treatment on the back of the treatment subject person. An example of using the position adjustment means 402 is not limited to the above-described example. For example, when the treatment unit 403 performs the treatment by using the position adjustment means 402 in conjunction with the treatment unit 403, a treatment posture of the treatment subject person is changed by adjusting the head position of the treatment position person. In this manner, the treatment subject site or the strength of the treatment can be changed.

In addition, when the shoulder treatment mechanism 200 performs the treatment by using the position adjustment means 402 in conjunction with the shoulder treatment mechanism 200, the position adjustment means 402 moves the head of the treatment subject person forward. In this manner, while the treatment is performed on the shoulder and the shoulder is held from the front side, the neck can be stretched at the same time.

(c) Detection of Shoulder Position

The massage machine 400 according to the second embodiment has movement means which can move the shoulder treatment mechanism 200 in the height direction of the treatment subject person, first detection means 320 for detecting a specific position in the height direction of the shoulder treatment mechanism 200, second detection means 321 for detecting an oscillation position of the second base 216 with respect to the first base 211, and the control unit 310 which controls the movement means. The movement means has the lifting/lowering motor 131, and controls the driving of the lifting/lowering motor 131. In this manner, similar to the massage machine 1 according to the first embodiment, the shoulder treatment mechanism 200 can be moved in the height direction of the shoulder treatment mechanism 200.

The first detection means 320 for detecting the specific position in the height direction of the shoulder treatment mechanism 200 can detect the specific position by detecting the number of rotations of a large-diameter pulley 134 (refer to FIG. 2) of the above-described lifting/lowering motor drive unit 130. More specifically, a magnet (not illustrated) is disposed in the large-diameter pulley 134, and a Hall element (not illustrated) is fixedly disposed at a position facing the magnet. If the large-diameter pulley 134 is rotated, the magnet moves closer to the Hall element, and the rotation is counted as one rotation. The movement distance of the shoulder treatment mechanism 200 can be calculated based on the number of rotations, and the position in the height direction can be specified. In addition, the first detection means 320 is not limited to the above-described configuration. For example, a micro-switch or a may be disposed in the first treatment device 261 or the second treatment device 265 of the shoulder treatment mechanism 200 so that a position where the micro-switch is turned on is specified as the shoulder position of the treatment subject person. In addition, a pressure sensor or a pneumatic sensor capable of measuring air pressure of the above-described air bag 300 may be disposed in the first treatment device or the second treatment device 265 of the shoulder treatment mechanism 200 so that a position where the pressure reaches a predetermined pressure value or a greater value is specified as the shoulder position of the treatment subject person. Alternatively, a current value of the lifting/lowering motor 131 serving as the movement means may be detected on a real-time basis so that a position where the current value is equal to or greater than a predetermined value when a load is applied during the lifting and lowering is specified as the shoulder position of the shoulder treatment mechanism 200. A case has been described where the first detection means 320 detects the load applied the lifting/lowering motor 131. However, while the treatment is performed by the shoulder treatment mechanism 200, or when the shoulder treatment mechanism 200 is moved in the height direction, in a case where the above-described current value is equal to or greater than the predetermined value, the lifting/lowering motor 131 may be stopped. In this manner, the treatment can be safely performed on the shoulder of the treatment subject person, and excessive movement can be prevented. In addition, this configuration can also be used for preventing the lifting/lowering motor 131 from being overloaded.

The base 210 of the shoulder treatment mechanism 200 has the air bag 307 serving as the biasing member 239 between the bottom portion 212 of the first base 211 and the bottom portion 217 of the second base 216, and the second detection means 321 for detecting the oscillation position of the second base 216 with respect to base 211. The air bag 307 is inflated, thereby enabling the second base 216 to oscillate with respect to the first base 211. The oscillation position can be detected by the second detection means 321. The second base 216 oscillates, thereby enabling the first treatment device 261 or the second treatment device 265 disposed in the second base 216 to be aligned with the shoulder of the treatment subject person or to be held. In this manner, pressing treatment can be performed. In addition, the oscillation position is detected by the second detection means 321, thereby enabling the first treatment device 261 or the second treatment device 265 to move to the treatment position suitable for the individual.

As illustrated in FIG. 20, the backrest unit 12 of the massage machine 400 has the above-described treatment unit 403 which is movable in the height direction of the treatment subject person with respect to the back of the treatment subject person, third detection means 322 for detecting the specific position of the treatment subject person by the movement of the treatment unit 403. In addition, a plurality of (one in the present embodiment) the treatment units 403 may be disposed in the height direction. The treatment unit 403 is configured to include a pair of right and left arms 404 and treatment devices 405 disposed in upper and lower end portions of the arm 404. The treatment unit 403 can perform the kneading operation in which the right and left treatment devices 405 are moved closer to and away from each other by the kneading motor and the patting motor, and the patting operation in which the right and left treatment devices 405 alternately move forward to and rearward from the treatment subject person. The treatment unit 403 is moved upward and downward along the height direction by driving a lifting/lowering motor (not illustrated). In this manner, the position can be changed with respect to the body of the treatment subject person, or a rolling massage can be performed. The arm 404 freely oscillates in the forward/rearward direction, and is biased by a biasing means (not illustrated) such as a spring so that the treatment device 405 on the upper side protrudes forward. The third detection means 322 is a sensor (not illustrated) disposed in the arm 404 of the treatment unit 403. The third detection means 322 detects that the arm 404 reaches a predetermined oscillation position, and detects the position in the height direction of the treatment subject person when detected, as the specific position. More specific, during a process where the control unit 310 controls the treatment unit 403 to be lifted along the height direction of the treatment subject person, if the treatment device 405 on the upper side reaches the upper side of the shoulder of the treatment subject person, the load acting on the treatment device 405 is released, and the arm 404 oscillates so as to reach a predetermined oscillation position. A sensor (not illustrated) configuring the third detection means 332 detects that the arm 404 reaches the predetermined oscillation position, and the shoulder position is detected based on the upper and lower positions of the treatment unit 403 at that time. When the optimal treatment position of the shoulder treatment mechanism 200 is specified, the shoulder position detected as described above is set as a reference position. Based on the reference position, the movement position of the shoulder treatment mechanism 200 is specified. In this way, shoulder position information of the backrest unit 12 can be reflected in the treatment position of the shoulder treatment mechanism 200. Therefore, it is possible to shorten a time required for detecting the treatment position of the shoulder treatment mechanism 200. In the above description, an example has been described in which the third detection means 322 is the sensor (not illustrated) which detects the oscillation of the arm 404 disposed in the treatment unit 403. However, the present invention is not limited to this example. For example, a pressure sensor may be disposed in the treatment device 405. In this manner, the shoulder position may be determined by observing a change in the pressure value when the load acting on the treatment device 405 is released.

Next, detecting the shoulder position of the massage machine 400 according to the second embodiment will be described with reference to FIGS. 21A and 21B.

Figure 21A:
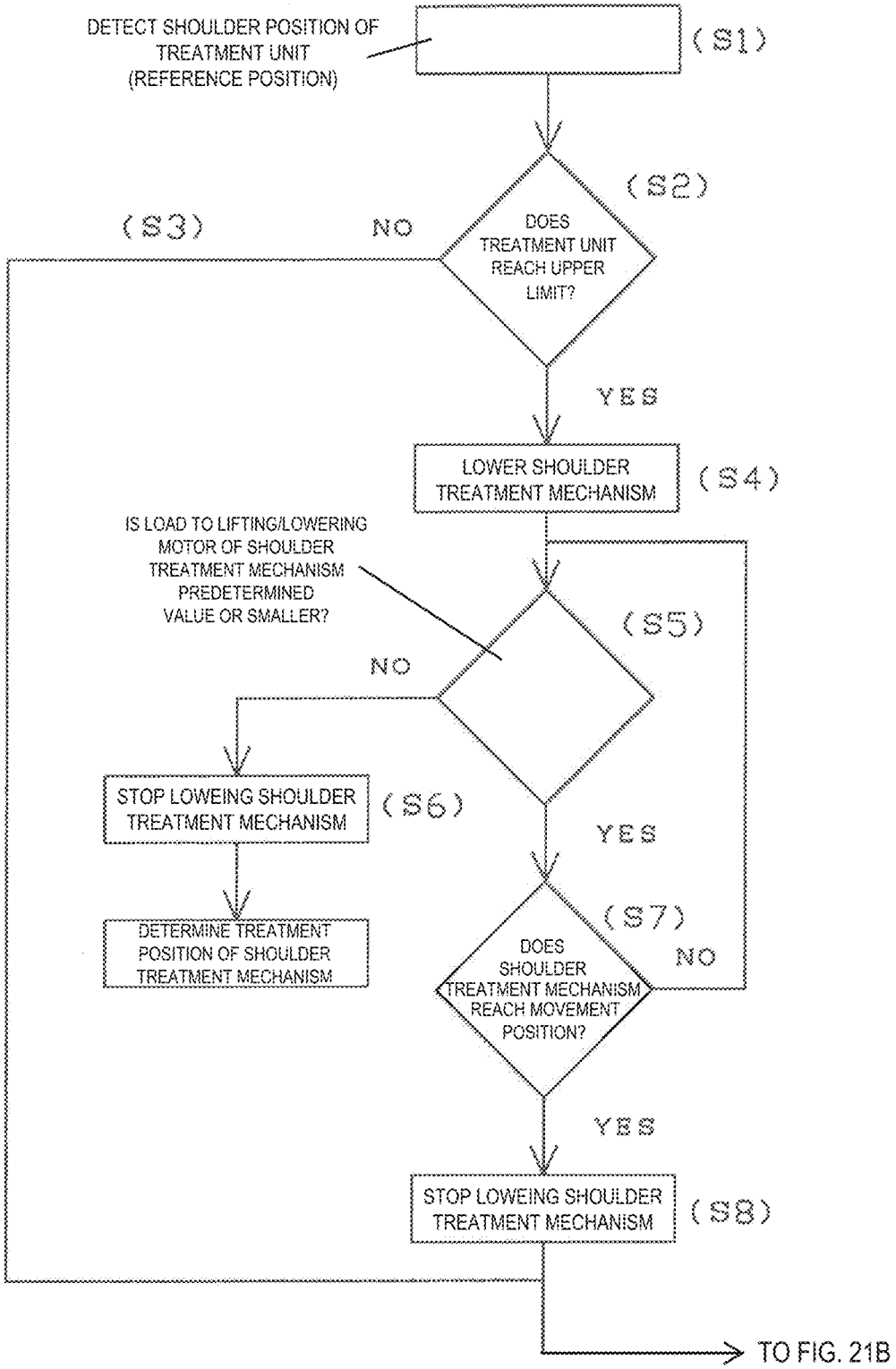
FIGS. 21A and 21B are views illustrating an operation flow of the massage machine according to the second embodiment.
Figure 21B:
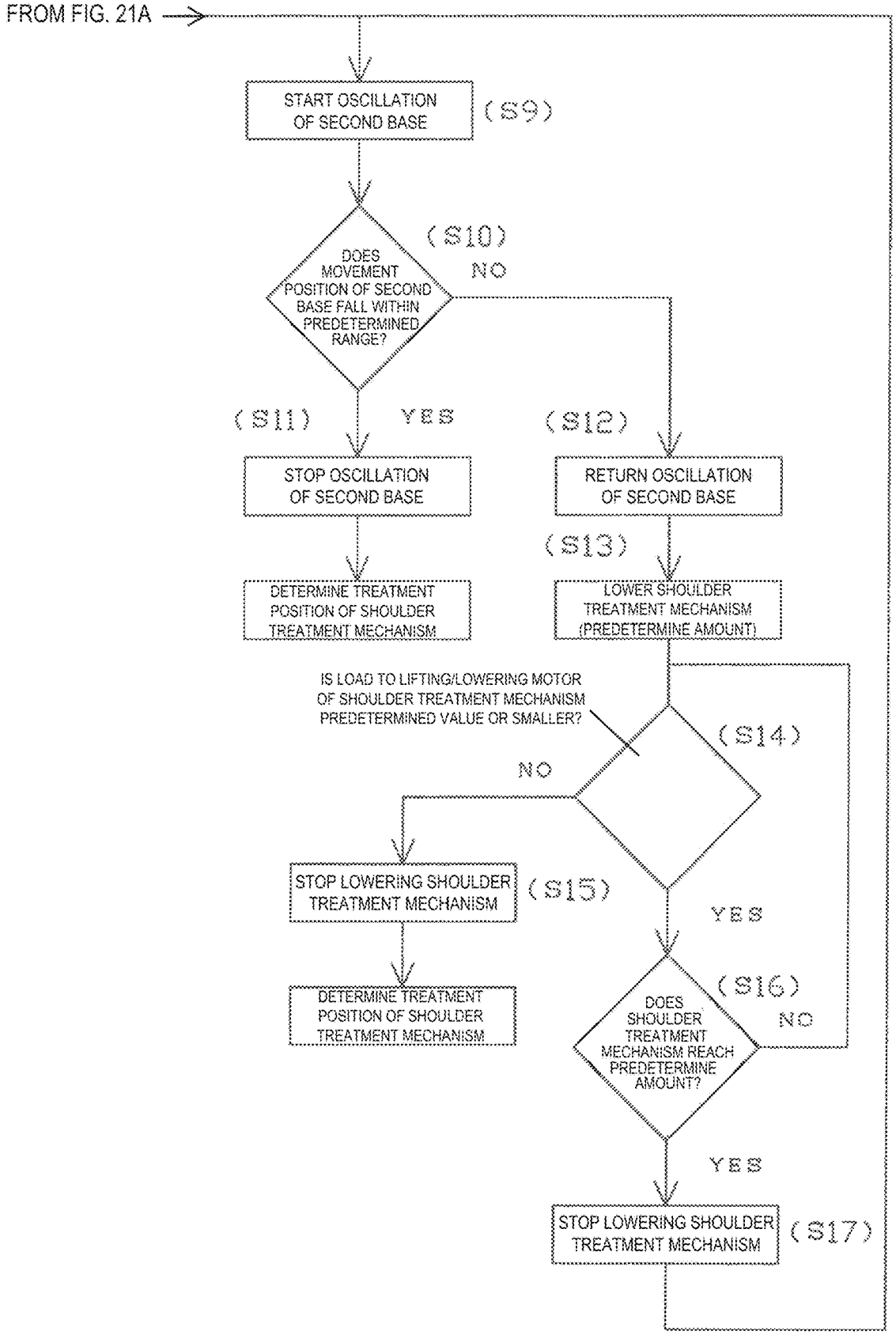

As illustrated in FIGS. 21A and 21B, the control unit 310 drives the treatment unit 403, and uses the third detection means 322 so as to detect the shoulder position of the treatment subject person (Step S1). In this case, the shoulder position detected by the treatment unit 403 is set as the reference position so as to specify the movement position of the shoulder treatment mechanism 200. In the process where the treatment unit 403 is lifted so as to detect the shoulder position, a tall person cannot be detected by the third detection means 322, in some cases. In this case, the third detection means 322 may reach an upper limit set as a limit to which the third detection means 322 can be lifted. It is determined whether the third detection means 322 reaches the upper limit (Step S2). When the third detection means 322 reaches the upper limit, the movement position of the shoulder treatment mechanism 200 is not specified. The process proceeds to Step S9 where the second base 216 (to be described later) is caused to oscillate from the upper limit position in the height direction of the shoulder treatment mechanism 200 (Step S3). Subsequent to Step S2, the shoulder treatment mechanism 200 is lowered toward the movement position (Step S4). In Step S4, the load of the lifting/lowering motor 131 is determined (Step S5). In a case where no load is applied to the lifting/lowering motor 131 and a current value is equal to or smaller than a predetermined value, the process proceeds to Step S7 where it is determined whether the shoulder treatment mechanism 200 reaches the movement position. However, in a case where the load is applied to the lifting/lowering motor 131 and the current value is equal to or greater than the predetermined value, the process proceeds to Step S6 where the lifting/lowering motor 131 is stopped. In a case where the process proceeds to Step S6, the lifting/lowering motor 131 is stopped, and the lowering operation of the shoulder treatment mechanism 200 is stopped. A stop position of the shoulder treatment mechanism 200 at this time is determined as a treatment position of the shoulder treatment mechanism 200. In Step S7, the first detection means 320 determines whether the shoulder treatment mechanism 200 reaches the movement position. After the determination, in a case where the shoulder treatment mechanism 200 does not reach the movement position, the process proceeds to Step S4 so as to continue the lowering operation. In a case where the shoulder treatment mechanism 200 reaches the movement position, the lifting/lowering motor 131 is stopped, and the lowering operation of the shoulder treatment mechanism 200 is stopped (Step S8).

Subsequent to Step S8, the air bag 307 serving as the biasing member 239 is inflated between the bottom portion 212 of the first base 211 and the bottom portion 217 of the second base 216 (Step S9), and the second base 216 is caused to oscillate in order to bring the first treatment device 261 into contact with the shoulder of the treatment subject person (Step S9). In Step S9, the second detection means 321 detects the oscillation position including whether or not the first treatment device 261 comes into contact with the shoulder of the treatment subject person. It is determined whether or not the oscillation position of the second base 216 falls within a predetermined range (Step S10). After the determination, if the oscillation position of the second base 216 falls within the predetermined range, the air bag 307 is held, and the oscillation is stopped (Step S11). The stop position of the shoulder treatment mechanism 200 and the oscillation stop position of the second base 216 at this time are determined as the treatment position of the shoulder treatment mechanism 200. After the determination, it is determined that the oscillation position of the second base 216 is out of the predetermined range, that is, it is determined that the first treatment device 261 is not in contact with the shoulder of the treatment subject person. The air bag 307 is deflated, and the oscillation of the second base 216 returns to an initial position (Step S12). Biasing means such as a spring is used in the returning direction of the second base 216. In this manner, the second base 216 can return to the initial position only by deflating the air bag 307.

Subsequent to Step S12, the shoulder treatment mechanism 200 is lowered by a predetermined amount (Step S13). The predetermined amount is a slight movement amount until the shoulder treatment mechanism 200 comes into contact with the shoulder, since the shoulder treatment mechanism 200 is not yet in contact with the shoulder but is located close to the shoulder. For example, the predetermined amount is a movement amount obtained by the lifting/lowering motor 131 rotated several times for several seconds. In Step S13, the load of the lifting/lowering motor 131 is determined (Step S14). In a case where there is no load applied to the lifting/lowering motor 131 and the current value is equal to or smaller than the predetermined value, the process proceeds to Step S16 where it is determined whether the shoulder treatment mechanism 200 reaches the predetermined amount. However, in a case where the load is applied to the lifting/lowering motor 131 and the current value is equal to or greater than the predetermined value, the process proceeds to Step S15 where the lifting/lowering motor 131 is stopped. In a case where the process proceeds to Step S15, the lifting/lowering motor 131 is stopped, and the lowering operation of the shoulder treatment mechanism 200 is stopped. The stop position of the shoulder treatment mechanism 200 at this time is determined as the treatment position of the shoulder treatment mechanism 200. In Step S16, the first detection means 320 determines whether the shoulder treatment mechanism 200 reaches the predetermined amount. After the determination, in a case where the shoulder treatment mechanism 200 does not reach the predetermined amount, the process returns to Step S13 so as to continue the lowering operation. In a case where the shoulder treatment mechanism 200 reaches the predetermined amount, the lifting/lowering motor 131 is stopped, and the lowering operation of the shoulder treatment mechanism 200 is stopped. The process proceeds to Step S9 so as to repeatedly perform the processes until the treatment position of the shoulder treatment mechanism 200 is determined (Step S17). In this way, the optimal treatment position of the shoulder treatment mechanism 200 can be detected.

(d) Correction of Treatment Position of Shoulder Treatment Mechanism by Using Reclining As illustrated in FIGS. 19 and 20, the massage machine 400 according to the second embodiment has reclining means 323 for causing the backrest unit 12 to recline against the seat unit 11. The backrest unit 12 is configured to be capable of reclining forward to and rearward from the seat unit 11 by using an actuator 324 serving as the reclining means 323 disposed below the seat unit 11. The backrest unit 12 performs an upright operation and a reclining operation. In this manner, it is possible to change an upright posture to a reclining posture in which a backrest surface is substantially horizontal. The control unit 310 and the actuator 324 are electrically connected to each other.

Figure 22:
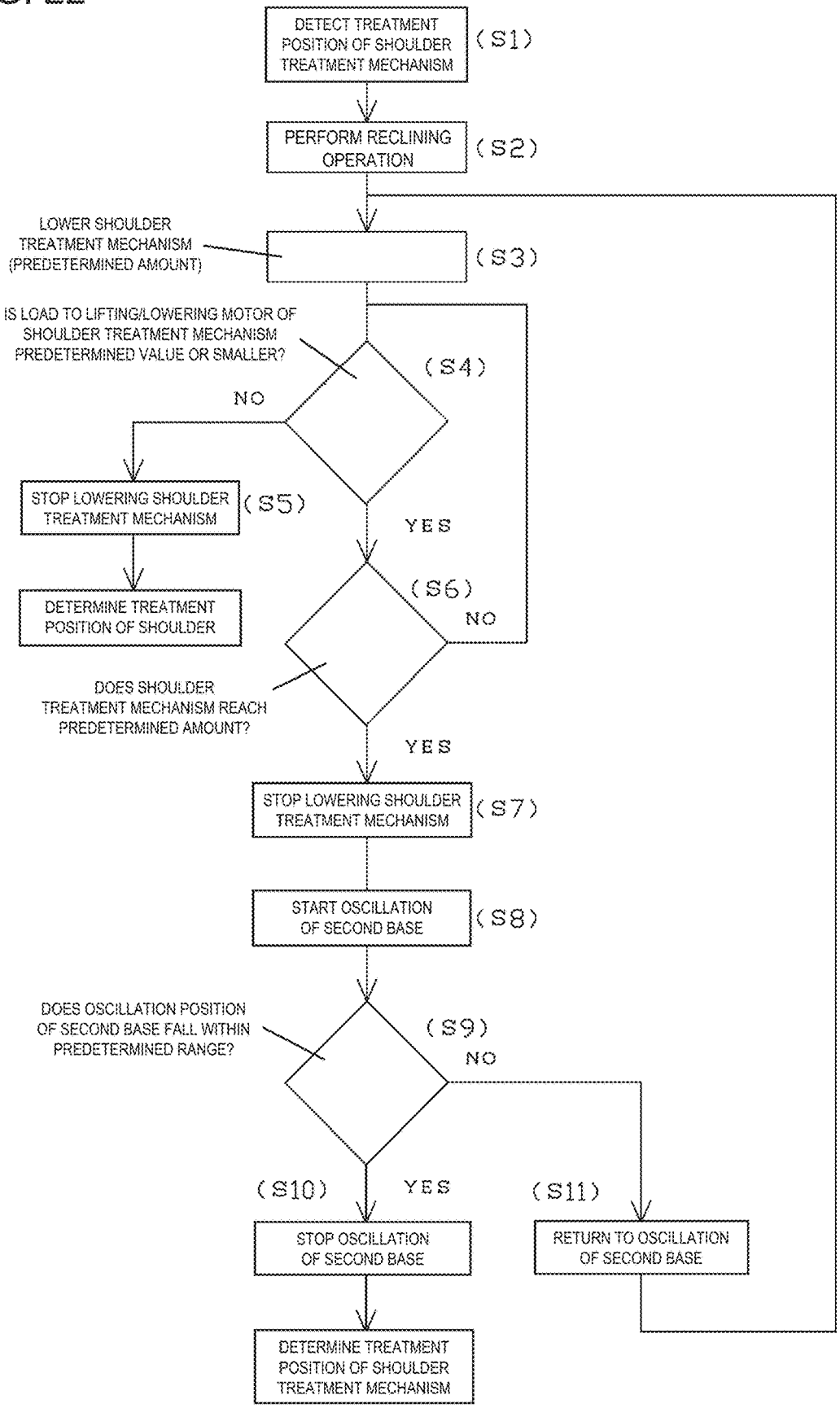
FIG. 22 is a view illustrating an operation flow of the massage machine according to the second embodiment.
Figure 23:
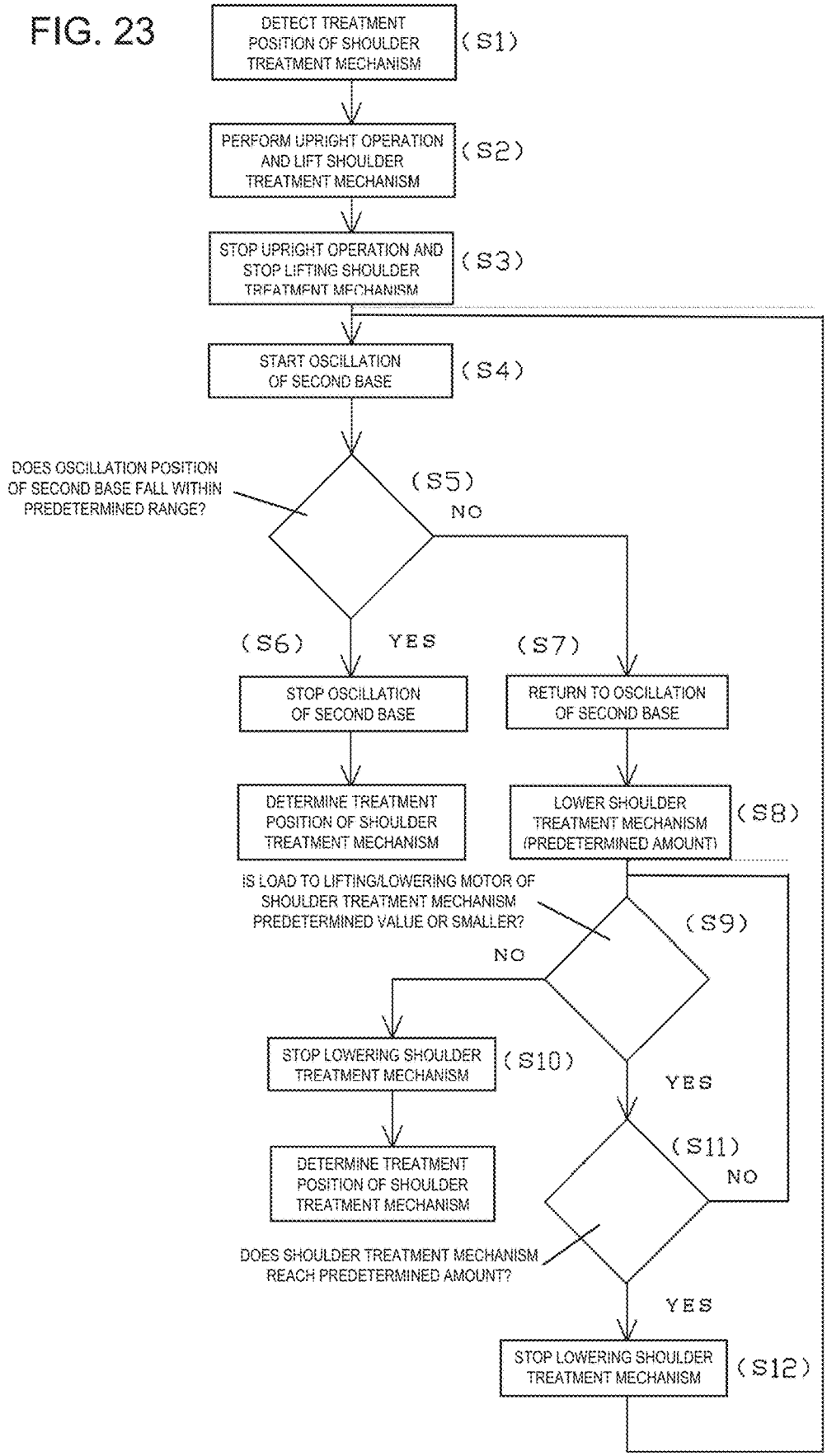
FIG. 23 is a view illustrating an operation flow of the massage machine according to the second embodiment.

Correction of the treatment position of the shoulder treatment mechanism 200 by using reclining of the massage machine 400 according to the second embodiment will be described with reference to FIGS. 22 and 23. FIG. 22 illustrates a correction operation flow of the treatment position of the shoulder treatment mechanism 200 when the reclining operation is performed. FIG. 23 illustrates a correction operation flow of the treatment position of the shoulder treatment mechanism 200 when the upright operation is performed.

A correction operation of the treatment position of the shoulder treatment mechanism 200 when the reclining operation is performed will be described.

As illustrated in FIG. 22, the control unit 310 detects the treatment position of the shoulder treatment mechanism 200 described above (Step S1). Subsequent to Step S1, the actuator 324 causes the backrest unit to perform the reclining operation on the seat unit 11 (Step S2). In Step S2, downward positional misalignment of the treatment subject person occurs with respect to the backrest unit 12, and the treatment position of the shoulder treatment mechanism 200 which is detected in Step S1 is not suitable for the treatment subject person. Accordingly, it is necessary to correct the treatment position where the position misalignment occurs with respect to the backrest unit 12.

The shoulder treatment mechanism 200 is lowered by a predetermined amount (Step S3). The predetermined amount is a slight movement amount until the shoulder treatment mechanism 200 comes into contact with the shoulder, since the downward positional misalignment of the treatment subject person occurs with respect to the backrest unit 12 but the shoulder treatment mechanism 200 is located close to the shoulder. For example, the predetermined amount is a movement amount obtained by the lifting/lowering motor 131 rotated several times for several seconds. In Step S3, the load of the lifting/lowering motor 131 is determined (Step S4). In a case where there is no load applied to the lifting/lowering motor 131 and the current value is equal to or smaller than the predetermined value, the process proceeds to Step S6 where it is determined whether the shoulder treatment mechanism 200 reaches the predetermined amount. However, in a case where the load is applied to the lifting/lowering motor 131 and the current value is equal to or greater than the predetermined value, the process proceeds to Step S5 where the lifting/lowering motor 131 is stopped. In a case where the process proceeds to Step S5, the lifting/lowering motor 131 is stopped, and the lowering operation of the shoulder treatment mechanism 200 is stopped. The stop position of the shoulder treatment mechanism 200 at this time is determined as the treatment position of the shoulder treatment mechanism 200. In Step S6, the first detection means 320 determines whether the shoulder treatment mechanism 200 reaches the predetermined amount. After the determination, in a case where the shoulder treatment mechanism 200 does not reach the predetermined amount, the process returns to Step S3 so as to continue the lowering operation. In a case where the shoulder treatment mechanism 200 reaches the predetermined amount, the lifting/lowering motor 131 is stopped, and the lowering operation of the shoulder treatment mechanism 200 is stopped (Step S7).

Subsequent to Step S7, the air bag 307 serving as the biasing member 239 is inflated between the bottom portion 212 of the first base 211 and the bottom portion 217 of the second base 216, and the second base 216 is caused to oscillate in order to bring the first treatment device 261 into contact with the shoulder of the treatment subject person (Step S8). In Step S8, the second detection means 321 detects the oscillation position including whether or not the first treatment device 261 comes into contact with the shoulder of the treatment subject person. It is determined whether or not the oscillation position of the second base 216 falls within a predetermined range (Step S9). After the determination, if the oscillation position of the second base 216 falls within the predetermined range, the air bag 307 is held, and the oscillation is stopped (Step S10). The stop position of the shoulder treatment mechanism 200 and the oscillation stop position of the second base 216 at this time are determined as the treatment position of the shoulder treatment mechanism 200. After the determination, it is determined that the oscillation position of the second base 216 is out of the predetermined range, that is, it is determined that the first treatment device 261 is not in contact with the shoulder of the treatment subject person. The air bag 307 is deflated, and the oscillation of the second base 216 returns to an initial position. The process proceeds to Step S3 so as to repeatedly perform the processes until the treatment position of the shoulder treatment mechanism 200 is determined (Step S11). Biasing means such as a spring is used in the returning direction of the second base 216. In this manner, the second base 216 can return to the initial position only by deflating the air bag 307. In this way, it is possible to correct the treatment position of the shoulder treatment mechanism 200 where the positional misalignment of the treatment subject person occurs with respect to the backrest unit 12 due to the reclining operation. Therefore, even if the posture is changed, the treatment can be performed at the suitable treatment position.

A correction operation of the treatment position of the shoulder treatment mechanism 200 when the upright operation is performed will be described.

As illustrated in FIG. 23, the control unit 310 detects the treatment position of the shoulder treatment mechanism 200 described above (Step S1). Subsequent to Step S1, the actuator 324 causes the backrest unit 12 to perform the upright operation on the seat unit 11, and lifts the shoulder treatment mechanism 200 (Step S2). During the upright operation, upward positional misalignment of the treatment subject person occurs with respect to the backrest unit 12. Accordingly, the shoulder treatment mechanism 200 is lifted at the same time. Subsequent to Step S2, the upright operation is stopped, and lifting the shoulder treatment mechanism 200 is stopped at the same time (Step S3).

Subsequent to Step S3, the air bag 307 serving as the biasing member 239 is inflated between the bottom portion 212 of the first base 211 and the bottom portion 217 of the second base 216, and the second base 216 is caused to oscillate in order to bring the first treatment device 261 into contact with the shoulder of the treatment subject person (Step S4). In Step S4, the second detection means 321 detects the oscillation position including whether or not the first treatment device 261 comes into contact with the shoulder of the treatment subject person. It is determined whether or not the oscillation position of the second base 216 falls within a predetermined range (Step S5). After the determination, if the oscillation position of the second base 216 falls within the predetermined range, the air bag 307 is held, and the oscillation is stopped (Step S6). The stop position of the shoulder treatment mechanism 200 and the oscillation stop position of the second base 216 at this time are determined as the treatment position of the shoulder treatment mechanism 200. After the determination, it is determined that the oscillation position of the second base 216 is out of the predetermined range, that is, it is determined that the first treatment device 261 is not in contact with the shoulder of the treatment subject person. The air bag 307 is deflated, and the oscillation of the second base 216 returns to an initial position (Step S7). Biasing means such as a spring is used in the returning direction of the second base 216. In this manner, the second base 216 can return to the initial position only by deflating the air bag 307.

Subsequent to Step S7, the shoulder treatment mechanism 200 is lowered by a predetermined amount (Step S8). The predetermined amount is a slight movement amount until the shoulder treatment mechanism 200 comes into contact with the shoulder, since the shoulder treatment mechanism 200 is not yet in contact with the shoulder but is located close to the shoulder. For example, the predetermined amount is a movement amount obtained by the lifting/lowering motor 131 rotated several times for several seconds. In Step S8, the load of the lifting/lowering motor 131 is determined (Step S9). In a case where there is no load applied to the lifting/lowering motor 131 and the current value is equal to or smaller than the predetermined value, the process proceeds to Step S11 where it is determined whether the shoulder treatment mechanism 200 reaches the predetermined amount. However, in a case where the load is applied to the lifting/lowering motor 131 and the current value is equal to or greater than the predetermined value, the process proceeds to Step S10 where the lifting/lowering motor 131 is stopped. In a case where the process proceeds to Step S10, the lifting/lowering motor 131 is stopped, and the lowering operation of the shoulder treatment mechanism 200 is stopped. The stop position of the shoulder treatment mechanism 200 at this time is determined as the treatment position of the shoulder treatment mechanism 200. In Step S11, the first detection means 320 determines whether the shoulder treatment mechanism 200 reaches the predetermined amount. After the determination, in a case where the shoulder treatment mechanism 200 does not reach the predetermined amount, the process returns to Step S8 so as to continue the lowering operation. In a case where the shoulder treatment mechanism 200 reaches the predetermined amount, the lifting/lowering motor 131 is stopped, and the lowering operation of the shoulder treatment mechanism 200 is stopped. The process proceeds to Step S4 so as to repeatedly perform the processes until the treatment position of the shoulder treatment mechanism 200 is determined (Step S12). In this way, it is possible to correct the treatment position of the shoulder treatment mechanism 200 where the position misalignment of the treatment subject person occurs with respect to the backrest unit 12 due to the upright operation.

Figure 24:
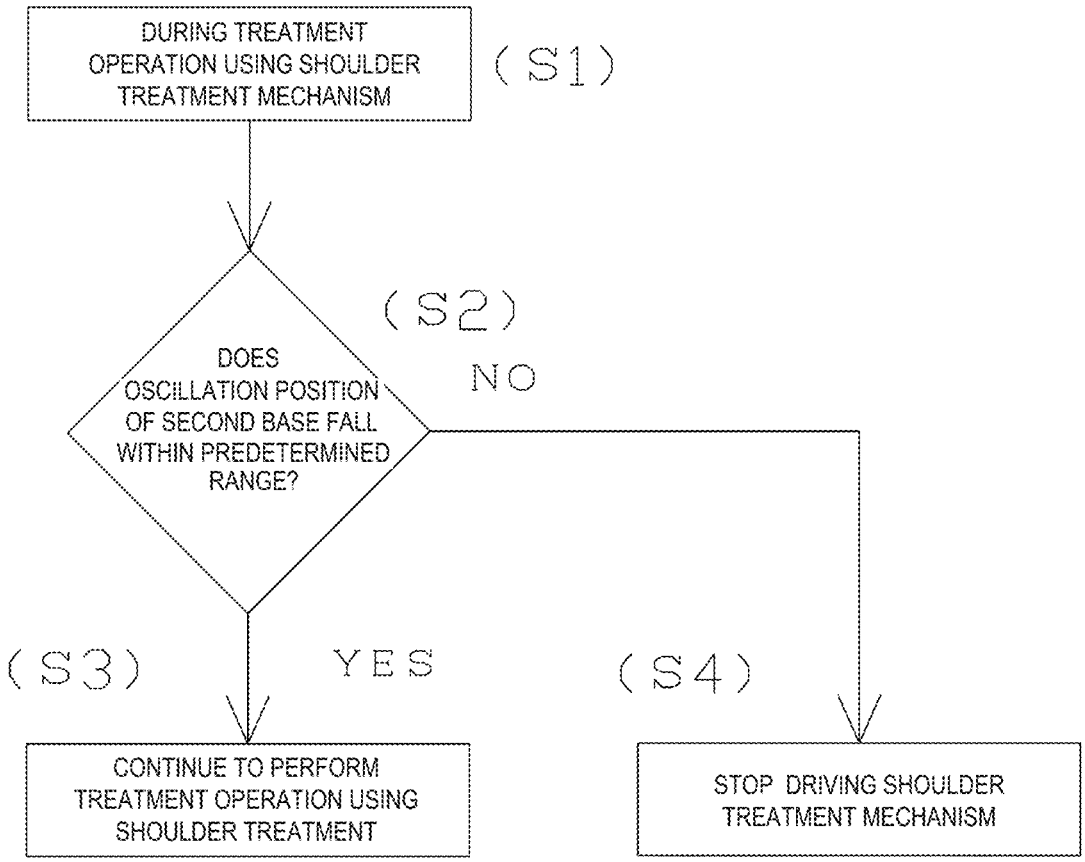
FIG. 24 is a view illustrating an operation flow of the massage machine according to the second embodiment.

An operation of the shoulder treatment mechanism 200 of the massage machine 400 according to the second embodiment will be described with reference to FIG. 24. FIG. 24 illustrates an operation flow when the shoulder treatment mechanism 200 is separated from the treatment subject person during the treatment using the shoulder treatment mechanism 200.

As illustrated in FIG. 24, the control unit 310 drives the treatment motor 231 of the shoulder treatment mechanism 200, the drive unit of the lifting/lowering motor 131, and the air supply/discharge unit 301 so as to perform the treatment on the shoulder of the treatment subject person (Step S1). In Step S1, the second detection means 321 detects the oscillation position including whether or not the first treatment device 261 comes into contact with the shoulder of the treatment subject person. It is determined whether or not the oscillation position of the second base 216 falls within a predetermined range (Step S2). After the determination, if the oscillation position of the second base 216 falls within the predetermined range, the shoulder treatment mechanism 200 continues to perform the treatment without any change (Step S3). After the determination, in a case where it is determined that the oscillation position of the second base 216 is out of the predetermined range, that is, it is determined that the first treatment device 261 is not in contact with the shoulder of the treatment subject person, driving the shoulder treatment mechanism 200 is stopped (Step S4). The reason that the first treatment device 261 is changed from a state of being in contact with the shoulder of the treatment subject person to a non-contact state is as follows. For example, during the treatment, the treatment subject person himself or herself manually operates the shoulder treatment mechanism 200 so to lift the shoulder treatment mechanism 200. In a case where a phone call is made to the treatment subject person and the treatment subject person is separated from the massage machine 400 during the treatment, the oscillation position of the second base 216 is located within the predetermined range since the first treatment device is in contact with the shoulder of the treatment subject person. However, the oscillation position is changed to be located out of the predetermined range since the first treatment device is not in contact with the shoulder of the treatment subject person. In this way, when the treatment subject person is separated from the shoulder treatment mechanism 200 during the treatment using the shoulder treatment mechanism 200, it is detected that the treatment subject person is separated therefrom, and driving the shoulder treatment mechanism 200 is stopped. In this manner, the treatment subject person can be safely separated from the massage machine 400. In addition, a configuration can be adopted so as not to perform the treatment on the head when the shoulder treatment mechanism 200 moves close to the head during the treatment using the shoulder treatment mechanism 200.

(3) Third Embodiment

(a) Treatment Device

Figure 25:
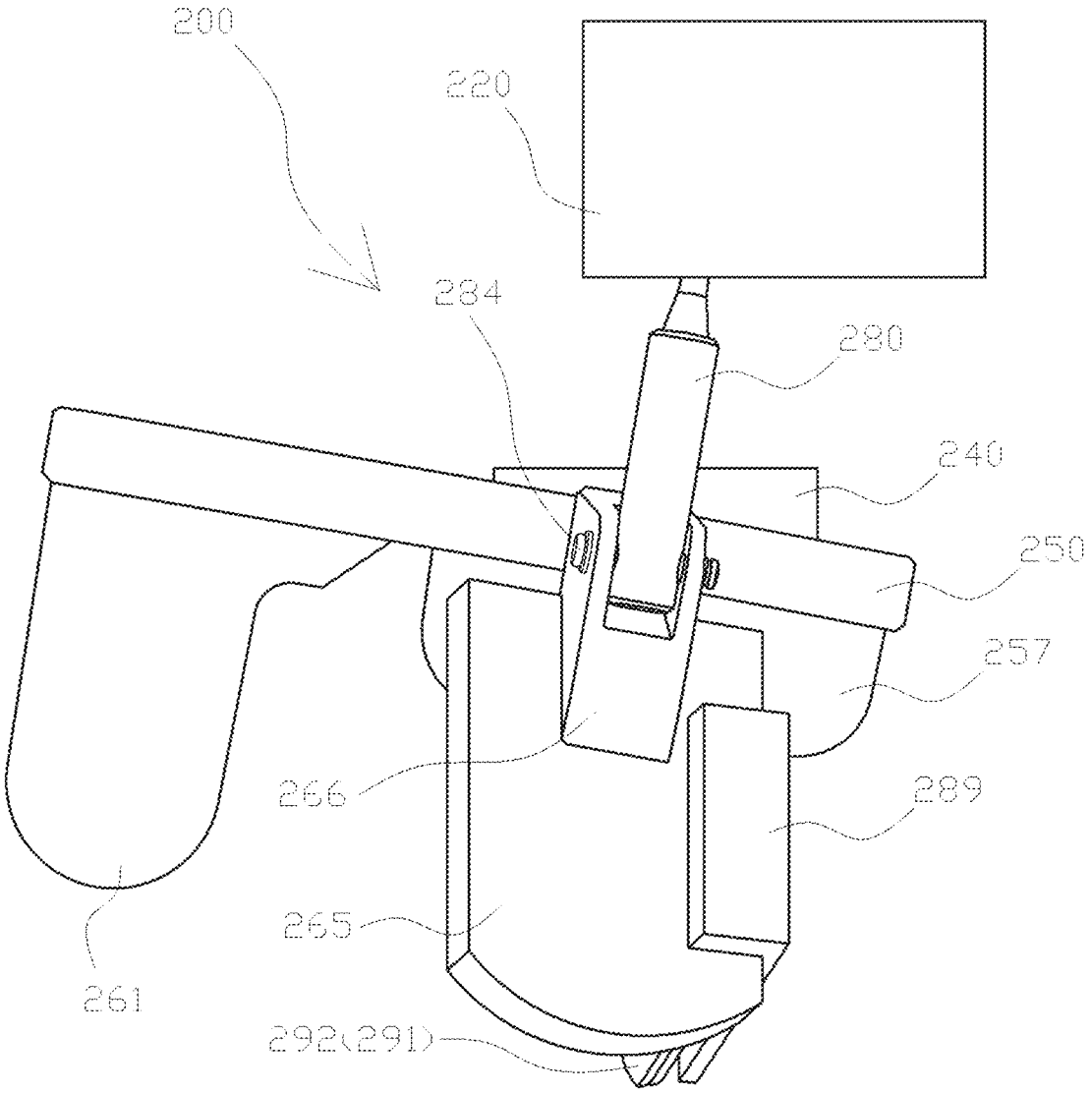
FIG. 25 is a front view of a shoulder treatment mechanism according to a third embodiment.
Figure 26:
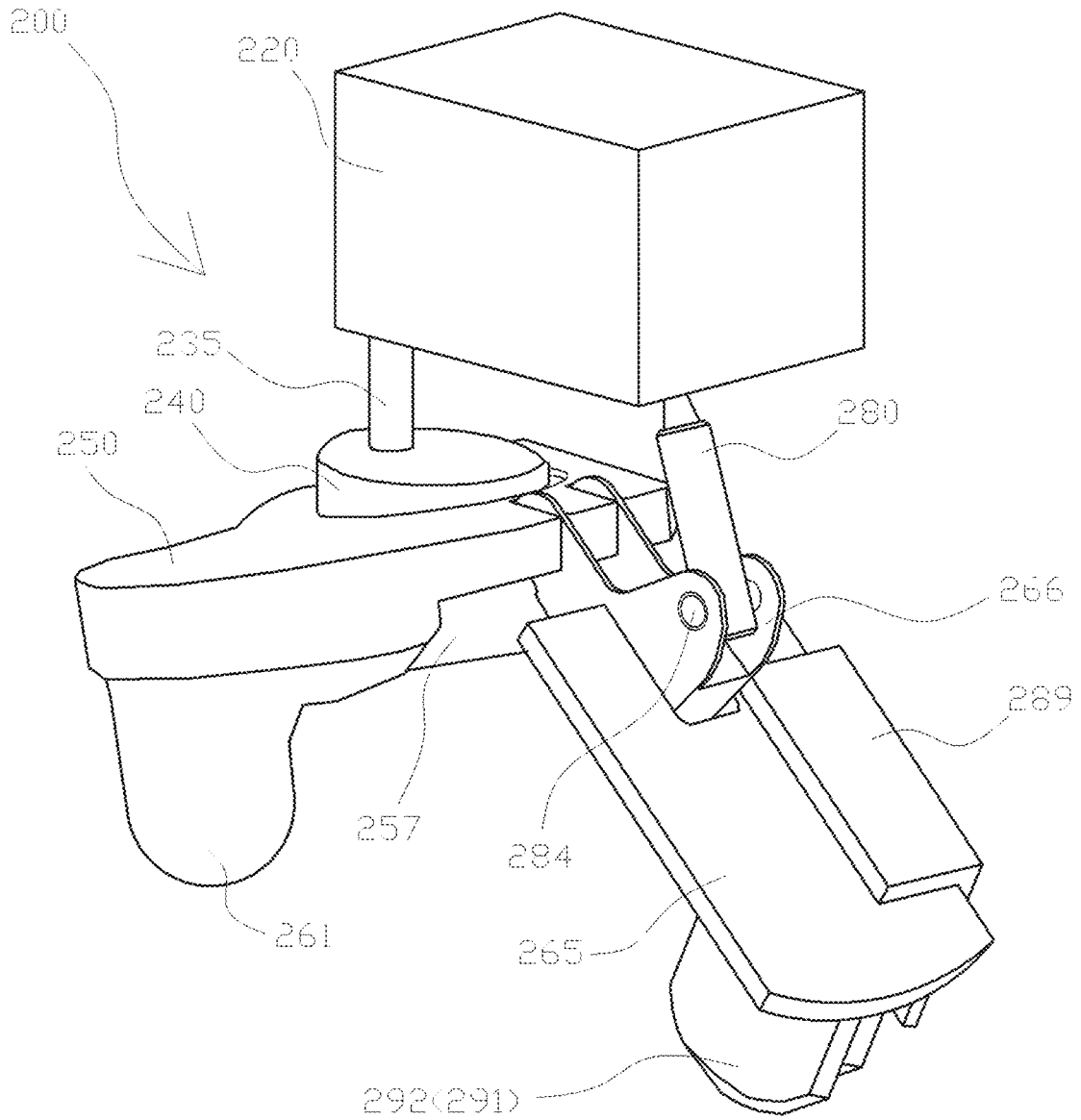
FIG. 26 is a perspective view of the shoulder treatment mechanism according to the third embodiment.
Figure 27:
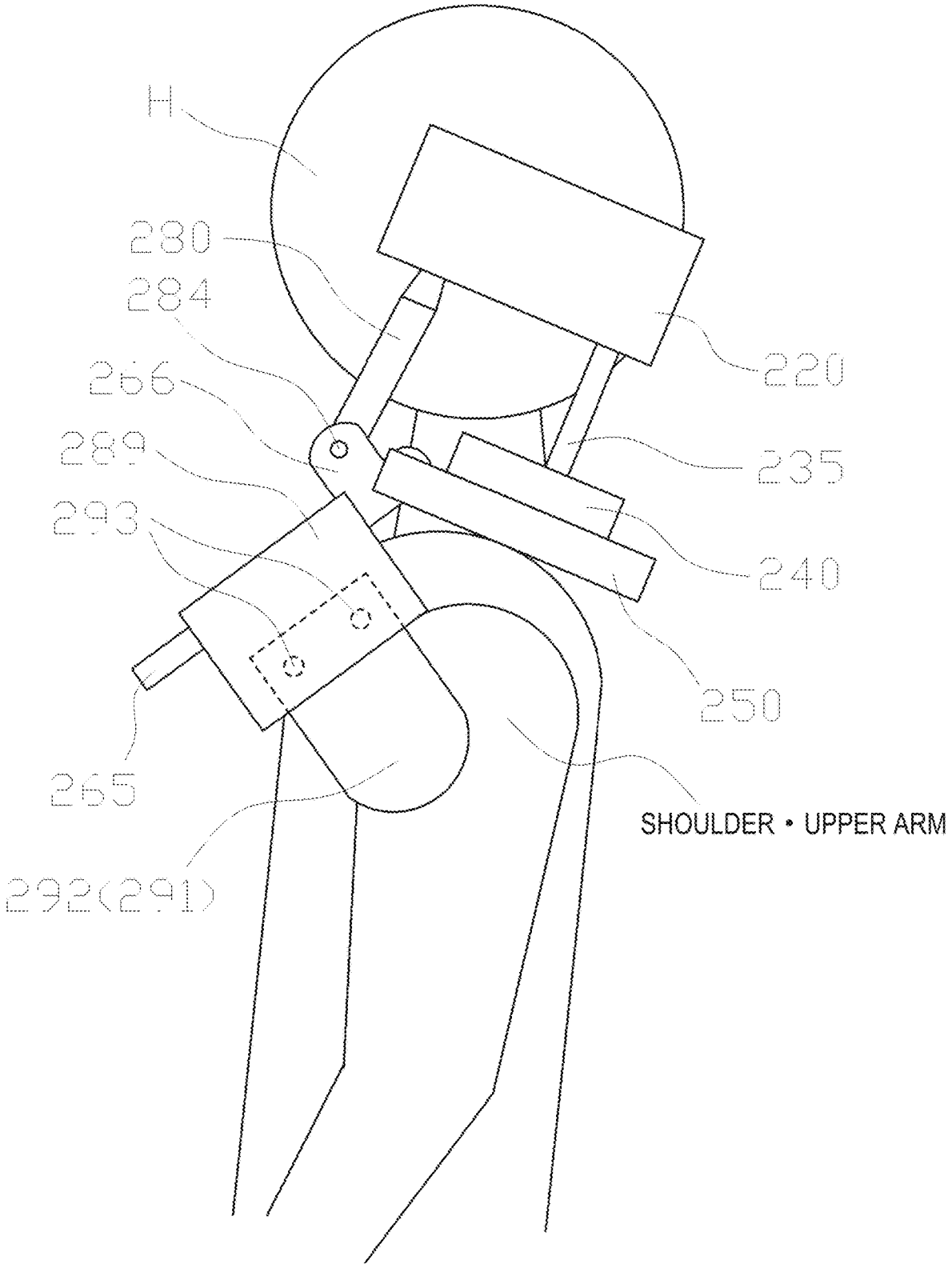
FIG. 27 is a side view illustrating a state where the shoulder treatment mechanism according to the third embodiment is brought into contact with a treatment subject person.

FIG. 25 is a front view of the shoulder treatment mechanism 200 according to a third embodiment. FIG. 26 is a perspective view of the shoulder treatment mechanism 200 according to the third embodiment. FIG. 27 is a side view illustrating a state where the shoulder treatment mechanism 200 according to the third embodiment is brought into contact with a treatment subject person H. A basic configuration of the third embodiment is the same as that of the first embodiment, and each configuration of the second treatment device 265, a side wall portion 289, and a fourth treatment device 291 of the shoulder treatment mechanism 200 are different from that according to the first embodiment.

As illustrated in FIGS. 25 to 27, the second treatment device 265 is configured to include a plate-shaped member. An air bag (not illustrated) may be disposed on a rear surface (surface which comes into contact with the treatment subject person H) of the second treatment device 265. The air-assisting treatment can be performed by disposing the air bag thereon.

The side wall portion 289 is attached to a front surface (surface opposite to the surface which comes into contact with the treatment subject person H) of the second treatment device 265. The side wall portion 289 is configured to include a substantially L-shaped plate member. The rear surface on the short side of the plate member and the front surface of the second treatment device are fixed to each other. The fourth treatment device 291 is attached to an inner side surface in the rightward/leftward direction on the long side. That is, the side wall portion 289 is attached to the second treatment device 265 so as to protrude rearward from the outside in the width direction of the second treatment device 265.

The fourth treatment device 291 is attached to the inner side of the side wall portion 289. The fourth treatment device 291 is located so as to face at least the shoulder outer surface or the upper arm outer surface of the treatment subject person H. The fourth treatment device 291 has an air bag 292. The air bag 292 is attached via an interlocking pin 293 by setting a front side (side closer to the second treatment device 265) in the forward/rearward direction front side of the side wall portion 289, as a fulcrum. The air bag 292 can adjust the strength of the treatment as follows. The above-described air supply/discharge unit 301 holds a state where the air bag 292 is brought into contact with at least the shoulder outer surface or the upper arm outer surface of the treatment subject person H from the front side. The pressing treatment is performed by repeatedly inflating and deflating the air bag 292. The air amount of the air bag 292 is adjusted. In this way, the strength of the treatment suitable for the individual can be adjusted, and the air bag 292 can be held in accordance with the body shape of the individual. In addition, the operation of the second treatment device 265 and the operation of the fourth treatment device 291 may be combined with each other. For example, while the second treatment device 265 performs the treatment on the shoulder or the upper arm of the treatment subject person H from the front side and/or from above, the fourth treatment device 291 further performs the treatment on the shoulder outer surface or the upper arm outer surface from the lateral side. That is, treatment can be performed on the shoulder or the upper arm of the treatment subject person H in three directions by the first treatment device 261, the second treatment device 265, and the fourth treatment device 291.

In the third embodiment, a configuration employing one second treatment devices 265 is employed will be described. However, a plurality of the second treatment devices 265 may be employed. In a case of employing the plurality of second treatment devices 265, a configuration may be adopted so that the plurality of second treatment devices 265 can be respectively and independently driven. Alternatively, the second treatment devices 265 may be respectively operated in conjunction with the link mechanism. In this way, the operation of the shoulder treatment mechanism 200 can be performed in various manners.

In the above-described embodiments, a case has been described as an example in which the massage machines 1 and 400 have the shoulder treatment mechanism 200 for performing the treatment on the shoulder as an example of the treatment mechanism. However, instead of the shoulder treatment mechanism 200, or in conjunction with the shoulder treatment mechanism 200, the massage machines 1 and 400 can be applied to a treatment mechanism 300 for performing the treatment on various sites of the body of the treatment subject person, such as the neck, the arm (upper arm or forearm), the back or the waist, the hip, and the leg (thigh or calf) or the foot (hereinafter, sometimes referred to as each body site).

In this case, the treatment mechanism 300 can be suitably located for each body site of the treatment subject person. Specifically, as illustrated in FIGS. 28 to 34, the treatment can be performed as if a person (treatment providing person) performs the treatment for the treatment subject person on the neck, the arm (upper arm or forearm), the back or the waist, the hip, and the leg (thigh or calf) or the foot of the treatment subject person.

FIGS. 28 to 34 schematically illustrate a case where the treatment is performed on each body site of the person. In FIGS. 31(*a*), 33, and 34, a site P1 indicated by an arc drawn using a dotted line shows the first treatment device 261, a site P2 indicated by an arc drawn using a solid line shows the second treatment device 265.

Figure 33:
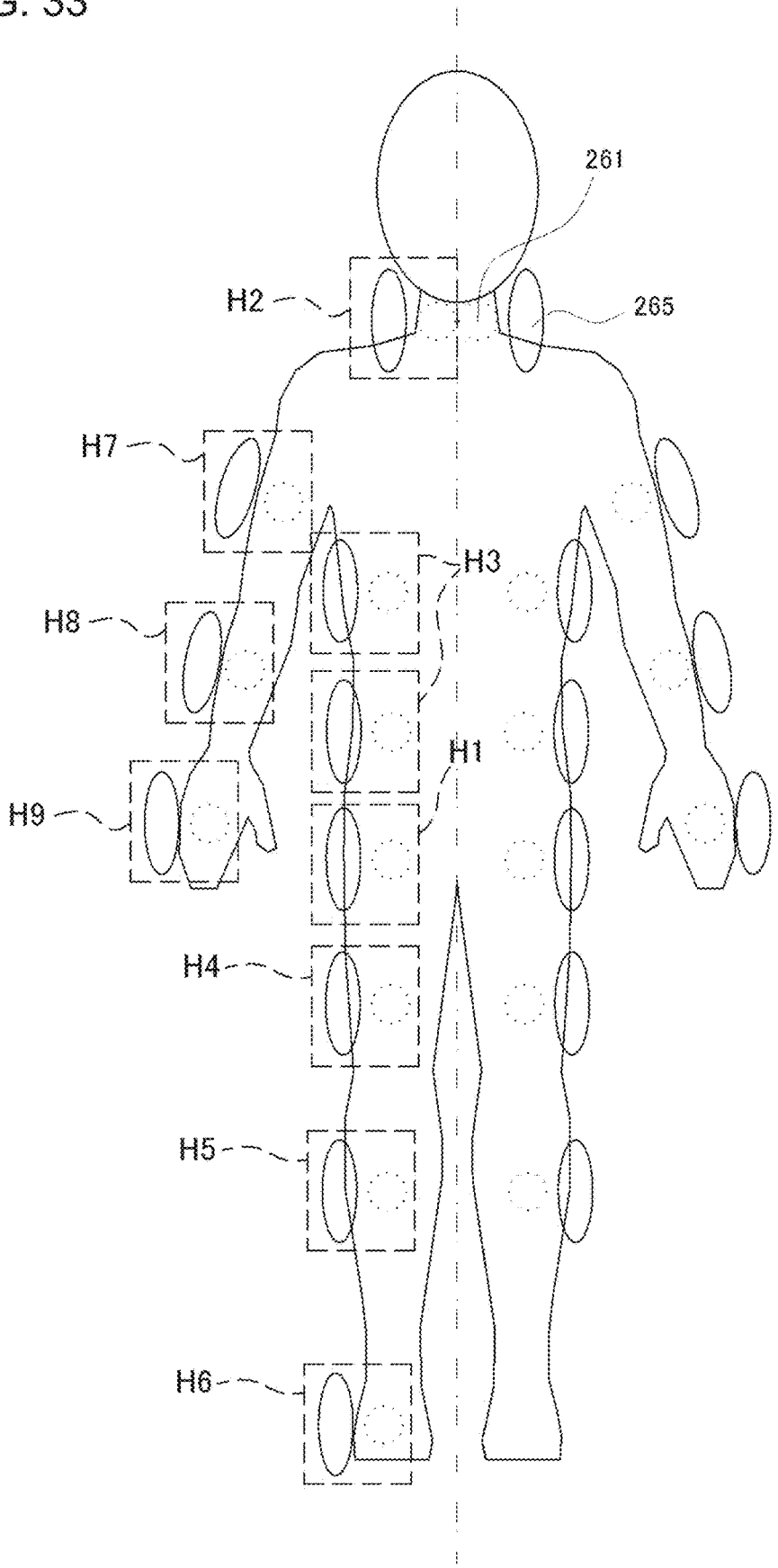
FIG. 33 is a schematic view illustrating a state where the first treatment device is located so as to face inward in a rightward/leftward direction of a user and the second treatment device is located so as to face outward in the rightward/leftward direction of the user.
Figure 34:
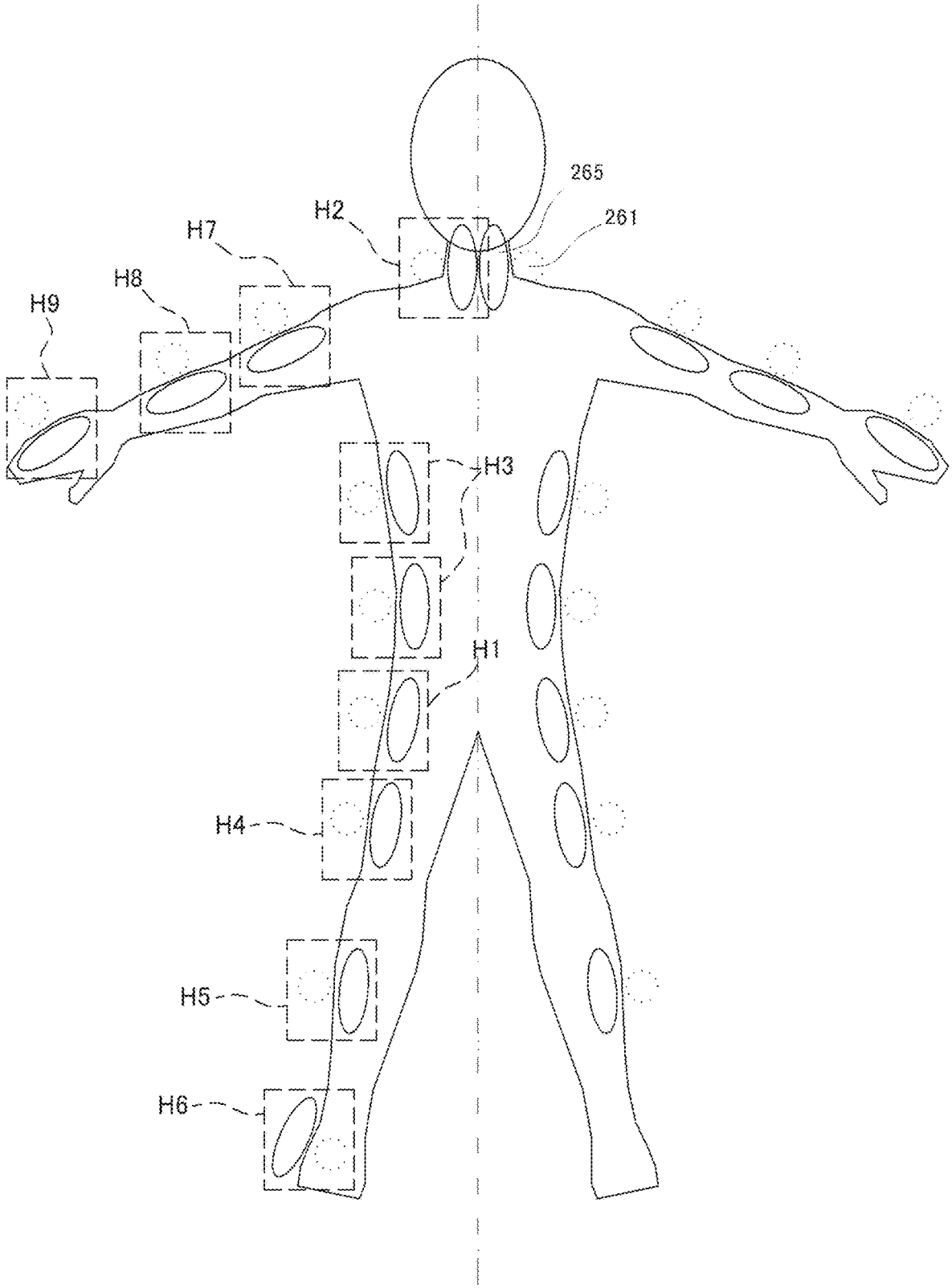
FIG. 34 is a schematic view illustrating a state where the first treatment device is located so as to face outward in the rightward/leftward direction of the user and the second treatment device is located so as to face inward in the rightward/leftward direction of the user.

FIGS. 33 and 34 illustrate a hip H1, a neck H2, a back (including the waist) H3, a thigh H4, a calf H5, a toe (including foot sole) H6, an upper arm H7, a forearm H8, and a finger H9. In this way, exemplary description will be additionally made on an aspect in which the treatment mechanism 300 for performing the treatment on these sites is disposed in the massage machine 1.

Hereinafter, in a case of describing each body site of the treatment subject person, an abdominal side of the treatment subject person will be defined as a "front side," a back side will be defined as a "rear side," a right hand side will be defined as a "right side," a left hand side will be defined as a "left side," a head side will be defined as an "upper side," and a foot side will be defined as a "lower side." In addition, a direction parallel to the shoulder width direction of the treatment subject person will be defined as the "rightward/leftward direction," a direction parallel to a direction rearward from the front side will be defined as a "forward/rearward direction," and a direction perpendicular to both the width direction and the forward/rearward direction will be defined as the "upward/downward direction." In addition, hereinafter, unless otherwise specifically described, in a case of describing directions such as "leftward" or "rightward" in the "rightward/leftward direction," "forward" or "rearward" in the "forward/rearward direction," and "upward" or "downward" in the "upward/downward direction," all of these may be simply described as "leftward" or "rightward," "forward" or "rearward," and "upward" or "downward," in some cases. For example, the right side and rightward in the rightward/leftward direction may be simply described as the "right side" or "rightward" side," in some cases. In addition, a direction closer to a center line (broken line) side illustrated in FIGS. 30 and 31 will be defined as "inward," and a direction away from the center line (broken line) will be defined as "outward."

The human body has a symmetrical shape on the left side and the right side. Accordingly, with regard to the hip H1 to the finger H9, description will be additionally made only on the right or left side of the body of the treatment subject person, and the other side of the body will be omitted in the description.

Figure 28:
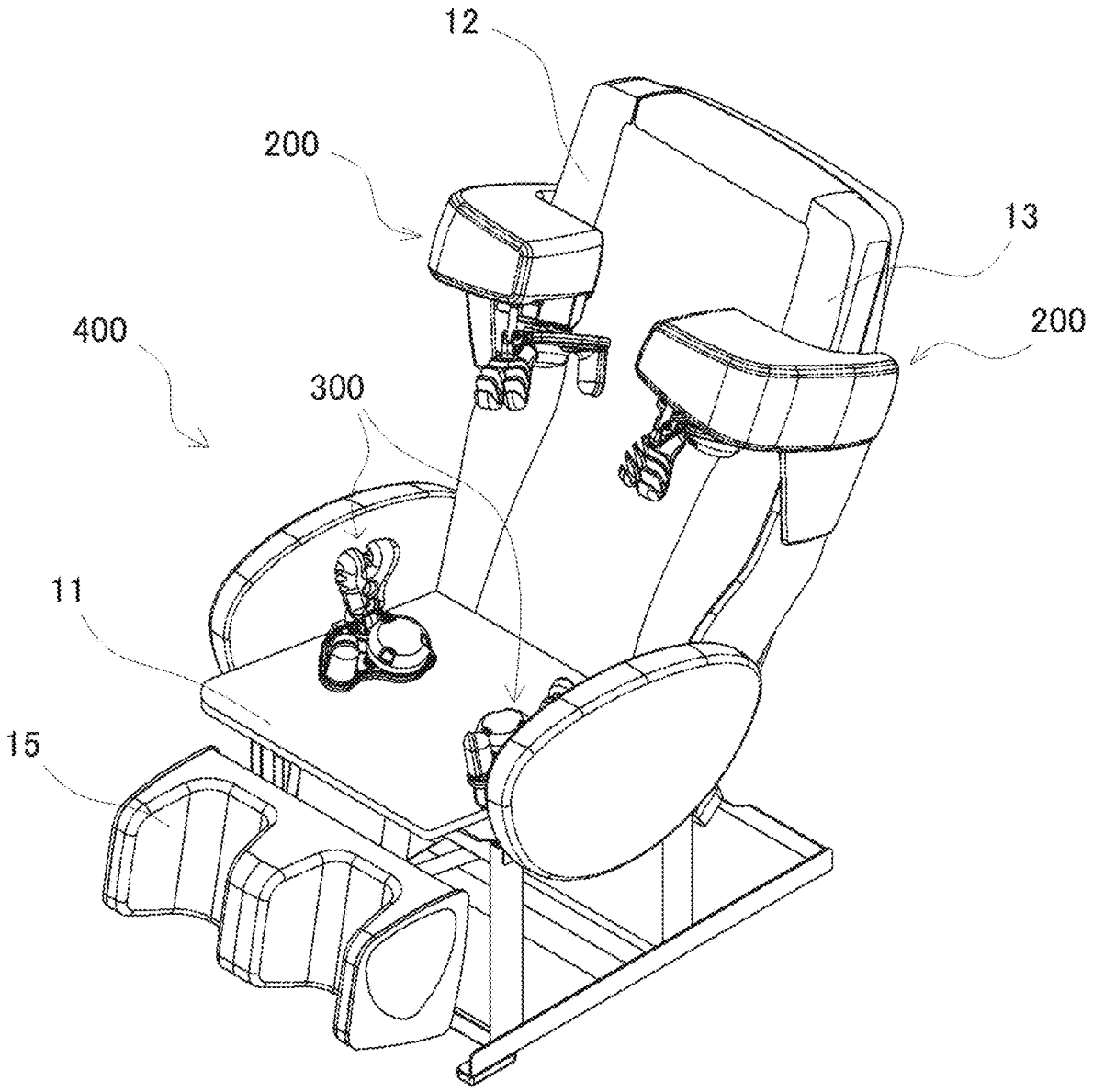
FIG. 28 is a schematic view illustrating a massage machine in which a treatment mechanism is applied to a seat unit.

As illustrated in FIGS. 28 and 33, in a case of performing the treatment on the hip H1 on the right side, the second treatment device 265 is located on the outer side (right side) of the hip H1 on the right side, and the first treatment device 261 is located on the inner side (back surface side). In a case of disposing the treatment mechanism 300 for performing the treatment on the hip H1 in the massage machine 1, as illustrated in FIG. 28, the treatment mechanism 300 is disposed on both right and left sides of the seat unit 11. In the treatment mechanism 300, the first treatment device 261 and the cover 257 come into contact with the inner side of the hip H1, and the second treatment device 265 is located so as to come into contact with the outer side of the hip H1. As illustrated in FIG. 34, with regard to the hip H1, the second treatment device 265 may be located so as to come into contact with the inner side (back surface side).

Figure 29:
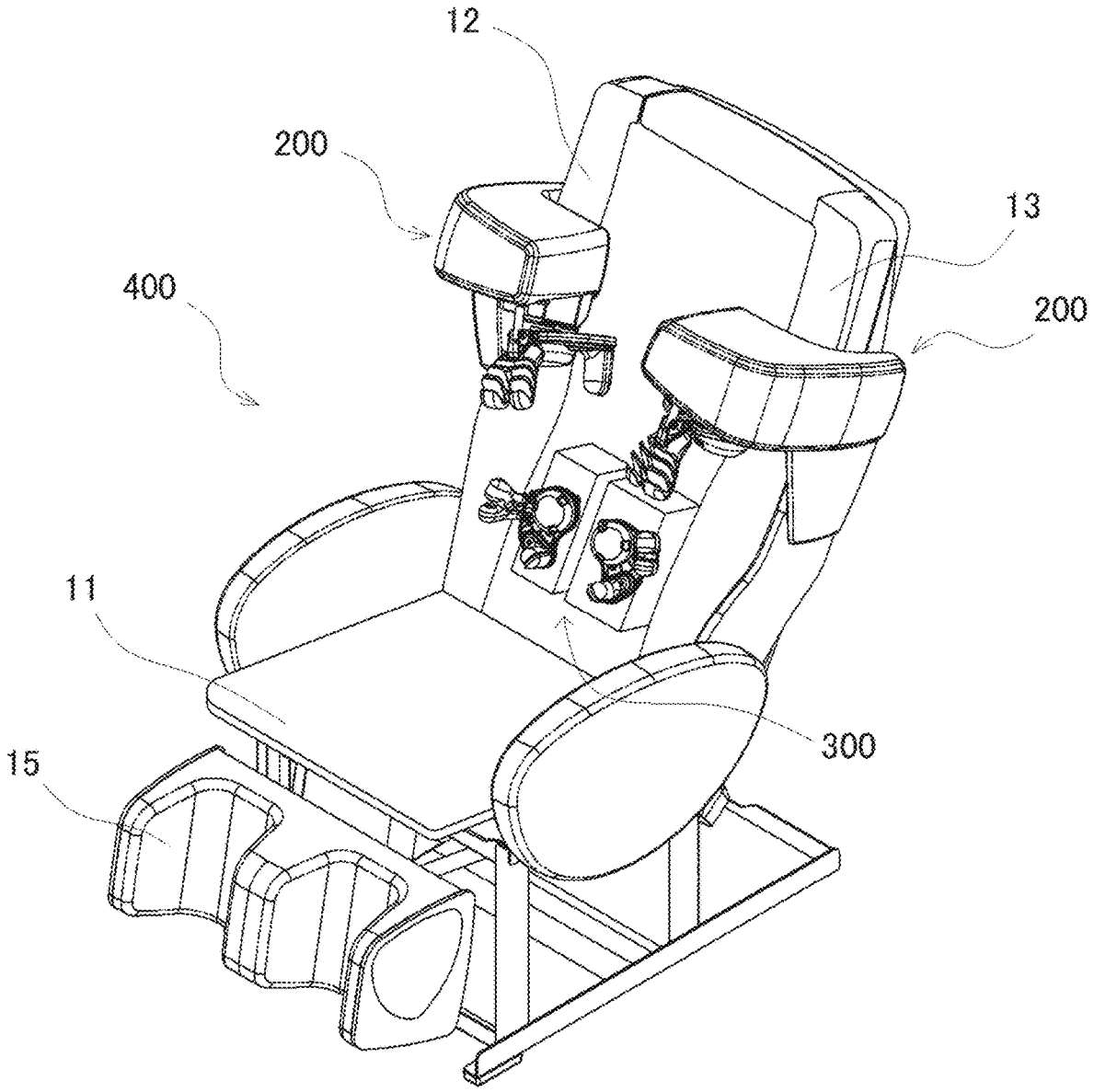
FIG. 29 is a schematic view illustrating a massage machine in which the treatment mechanism is applied to a backrest unit.

As illustrated in FIGS. 29 and 33, in a case of performing the treatment on the neck H2 on the right side, the second treatment device 265 is located on the outer side (right side surface) of the neck H2, and the first treatment device 261 is located on the inner side (back surface side). In a case of disposing the treatment mechanism 300 for performing the treatment on the neck H2 in the massage machine 1, for example, the treatment mechanism 300 is disposed in the upper portion or the upper end portion of the backrest unit 12. The treatment mechanism 300 is located so that the first treatment device 261 and the cover 257 come into contact with the inner side of the neck H2 and the second treatment device 265 comes into contact with the outer side of the neck H2. As illustrated in FIG. 34, with regard to the neck H2, the second treatment device 265 may be located so as to come into contact with the right side surface.

In addition, in a case of performing the treatment on the back and/or the waist H3 on the right side, the second treatment device 265 is located on the outer side (right side surface) of the back and/or the waist H3, and the first treatment device 261 is located on the inner side (back surface side). In the case of disposing the treatment mechanism 300 for performing the treatment on the back H3 in the massage machine 1, for example, the treatment mechanism 300 is disposed in the backrest unit 12. The treatment mechanism 300 is located so that the first treatment device 261 and the cover 257 come into contact with the inner side of the back H3 and the second treatment device 265 comes into contact with the outer side of the back H3. As illustrated in FIG. 34, with regard to the back H3, the second treatment device 265 may be located so as to come into contact with the right side surface.

As illustrated in FIGS. 28 and 33, in a case of performing the treatment on the thigh H4 on the right side, the second treatment device 265 is located on the outer side (right side surface) of the thigh H4, and the first treatment device 261 is located on the inner side (back surface side). In the case of disposing the treatment mechanism 300 for performing the treatment on the thigh H4 in the massage machine 1, for example, the treatment mechanism 300 is disposed in the seat unit 11 (refer to FIG. 28) or the upper end portion of the footrest unit 15. The treatment mechanism 300 is located so that the first treatment device 261 and the cover 257 come into contact with the inner side of the thigh H4 and the second treatment device 265 comes into contact with the outer side of the thigh H4. As illustrated in FIG. 34, with regard to the thigh H4, the second treatment device 265 may be located so as to come into contact with the right side surface.

Figure 30:
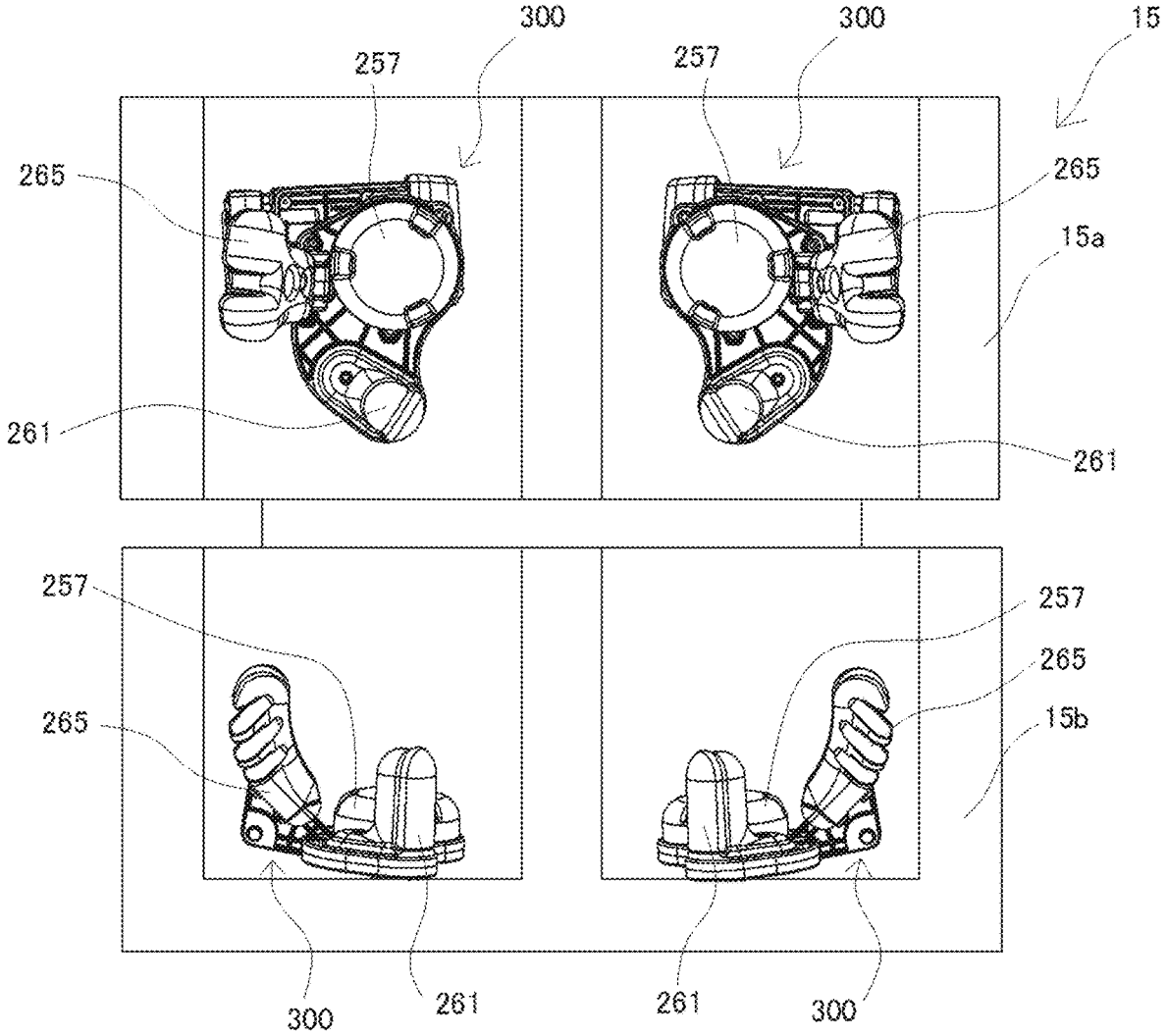
FIG. 30 is a schematic view illustrating a state where the treatment mechanism is applied to a footrest unit configured to include a leg unit and a foot unit.
Figure 31A:
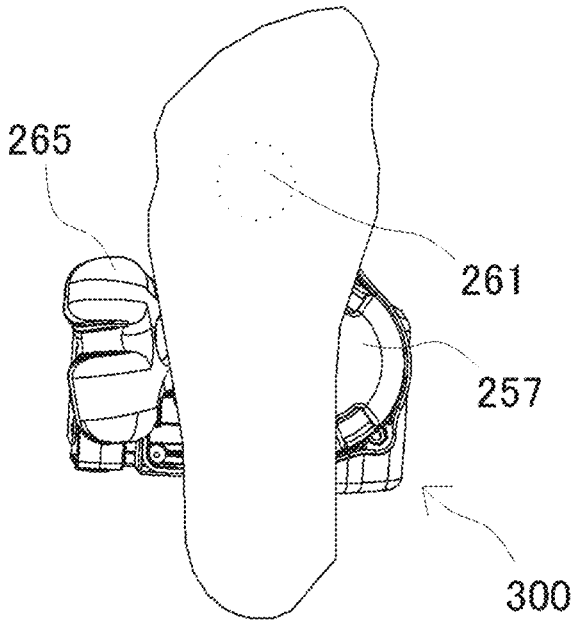
FIGS. 31A and 31B are schematic views illustrating a case where the treatment mechanism performs treatment on a treatment subject site.
Figure 31B:
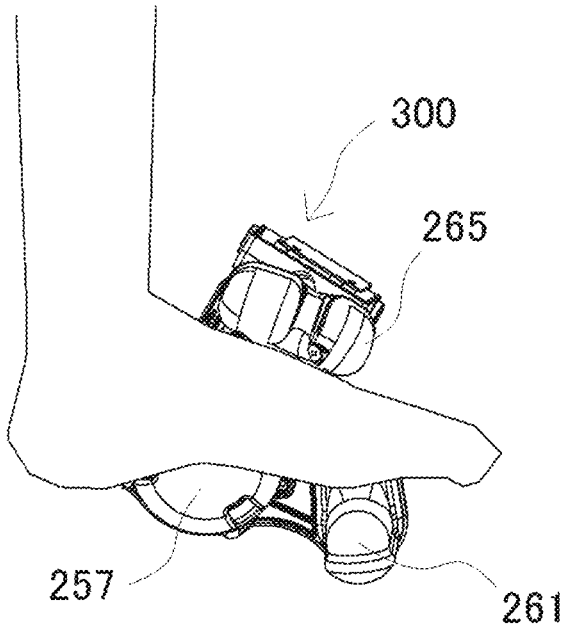

As illustrated in FIG. 30, the footrest unit 15 is configured to include a leg unit 15*a* and a foot unit 15*b*. As illustrated in FIG. 33, in a case of performing the treatment on the calf H5 on the right side, the second treatment device 265 is located on the outer side (right side surface) of the calf H5, and the first treatment device 261 is located on the inner side (back surface side). In a case of disposing the treatment mechanism 300 for performing the treatment on the calf portion H7 in the massage machine 1, for example, the treatment mechanism 300 is disposed in each recess of the leg unit 15*a* and the foot unit 15*b*. The treatment mechanism 300 is located so that the first treatment device 261 and the cover 257 come into contact with the inner side of the calf H5 and the second treatment device 265 comes into contact with the outer side of the thigh H4. As illustrated in FIGS. 31A and 31B, with regard to the calf H5, the second treatment device 265 may be located so as to come into contact with the left side surface.

As illustrated in FIGS. 30, 31A, 31B, and 33, in case of performing the treatment on the foot sole or the foot side surface H6 of the foot of the treatment providing person, the footrest unit 15 is configured to include the leg unit 15*a* and the foot unit 15*b*. The foot unit 15*b* is disposed in the lower end of or below the leg unit 15*a*, and the treatment mechanism 300 is disposed in the foot unit 15*b*, thereby enabling both of these to correspond to each other.

FIGS. 31A and 31B schematically illustrate a case where the treatment is performed on the left foot H6 of the human body. In FIGS. 31A and 31B, a site P1 indicated by an arc drawn using a dotted line shows the first treatment device 261.

FIG. 31A illustrates a case where the first treatment device 261 is located in the foot sole of the left foot H6 and the second treatment device 265 is located on the outer side (left side surface) of the foot sole of the left foot H6. In this manner, the treatment can be performed as if a person (treatment providing person) performs the treatment in a state where four fingers are located on the outer side of the foot of the treatment subject person and the thumb is located in the foot sole. As illustrated in FIG. 34, it is possible to adopt an aspect in which the second treatment device 265 is located on the inner side (right side surface) of the foot sole of the left foot H6.

In addition, FIG. 31B illustrates a case where the second treatment device 265 is located on the outer side (left side surface) of the foot sole of the left foot H6 and the first treatment device 261 is located in the foot sole of the left foot H6. In this manner, the treatment can be performed as if the person (treatment providing person) performs the treatment in a state where four fingers are located on the outer side of the foot of the treatment subject person and the thumb is located in the foot sole. As illustrated in FIG. 34, it is possible to adopt an aspect in which the second treatment device 265 is located on the inner side (right side surface) of the foot sole of the left foot H6.

Figure 32:
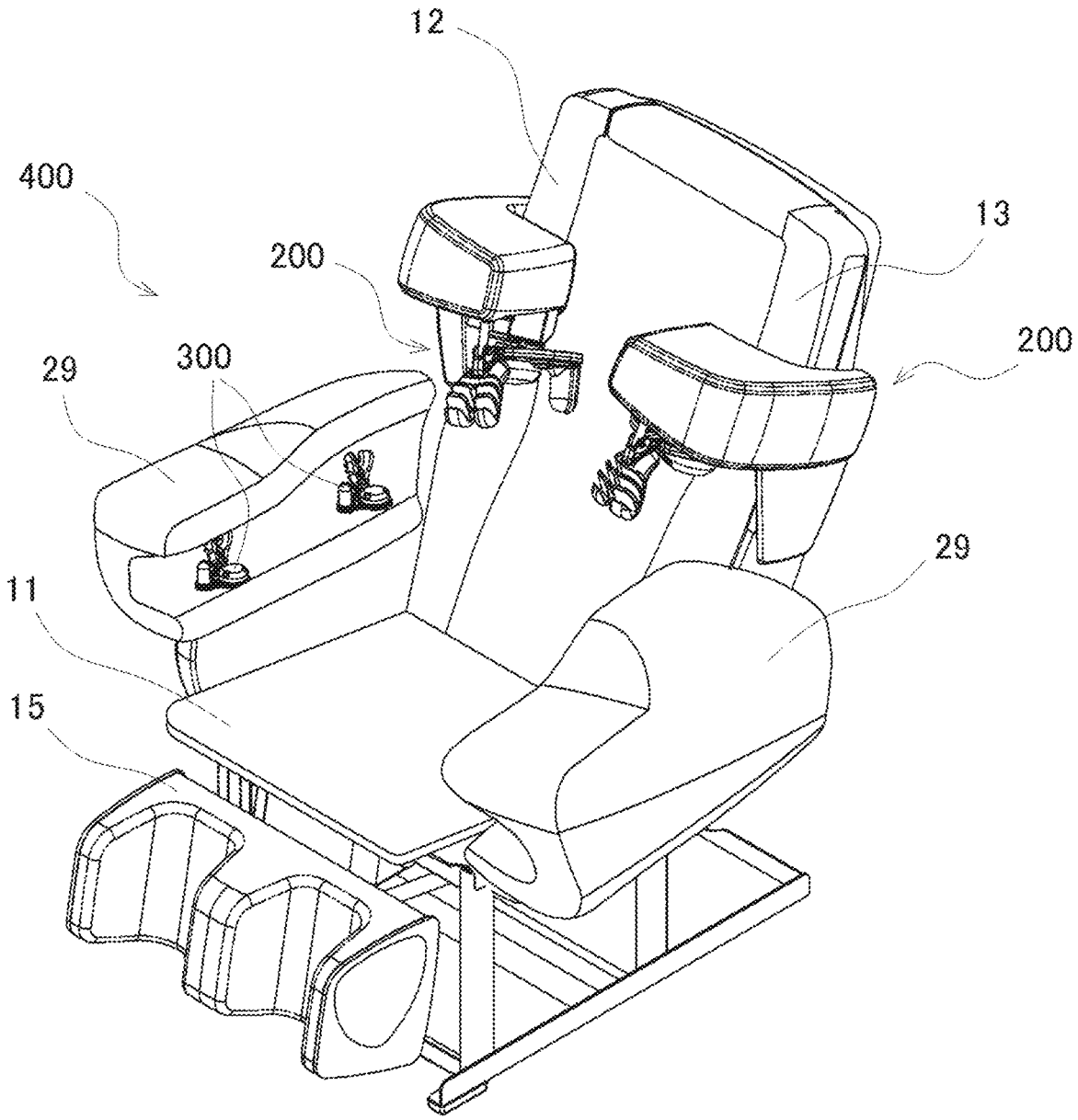
FIG. 32 is a schematic view illustrating a massage machine in which the treatment mechanism is applied to an armrest unit.

As illustrated in FIGS. 32 and 33, in a case of performing the treatment on the upper arm H7 on the right side, the second treatment device 265 is located on the outer side (right side surface) of the upper arm H7, and the first treatment device 261 is located on the inner side (back surface side). In a case of disposing the treatment mechanism 300 for performing the treatment on the upper arm H7 in the massage machine 1, for example, the armrest unit 29 is disposed on a side portion of the seat unit 11 (refer to FIG. 32), and the treatment mechanism 300 is disposed inside the armrest unit 29. The treatment mechanism 300 is located so that the first treatment device 261 and the cover 257 come into contact with the inner side of the upper arm H7 and the second treatment device 265 comes into contact with the outer side of the upper arm H7. As illustrated in FIG. 34, with regard to the upper arm H7, the second treatment device 265 may be located so as to come into contact with the right side surface.

In a case of performing the treatment on the forearm H8 on the right side, the second treatment device 265 is located on the outer side (right side surface) of the forearm H8, and the first treatment device 261 is located on the inner side (back surface side). In a case of disposing the treatment mechanism 300 for performing the treatment on the forearm H8 in the massage machine 1, for example, the armrest unit 29 is disposed on the side portion of the seat unit 11 (refer to FIG. 32), and the treatment mechanism 300 is disposed inside the armrest unit 29. The treatment mechanism 300 is located so that the first treatment device 261 and the cover 257 come into contact with the inner side of the forearm H8 and the second treatment device 265 comes into contact with the outer side of the forearm H8. As illustrated in FIG. 34, with regard to the forearm H8, the second treatment device 265 may be located so as to come into contact with the right side surface.

In a case of performing the treatment on the finger H9 on the right side, the second treatment device 265 is located on the outer side (right side surface) of the finger H9, and the first treatment device 261 is located on the inner side (back surface side). In a case of disposing the treatment mechanism 300 for performing the treatment on the finger H9 in the massage machine 1, for example, the armrest unit 29 is disposed on the side portion of the seat unit 11 (refer to FIG.

32), and the treatment mechanism 300 is disposed inside the armrest unit 29. The treatment mechanism 300 is located so that the first treatment device 261 and the cover 257 come into contact with the inner side of the finger H9 and the second treatment device 265 comes into contact with the outer side of the finger H9. As illustrated in FIG. 34, with regard to the finger H9, the second treatment device 265 may be located so as to come into contact with the right side surface.

In the above-described embodiments, a case has been described as an example where the treatment mechanism 300 is disposed in the massage machine 1 which is a massage chair so as to perform the treatment on the treatment subject site of the treatment subject person. However, the present invention is not limited to the case where the treatment mechanism 300 is disposed in the massage machine 1 which is the massage chair.

For example, the treatment mechanism 300 can be used as follows. One end of the treatment mechanism 300 is fixed to the ground, and a so-called robot arm having one, two or more joints driven by an instruction drive unit is disposed on the other end side of the fixed end portion. In this manner, the treatment mechanism 300 can perform the treatment on any desired body site or whole body of the treatment subject person, which includes the shoulder, the back, the neck, the arm, the leg, and the foot of the treatment subject person. For example, in a state where the treatment subject person lies on a bed, the treatment mechanism 300 is disposed in the other end of the robot arm whose one end is fixed to the bed. In this manner, and the treatment mechanism 300 can perform the treatment on the body of the treatment subject person.

In this case, a control unit to be operated in accordance with an instruction of the treatment providing person is disposed in the robot arm, and the robot arm is controlled by the control unit, based on the instruction of the treatment providing person, thereby enabling the robot arm to perform the treatment on the treatment subject person. For example, the treatment subject person can input desired instructions to the control unit as follows. The desired instructions of the treatment subject person can include which body site wants to receive the treatment, how the treatment subject person wants to receive the treatment, and what is the preferred sequence of the treatment. In this manner, the robot arm is driven by the control unit, thereby enabling the treatment mechanism 300 to perform the treatment on the site corresponding to the desired instructions.

It should be understood that the invention is not limited to the above-described embodiment, but may be modified into various forms on the basis of the spirit of the invention. Additionally, the modifications are included in the scope of the invention.

What is claimed is:

1. A massage machine comprising:

a seat unit on which a treatment subject person is configured to sit;

a backrest unit configured to support a back of the person sitting on the seat unit;

a base that is disposed in front of the backrest unit; and a shoulder treatment mechanism that is attached to the base configured to perform a massage on a shoulder of the person in a state where the person sits on the seat unit, wherein the shoulder treatment mechanism includes:

a drive unit which includes an output shaft attached to the base and rotated by supplied power, the output shaft extends in an upward/downward direction, and a treatment device configured to press the shoulder from above, and wherein in accordance with rotation of the output shaft, the treatment device oscillates in the upward/downward direction so as to perform the treatment on the shoulder;

wherein the shoulder treatment mechanism further includes:

a swash plate cam obliquely attached to the output shaft, and a treatment device holder attached to the swash plate cam so as to oscillate in the upward/downward direction without being rotated together by rotation of the swash plate cam; and wherein the treatment device is integrally attached to the treatment device holder.

2. A massage machine comprising:

a seat unit on which a treatment subject person is configured to sit;

a backrest unit that is configured to support a back of the person when sitting on the seat unit;

a base that is disposed in front of the backrest unit; and a shoulder treatment mechanism that is attached to the base so as to perform a massage on a shoulder of the person in a state where the person sits on the seat unit, wherein the shoulder treatment mechanism includes:

a drive unit that includes an output shaft attached to the base so as to be rotated by supplied power, the output shaft extends in an upward/downward direction, a first treatment device which is configured to press the shoulder from above, and a second treatment device, wherein when viewed along a width direction of the backrest unit, the second treatment device is located in front of the first treatment device, wherein when viewed along the width direction of the backrest unit, in accordance with rotation of the output shaft, the first treatment device and the second treatment device are configured to perform treatment on the shoulder in conjunction with each other so as to change a distance between the first treatment device and the second treatment device;

wherein the shoulder treatment mechanism further includes:

a swash plate cam which is obliquely attached to the output shaft, and a treatment device holder which is attached to the swash plate cam so as to oscillate in the upward/downward direction without being rotated together by rotation of the swash plate cam, wherein the first treatment device is integrally attached to the treatment device holder, and wherein the second treatment device is attached so that a base end side is oscillable around an oscillation axis extending along the width direction in which the treatment device holder is disposed, and a tip side performs the treatment on the shoulder.

3. The massage machine according to claim 1 or 2, wherein the base includes a first base and a second base, wherein the second base is attached to the first base so that a base end side of the second base is oscillable, wherein the drive unit is attached to the second base, and wherein a biasing member for biasing a tip side of the second base in a direction away from the first base is provided between the first base and the second base.

4. The massage machine according to claim 3,
wherein the biasing member is configured to include an air bag and an air supply/discharge unit capable of inflating and deflating the air bag,
wherein the massage machine comprises a control unit capable of controlling the drive unit and the air supply/discharge unit, and
wherein the control unit is capable of controlling the drive unit and the air supply/discharge unit independently of each other.

5. The massage machine according to claim 3, further comprising:
movement means capable of moving the shoulder treatment mechanism in a height direction of the person;
first detection means for detecting a specific position in the height direction of the shoulder treatment mechanism;
second detection means for detecting an oscillation position of the second base with respect to the first base; and
a control unit capable of controlling the movement means,
wherein the control unit performs a first step of causing the first detection means to detect a specific position in a height direction of the shoulder treatment mechanism and a second step of causing the second detection means to detect an oscillation position of the second base so as to specify an optimal treatment position of the shoulder treatment mechanism with respect to the shoulder.

6. The massage machine according to claim 5,
wherein the movement means includes a lifting/lowering motor, and
wherein the control unit stops the lifting/lowering motor in a case where a load applied to the lifting/lowering motor reaches a predetermined value or greater.

7. The massage machine according to claim 5,
wherein the backrest unit includes
a mechanical treatment unit movable in the height direction with respect to the back, and
third detection means for detecting a specific position in the height direction by moving the treatment unit, and
wherein the control unit sets a shoulder position of the person which is detected by the third detection means as a reference position so as to specify a movement position of the shoulder treatment mechanism in the first step, based on the reference position.

8. The massage machine according to claim 5, further comprising:
reclining means for causing the backrest unit to recline against the seat unit,
wherein the control unit performs the first step and the second step on position misalignment of the person with respect to the backrest unit which is caused by the reclining means, and corrects a treatment position of the person in the shoulder treatment mechanism.

9. The massage machine according to claim 5,
wherein the control unit stops driving of the shoulder treatment mechanism, in a case where the oscillation position detected by the second detection means reaches a predetermined value or greater.

10. The massage machine according to claim 1 or 2,
wherein the shoulder treatment mechanism is movable in the upward/downward direction.

11. The massage machine according to claim 1 or 2,
wherein the shoulder treatment mechanism is movable in the width direction.

12. The massage machine according to claim 1 or 2, further comprising:
a pillow that supports a head of the person,
wherein the pillow includes position adjustment means which is capable of adjusting a head position of the person in the forward/rearward direction.

13. The massage machine according to claim 1 or 2,
wherein a fourth treatment device is attached to a position facing at least a shoulder outer surface or an upper arm outer surface of the person.

14. The massage machine according to claim 13,
wherein the fourth treatment device is attached to a side wall portion which protrudes rearward from an outer side in the width direction of the second treatment device.

15. The massage machine according to claim 14,
wherein the fourth treatment device includes an air bag.

16. The massage machine according to claim 15,
wherein the air bag is attached to a front side as a fulcrum in the forward/rearward direction of the side wall portion.

17. The massage machine according to claim 1 or 2,
wherein the swash plate cam is configured to include an annular bearing, and the output shaft is attached so as to be eccentric with respect to a center of the annular bearing.

18. The massage machine according to claim 2,
wherein the second treatment device is further supported by a link, and
wherein one end portion of the link is rotatably attached to the base, and the other end portion of the link supports the second treatment device so as to be oscillable around the oscillation axis extending along the width direction between the base end side and the tip side of the second treatment device.

19. The massage machine according to claim 18,
wherein the link extends in the upward/downward direction, the one end portion is located on an upper side, and the other end portion is located on a lower side.

20. The massage machine according to claim 2,
wherein a width of a tip portion of the second treatment device is wider than a width of a tip portion of the first treatment device.

21. The massage machine according to claim 2,
wherein when viewed along the width direction of the backrest unit, a tip portion of the second treatment device is located below a tip portion of the first treatment device.

22. The massage machine according to claim 2,
wherein at least one of the first and the second treatment device includes an air bag.

23. The massage machine according to claim 22, further comprising:
an air supply/discharge unit capable of inflating and deflating the air bag, and
wherein the air supply/discharge unit is capable of adjusting strength of the treatment using the air bag, and holding a treatment subject site.

24. The massage machine according to claim 23, further comprising:
a control unit capable of controlling the drive unit and the air supply/discharge unit,
wherein the control unit is capable of controlling the drive unit and the air supply/discharge unit independently of each other.

25. The massage machine according to claim 23, further comprising:

a support body that is disposed closer to the person than the air bag;

a third treatment device that is disposed in the support body; and a forward/rearward movement mechanism capable of moving the support body forward to and rearward from the person by inflating and deflating the air bag.

* * * * *